US007434511B2

(12) United States Patent
Kitawaki et al.

(10) Patent No.: US 7,434,511 B2
(45) Date of Patent: Oct. 14, 2008

(54) IMAGE RECORDING APPARATUS INCLUDING A PLURALITY OF NOTCH FORMING SECTIONS

(75) Inventors: Shiro Kitawaki, Kyoto (JP); Yoshitomo Wada, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 525 days.

(21) Appl. No.: 11/100,397

(22) Filed: Apr. 7, 2005

(65) Prior Publication Data

US 2005/0241512 A1 Nov. 3, 2005

(30) Foreign Application Priority Data

Apr. 28, 2004 (JP) ..... 2004-133760

(51) Int. Cl.
*B41F 27/12* (2006.01)

(52) U.S. Cl. ..... 101/477; 101/401.1; 101/481

(58) Field of Classification Search ..... 101/477
See application file for complete search history.

(56) References Cited

U.S. PATENT DOCUMENTS 6,016,752 A 1/2000 Harari
6,321,651 B1 11/2001 Tice et al.
6,792,861 B2 * 9/2004 Kan et al. ..... 101/477
2003/0127004 A1 7/2003 Kitawaki et al.
2003/0147107 A1 8/2003 Kawada et al.

FOREIGN PATENT DOCUMENTS

JP 2002-341561 A 11/2002

* cited by examiner

*Primary Examiner*—Leslie J Evanisko
(74) *Attorney, Agent, or Firm*—McDermott Will & Emery LLP

(57) ABSTRACT

Punches 44 of punchers 41*a* to 41*d* each punch a plate P lying immediately thereunder to form a notch. Then, stopper pins 47 of the punchers 41*c* and 41*d* abut with the deepest portion of the notch, such that the plate P is further inserted. The punches 44 of the punchers 41*a* and 41*b* each punch the plate P lying immediately thereunder to form a deeper notch. In other words, the puncher 41 is capable of forming notches of different depths along one end face of the plate P, whereby it is possible to realize various methods for positioning the plate P on the recording drum 5 in a suitable manner.

10 Claims, 31 Drawing Sheets

4 { 41, 42 }

IMAGE RECORDING APPARATUS INCLUDING A PLURALITY OF NOTCH FORMING SECTIONS

BACKGROUND OF THE INVENTION

1. Field of the Invention

The present invention relates to an image recording apparatus, a notch forming apparatus, and a method for use therewith, more particularly, relates to an image recording apparatus for forming a positioning reference on a sheet-shaped image recording material such that the image recording material is positioned and mounted on a predetermined mounting member, a notch forming apparatus for forming the positioning reference, and a method for forming the positioning reference.

2. Related Art Statement

Conventionally, color printed materials are produced through a number of processes such as an exposure process (which serves as an image recording process), a printing process, and the like. Prior to the exposure process, an original image of a color printed material is separated into a plurality of colors, which typically are: Y (Yellow), M (Magenta), C (Cyan), and K (Kuro, i.e., "black"). Thus, image data of the respective colors are generated. Such image data are supplied to a cylindrical outer surface scanning apparatus which is used for an exposure process. The cylindrical outer surface scanning apparatus incorporates a recording drum. On the outer surface of the recording drum, a sheet-shaped plate which serves as an image recording material, e.g., a so-called PS plate (Presensitized Plate) or a thermal plate, is mounted. A "PS plate" is a plate comprising a plate material (e.g., an aluminum plate, a plastic sheet, or paper) and a photo-sensitive layer preapplied on the plate material.

In the exposure process, the cylindrical outer surface scanning apparatus subjects the plate which is mounted on the outer surface of the recording drum to an exposure process in order to form an image of each of the respective separated colors on the plate based on the image data thus supplied. In other words, in the case where the original image is color-separated into Y, M, C, and K, the cylindrical outer surface scanning apparatus draws images of the four different colors on four plates.

A printing machine which is used in a printing process applies inks to the plates which have been exposed, each ink being in a color corresponding to the associated plate, so as to overlay the respective images on a final color printed material. If the images of one or more colors are misaligned with each other when overlaid, the resulting color printed material will be of an inferior quality. In order to prevent such misalignment between images, positioning holes for the printing process, which are used as a positioning reference during the printing process, are formed in predetermined positions in the plate, prior to the exposure process. Each plate can be positioned in place by fitting pins which are provided on a printing drum of the printing machine into the positioning holes for the printing process. In some cases, e.g., where the specific printing machine to be used is still undecided at the prepress stage, the positioning holes for the printing process may be formed after the prepress.

Misalignments between images may also occur if the positions of one or more images drawn during the exposure process are misaligned with respect to the plates of the corresponding colors. In order to prevent such image misalignments with respect to the plates during the exposure process, in U.S. Pat. No. 6,321,651 and Japanese Laid-Open Patent Publication No. 2002-341561, for example, positioning for a plate is performed on the outer surface of the recording drum of the cylindrical outer surface scanning apparatus.

A plurality of offset pins are provided in an apparatus disclosed in U.S. Pat. No. 6,321,651 for positioning each plate in place by changing an angle of the plate in accordance with the width thereof, such that only two pins contact an edge of the plate.

In the cylindrical outer surface scanning apparatus disclosed in Japanese Laid-Open Patent Publication No. 2002-341561, positioning pins for positioning each plate in place are provided on the outer surface of the recording drum. Together with the holes for the printing process, positioning notches for the recording drum are provided along one end of the plate, the positioning notches being configured so as to receive the positioning pins. Hereinafter, referring to FIG. 31, an outline of a plate positioning method employed in the cylindrical outer surface scanning apparatus disclosed in Japanese Laid-Open Patent Publication No. 2002-341561 will be described. FIG. 31 is a schematic view showing the simplified relative positions of the plate P, punches 501*a* to 501*c* of punchers 500*a* to 500*c*, and positioning pins 601*a* to 601*c* of a recording drum 600.

In FIG. 31, the cylindrical outer surface scanning apparatus disclosed in Japanese Laid-Open Patent Publication No. 2002-341561 includes three punchers 500*a* to 500*c*. The punches 501*a* to 501*c* are provided in the punchers 500*a* to 500*c*, respectively. The puncher 500*a* is provided to create a positioning notch which receives the positioning pin 601*a*. The punch 501*a* has a cross section in the shape of a full circle with the radius r. The punchers 500*b* and 500*c* are provided to create a non-contacting notch by which the plate P is not in contact with the positioning pins 601*b* and 601*c*. Each of the punches 501*b* and 501*c* has an elongated-circular cross section. The punches 501*a* to 501*c* are arranged in such a manner that the respective centers thereof are on the single line, with a pitch Q1 between the centers of the punches 501*a* and 501*b*, and a pitch Q2 between the centers of the punches 501*a* and 501*c*.

When a plate P having the lateral width L is led into the puncher 500, the plate P is led into an inlet of the puncher 500, so that the positioning members disposed at the back ends of the inlet come in contact with a leading end face Pe of the plate P. Specifically, the plate P is positioned in such a manner that the end face Pe coincides with or extends in parallel to the line on which the centers of the punches 501*a* to 501*c* are aligned (the illustrated plate P1 is in this state). Depending on the width L of the plate P, the punchers 500*a* to 500*c* operate to form necessary notches along the end face Pe of the plate P by the punches 501*a* to 501*c*. For example, in the case where a plate P has the width L as shown in FIG. 31, the punch 501*a* of the puncher 500*a* and the punch 501*b* of the puncher 500*b* operate to form a positioning notch Pae and a non-contacting notch Pbe, respectively, along the end face Pe of the plate P.

On the other hand, three positioning pins 601*a* to 601*c* are provided on the outer surface of the recording drum 600. Each of the positioning pins 601*a* to 601*c* has a cross-section in the shape of a full circle with the radius r. The positioning pins 601*b* and 601*c* are located at an offset of a distance r along the circumferential direction of the recording drum 5 with respect to the positioning pin 601*a*. The positioning pins 601*b* and 601*c* are disposed at the intra-central pitches Q1 and Q2 from the positioning pin 601*a*, respectively, along the axial direction of the recording drum 600.

In the case where the plate P which is prefabricated with the positioning notch Pae and the non-contacting notch Pbe is positioned on the recording drum 600 with the positioning pins 601*a* to 601*c* provided thereon, the plate P is positioned in place as the positioning pin 601*a* fits in the positioning notch Pae of the plate P and the end face Pe of the plate P abuts with the positioning pin 601*c*. Note that the plate P is not in contact with the positioning pin 601*b* because of the non-contacting notch Pbe being formed (the illustrated plate P2 is in this state).

In accordance with the conventional cylindrical outer surface scanning apparatus, a plate is positioned in place in such a manner that two positioning pins are in contact with a positioning notch and an end face of the plate, respectively. A non-contacting notch is formed so that the plate is not in contact with the positioning pins which are not used for positioning. Specifically, only the positioning notch Pae is formed in a short-width plate P, and the short-width plate P is positioned in place by utilizing the positioning pins 601*a* and 601*b*. The positioning notch Pae and a non-contacting notch Pce, which is formed by a puncher 500*c*, are formed in a medium-width plate P, and the medium-width plate P is positioned in place by utilizing the positioning pins 601*a* and 601*b* (the positioning pin 601*c* is not in contact with the plate P due to the non-contacting notch Pce). As shown in FIG. 31, the positioning notch Pae and the non-contacting notch Pbe are formed in a long-width plate P, and the long-width plate P is positioned in place by utilizing the positioning pins 601*a* and 601*c* (the positioning pin 601*b* is not contact with the plate P due to the non-contacting notch Pbe).

As described above, in order to prevent image misalignments with respect to the plates during the exposure process, positioning pins for positioning each plate in place are provided on the outer surface of the recording drum of the cylindrical outer surface scanning apparatus. Together with the holes for the printing process, positioning notches for the recording drum are provided along one end of the plate, the positioning notches being configured so as to receive the positioning pins. Thus, the positioning notches for the recording drum and the positioning holes for the printing process are formed in each plate prior to an exposure process. During the exposure process, the positioning notches for the recording drum can be used as a reference for aligning the images to be exposed. During the printing process, the positioning holes for the printing process can be used as a reference for aligning the images to be printed.

However, in accordance with the apparatus disclosed in U.S. Pat. No. 6,321,651, some plates having a certain width maybe positioned in an unstable manner. Specifically, in the case where the plate is disposed so as to be in abutment with two positioning pins, a plate whose corner is barely in contact with a third pin located at the outer side of any of the two positioning pins cannot be stably positioned due to its width. Also, in the case where the accuracy of the end face of a plate is not insured, such inaccuracy may affect the positioning accuracy.

Also, in accordance with the cylindrical outer surface scanning apparatus disclosed in Japanese Laid-Open Patent Publication No. 2002-341561, a center of the two positioning pins being in contact with a positioned plate is misaligned with respect to a center of the plate. Such a misalignment may result in instability of positioning of the plate. In addition to this, the puncher 500*a* is always used for creating a positioning notch, whereas the punchers 500*b* and 500*c* are always used for creating a non-contacting notch. In other words, since the positioning notch Pae created by the puncher 500*a* is always used for positioning, a lateral width of the plate P extendable in the direction of the positioning notch Pae (i.e., the right side of FIG. 31) is restricted. Furthermore, a positioning pin to be always used is fixed, thereby reducing positioning flexibility of the plate to be stabilized on the recording drum.

SUMMARY OF THE INVENTION

Therefore, an object of the present invention is to provide an image recording apparatus for recording an image on a sheet-shaped image recording material mounted thereon, a notch forming apparatus, and a method for use therewith, which are capable of positioning the image recording material with accuracy and a high degree of flexibility in selecting a position thereof without being restricted by the lateral width of the image recording apparatus.

The present invention has the following features to attain the object mentioned above.

The first aspect of the present invention is directed to an image recording apparatus for recording an image on a sheet-shaped image recording material mounted thereon. The image recording apparatus comprises a mounting member, a first positioning member, a second positioning member, a third positioning member, a first notch forming section, a second notch forming section, a third notch forming section, and a mounting mechanism. The mounting member has a predetermined mounting surface on which the image recording material is mounted. The first positioning member is fixed on the mounting surface of the mounting member. The second positioning member is fixed on the mounting surface of the mounting member and located at a first pitch from the first positioning member with respect to a predetermined direction. The third positioning member is fixed on the mounting surface of the mounting member and located at a second pitch, which is greater than the first pitch, from the first positioning member with respect to the predetermined direction, so that the third positioning member is further away from the first positioning member than the second positioning member. The first notch forming section forms, along one end of the image recording material, either a positioning notch to be fitted with the first positioning member or a non-contacting notch, which is deeper than the positioning notch, for preventing the first positioning member from coming in contact with the image recording material. The second notch forming section is located at the first pitch from the first notch forming section for forming, along one end of the image recording material, either a positioning notch to be fitted with the second positioning member or a non-contacting notch, which is deeper than the positioning notch, for preventing the second positioning member from coming in contact with the image recording material. The third notch forming section is located at the second pitch from the first notch forming section for forming, along one end of the image recording material, either a positioning notch to be fitted with the third positioning member or a non-contacting notch, which is deeper than the positioning notch, for preventing the third positioning member from coming in contact with the image recording material. The mounting mechanism mounts the image recording material, in which the notch is formed by any of the first, second, and third notch forming sections, on the mounting surface of the mounting member by using any two of the first, second, and third positioning members as positioning references.

According to a second aspect, in the first aspect, each of the first, second, and third notch forming sections includes a punch member and a contact member. The punch member forms a notch by punching one end of the image recording material in an up and down motion. The contact member determines where the image recording material is punched by the punch member by coming in contact with the image recording material. When the positioning notch is formed, each of the first, second, and third notch forming sections punches the image recording material by the punch member with the contact member being in contact with one end of the image recording material. When the non-contacting notch is formed, each of the first, second, and third notch forming sections punches the image recording material by the punch member with the contact member being in contact with the deepest portion of the notch formed along one end of the image recording material by the punch member.

According to a third aspect, in the second aspect, each of the first, second, and third notch forming sections includes a contact member moving section. The contact member moving section moves the contact member between a position where the contact member is in contact with the image recording material and a position where the contact member is retracted from the above position so as not to be in contact with the image recording material.

According to a fourth aspect, in the second aspect, each of the first, second, and third notch forming sections includes the punch member and the contact member arranged on a single line parallel to a direction in which the image recording material to be punched is inserted.

According to a fifth aspect, in the first aspect, any one of the first, second, and third notch forming sections forms the non-contacting notch along one end of the image recording material, and the remaining notch forming sections form the positioning notches along one end of the image recording material.

According to a sixth aspect, in the first aspect, the image recording apparatus further comprises a fourth positioning member and a fourth notch forming section. The fourth positioning member is fixed on the mounting surface of the mounting member and located at a third pitch, which is greater than the second pitch, from the first positioning member with respect to the predetermined direction, so that the fourth positioning member is further away from the first positioning member than the third positioning member. The fourth notch forming section is located at the third pitch from the first notch forming section for forming, along one end of the image recording material, either a positioning notch to be fitted with the fourth positioning member or a non-contacting notch, which is deeper than the positioning notch, for preventing the fourth positioning member from coming in contact with the image recording material. Any two of the first, second, third, and fourth notch forming sections form the non-contacting notches along one end of the image recording material, and the remaining notch forming sections form the positioning notches along one end of the image recording material. The mounting mechanism mounts the image recording material, in which the notches are formed by the first, second, third, and fourth notch forming sections, on the mounting surface of the mounting member by using any two of the first, second, third, and fourth positioning members as positioning references.

A seventh aspect of the present invention is directed to a notch forming apparatus for forming a notch along one end of a sheet-shaped image recording material. The notch forming apparatus comprises a punch member and a contact member. The punch member forms a notch by punching one end of the image recording material in an up and down motion. The contact member determines where the image recording material is punched by the punch member by coming in contact with the image recording material. A positioning notch to be fitted with a positioning member for positioning the image recording material is formed by punching the image recording material by the punch member with the contact member being in contact with one end of the image recording material. A non-contacting notch which is deeper than the positioning notch is formed by punching the image recording material by the punch member with the contact member being in contact with the deepest portion of the notch formed along one end of the image recording material by the punch member.

According to an eighth aspect, in the seventh aspect, the notch forming apparatus further comprises a contact member moving section. The contact member moving section moves the contact member between a position where the contact member is in contact with the image recording material and a position where the contact member is retracted from the above position so as not to be in contact with the image recording material.

According to a ninth aspect, in the seventh aspect, the punch member and the contact member are arranged on a single line parallel to a direction in which the image recording material to be punched is inserted.

A tenth aspect of the present invention is directed to a method for recording an image by mounting a sheet-shaped image recording material on a mounting member having a mounting surface on which first, second, and third positioning members are fixed. The method comprises a first notch forming step, a second notch forming step, a third notch forming step, and a mounting step. The first notch forming step forms, along one end of the image recording material, either a positioning notch to be fitted with the first positioning member or a non-contacting notch, which is deeper than the positioning notch, for preventing the first positioning member from coming in contact with the image recording material. The second notch forming step forms, along one end of the image recording material, either a positioning notch to be fitted with the second positioning member or a non-contacting notch, which is deeper than the positioning notch, for preventing the second positioning member from coming in contact with the image recording material. The third notch forming step forms, along one end of the image recording material, either a positioning notch to be fitted with the third positioning member or a non-contacting notch, which is deeper than the positioning notch, for preventing the third positioning member from coming in contact with the image recording material. The mounting step mounts the image recording material, in which the notch is formed at any of the first, second, and third notch forming steps, on the mounting surface of the mounting member by using any two of the first, second, and third positioning members as positioning references.

According to an eleventh aspect, in the tenth aspect, when the positioning notch is formed, each of the first, second, and third notch forming steps punches the image recording material by a predetermined punch member with a predetermined contact member being in contact with one end of the image recording material. When the non-contacting notch is formed, each of the first, second, and third notch forming steps punches the image recording material by the punch member with the contact member being in contact with the deepest portion of the notch formed along one end of the image recording material by the punch member.

According to a twelfth aspect, in the tenth aspect, the non-contacting notch is formed along one end of the image recording material at any of the first, second, and third notch forming steps, and the positioning notch is formed along one end of the image recording material at remaining steps.

According to a thirteenth aspect, in the tenth aspect, a fourth positioning member is further fixed on the mounting surface of the mounting member. The method further comprises a fourth notch forming step for forming, along one end of the image recording material, either a positioning notch to be fitted with the fourth positioning member or a non-contacting notch, which is deeper than the positioning notch, for preventing the fourth positioning member from coming in contact with the image recording material. The non-contacting notch is formed along one end of the image recording material at any two of the first, second, third, and fourth notch forming steps, and the positioning notch is formed along one end of the image recording material at remaining steps. The mounting step mounts the image recording material, in which the notch is formed at the first, second, third, and fourth notch forming steps, on the mounting surface of the mounting member by using any two of the first, second, third, and fourth positioning members as positioning references.

A fourteenth aspect of the present invention is directed to an image recording apparatus for recording an image on a sheet-shaped image recording material mounted thereon. The image recording apparatus comprises a mounting member, a first positioning member, a second positioning member, a third positioning member, a first notch forming section, a second notch forming section, a third notch forming section, and a mounting mechanism. The mounting member has a predetermined mounting surface on which the image recording material is mounted. The first positioning member is fixed on the mounting surface of the mounting member. The second positioning member is fixed on the mounting surface of the mounting member and located at a first pitch from the first positioning member with respect to a predetermined direction. The third positioning member is fixed on the mounting surface of the mounting member and located at a second pitch, which is greater than the first pitch, from the first positioning member with respect to the predetermined direction, so that the third positioning member is further away from the first positioning member than the second positioning member. The first notch forming section forms, along one end of the image recording material, a positioning notch to be fitted with the first positioning member. The second notch forming section is located at the first pitch from the first notch forming section for forming, along one end of the image recording material, either a positioning notch to be fitted with the second positioning member or a non-contacting notch, which is deeper than the positioning notch, for preventing the second positioning member from coming in contact with the image recording material. The third notch forming section is located at the second pitch from the first notch forming section for forming, along one end of the image recording material, a positioning notch to be fitted with the third positioning member. The mounting mechanism mounts the image recording material, in which the notch is formed by the first, second, and third notch forming sections, on the mounting surface of the mounting member by using the first and second positioning members as positioning references or using the first and third positioning members as positioning references.

According to a fifteenth aspect, in the fourteenth aspect, the second notch forming section includes a punch member and a contact member. The punch member forms a notch by punching one end of the image recording material in an up and down motion. The contact member determines where the image recording material is punched by the punch member by coming in contact with the image recording material. When the positioning notch is formed, the second notch forming section punches the image recording material by the punch member with the contact member being in contact with one end of the image recording material. When the non-contacting notch is formed, the second notch forming section punches the image recording material by the punch member with the contact member being in contact with the deepest portion of the notch formed along one end of the image recording material by the punch member.

A sixteenth aspect of the present invention is directed to an image recording apparatus for recording an image on a sheet-shaped image recording material mounted thereon. The image recording apparatus comprises a mounting member, a first positioning member, a second positioning member, a third positioning member, a first notch forming section, a second notch forming section, a third notch forming section, and a mounting mechanism. The mounting member has a predetermined mounting surface on which the image recording material is mounted. The first positioning member is fixed on the mounting surface of the mounting member. The second positioning member is fixed on the mounting surface of the mounting member and located at a first pitch from the first positioning member with respect to a predetermined direction. The third positioning member is fixed on the mounting surface of the mounting member and located at a second pitch, which is greater than the first pitch, from the first positioning member with respect to the predetermined direction, so that the third positioning member is further away from the first positioning member than the second positioning member. The first notch forming section forms, along one end of the image recording material, a positioning notch to be fitted with the first positioning member. The second notch forming section is located at the first pitch from the first notch forming section for forming, along one end of the image recording material, either a positioning notch to be fitted with the second positioning member or a non-contacting notch, which is deeper than the positioning notch, for preventing the second positioning member from coming in contact with the image recording material. The third notch forming section is located at the second pitch from the first notch forming section for forming, along one end of the image recording material, either a positioning notch to be fitted with the third positioning member or a non-contacting notch, which is deeper than the positioning notch, for preventing the third positioning member from coming in contact with the image recording material. The mounting mechanism mounts the image recording material, in which the notch is formed by the first, second, and third notch forming sections, on the mounting surface of the mounting member by using the first and second positioning members as positioning references or using the first and third positioning member as positioning references.

According to a seventeenth aspect, in the sixteenth aspect, each of the second and third notch forming sections includes a punch member and a contact member. The punch member forms a notch by punching one end of the image recording material in an up and down motion. The contact member determines where the image recording material is punched by the punch member by coming in contact with the image recording material. When the positioning notch is formed, each of the second and third notch forming sections punches the image recording material by the punch member with the contact member being in contact with one end of the image recording material. When the non-contacting notch is formed, each of the second and third notch forming sections punches the image recording material by the punch member with the contact member being contact with the deepest portion of the notch formed along one end of the image recording material by the punch member.

According to the first aspect, a plurality of notch forming sections provided in the image recording apparatus are capable of selectively forming a positioning notch and a non-contacting notch on one end face of the image recording material, whereby it is possible to realize various positioning methods utilizing fit between the first to third positioning members and the corresponding notches. For example, the image recording material can be positioned in place without having to cause a particular positioning member to always abut the image recording material. Thus, it is possible to provide greater flexibility in layout of the image recording material to be mounted on the mounting member. That is, the plurality of notch forming sections provided in the image recording apparatus are capable of forming various notches along one end face of the image recording material depending on a positioning method to be employed, whereby it is possible to stably position the image recording materials having a broad range of lateral widths on the mounting member by using an appropriate positioning member.

According to the second aspect, notches of two different depths can be formed by using one punch member, whereby it is possible to simplify the structure of the notch forming section.

According to the third aspect, the movable contact member enables the use of the same positional reference based on which the image recording material is punched and with which the image recording material is in contact so as to be mounted on the mounting member. Thus, it is possible to improve the accuracy of notch formation.

According to the fourth aspect, it is possible to use the same positional reference for punching the image recording material and for mounting the image recording material on the mounting member, thereby improving the accuracy of notch formation.

According to the fifth aspect, it is possible to mount the image recording material on the mounting surface of the mounting member by using any two of the first to third positioning members as positioning references. Thus, it is possible to position the image recording material accurately.

According to the sixth aspect, it is possible to realize various positioning methods utilizing fit between the first to fourth positioning members and the corresponding notches. For example, an image recording material having a relatively short lateral width is positioned on the mounting member by fitting two central positioning members which are disposed with a relatively short pitch therebetween into corresponding positioning notches while preventing contact with two positioning members disposed on the opposite ends of the image recording material by providing a non-contacting notch, if necessary. Also, an image recording material having a relatively long lateral width is positioned on the mounting member by fitting two positioning members which are disposed on the opposite ends with a relatively long pitch therebetween into corresponding positioning notches, while preventing contact with central two positioning members by providing a non-contacting notch. According to the sixth aspect, it is possible to realize such a positioning method that requires appropriate formation of a positioning notch and a non-contacting notch along one end face of the image recording material depending on a lateral width thereof.

According to the fourteenth aspect, the second notch forming section forms a non-contacting notch, whereby it is possible to position the image recording material on the mounting surface of the mounting member by fitting two positioning notches formed by the first and the third notch forming sections with the respective first and third positioning members while preventing the image recording material from coming in contact with the second positioning member. Also, the image recording material can be positioned on the mounting surface of the mounting member by fitting two positioning notches formed by the first and second notch forming sections with the respective first and second positioning members. As such, in either of the above two cases, it is possible to perform the positioning of the image recording material by abutting one end of the image recording material in which the positioning notch is formed with the positioning member, thereby realizing stable positioning.

According to the sixteenth aspect, the second notch forming section forms a non-contacting notch, whereby it is possible to position the image recording material on the mounting surface of the mounting member by fitting two positioning notches formed by the first and third notch forming sections with the respective first and third positioning members while preventing the image recording material from coming in contact with the second positioning member. Also, the image recording material can be positioned on the mounting surface of the mounting member by fitting two positioning notches formed by the first and second notch forming sections with the respective first and second positioning members. Furthermore, the third notch forming section forms a non-contacting notch, whereby it is possible to position the image recording material on the mounting surface of the mounting member by fitting two positioning notches formed by the first and second notch forming sections with the respective first and second positioning members while preventing the image recording material from coming in contact with the third positioning member. As such, in any of the above three cases, it is possible to perform the positioning of the image recording material by abutting one end of the image recording material in which the positioning notch is formed with the positioning member, thereby realizing stable positioning.

According to the notch forming apparatus and the image recording method of the present invention, an effect similar to that of the above-described image recording apparatus can be obtained.

The present invention has the following features to attain the object mentioned above.

DESCRIPTION OF THE PREFERRED EMBODIMENTS

Figure 1:
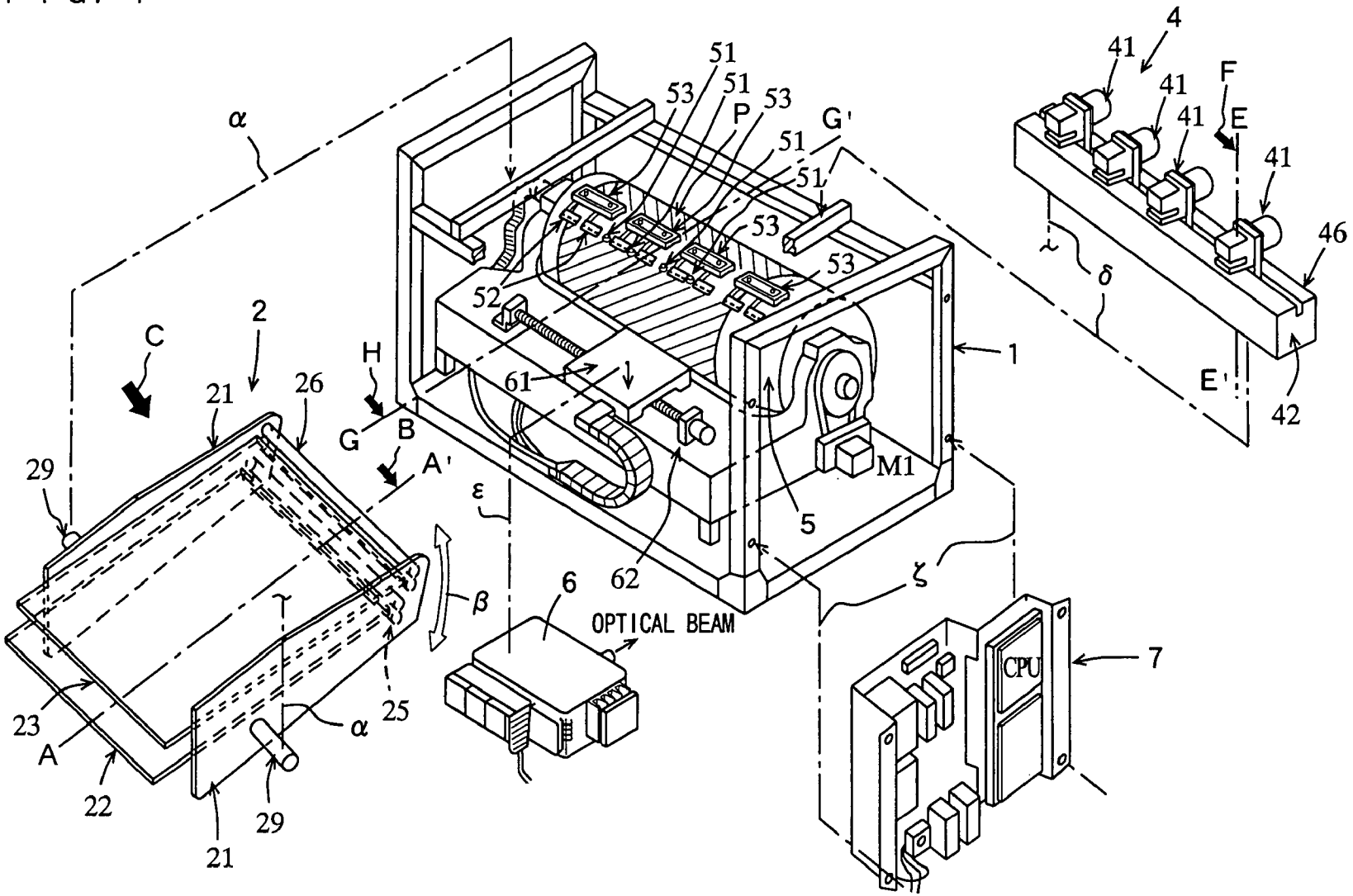
FIG. 1 is an exploded view showing a cylindrical outer surface scanning apparatus according to one embodiment of the present invention.

Referring to the drawings, an image recording apparatus according to one embodiment of the present invention will be described. Hereinafter, for the sake of concreteness, a cylindrical outer surface scanning apparatus incorporating a recording drum with a sheet-shaped image recording material being mounted on the outer surface thereof is taken as an exemplary image recording apparatus. The image recording apparatus of the present invention may be a cylindrical inner surface scanning apparatus incorporating a cylindrical member with an image recording material being mounted on the inner surface thereof, a planar surface scanning apparatus incorporating a planer member with an image recording material mounted on the upper surface thereof or the like. Hereinafter, a sheet-shaped plate P, e.g., a so-called PS plate (Presensitized Plate) or a thermal plate, is taken as an exemplary image recording material to be mounted on the outer surface of the recording drum of the cylindrical outer surface scanning apparatus. A "PS plate" is a plate comprising a plate material (e.g., an aluminum plate, a plastic sheet, or paper) and a photo-sensitive layer preapplied on the plate material.

FIG. 1 is an exploded view showing the cylindrical outer surface scanning apparatus according. The cylindrical outer surface scanning apparatus comprises a frame 1 which is in the shape of a generally rectangular solid. On the frame 1, a storage/transportation mechanism 2, a drive mechanism 3 (not shown; see 3 in FIGS. 3 and 4), a punch unit 4, a recording drum 5, an exposure head 6, and an electrical circuitry section 7 are mounted. For clarity, the drive mechanism 3 is not shown in FIG. 1.

Figure 2:
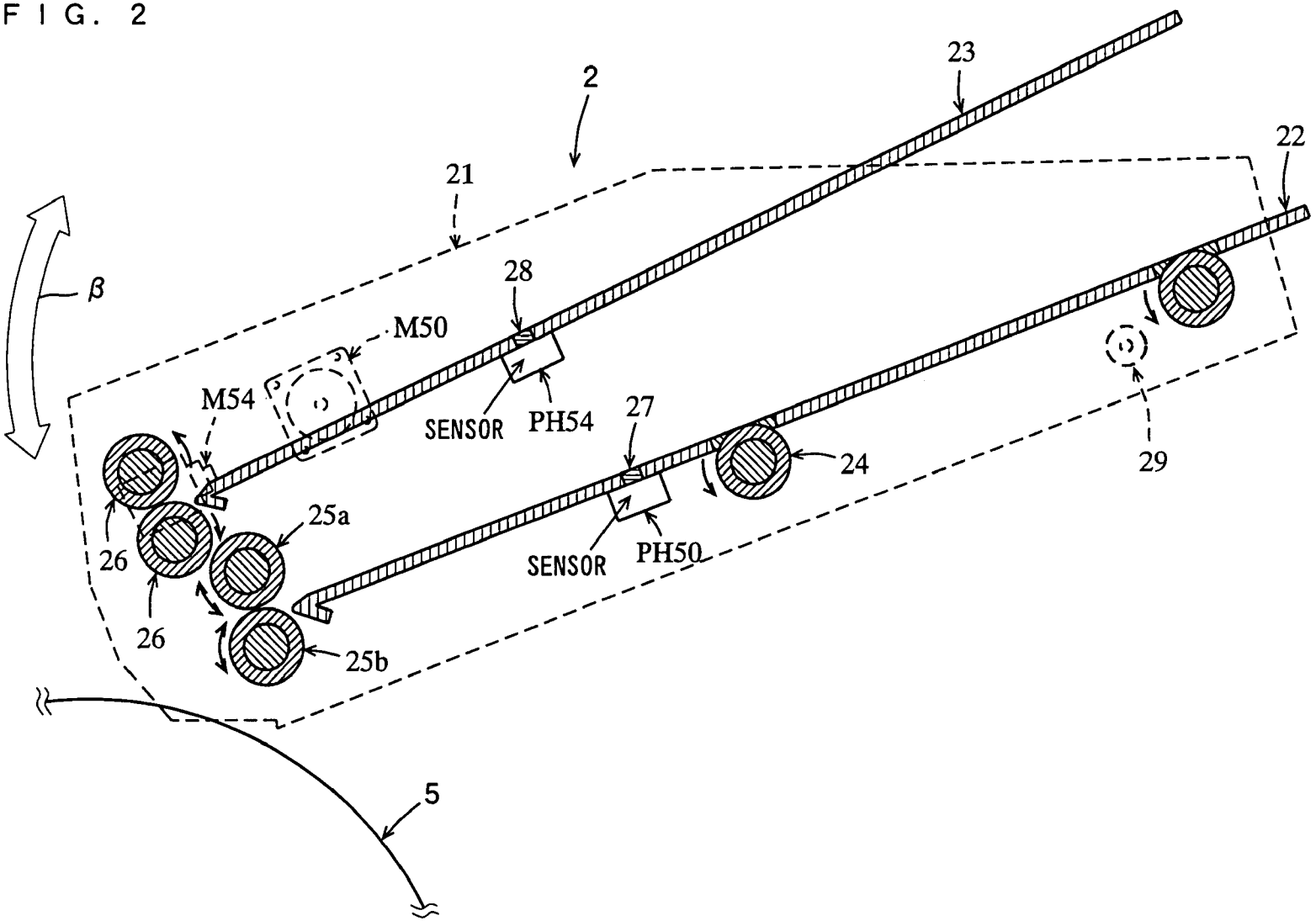
FIG. 2 is a cross-sectional view of a storage/transportation mechanism 2, taken at a dash-dot line A-A'and as seen in the direction of arrow B in FIG. 1.

FIG. 2 is a cross-sectional view of the storage/transportation mechanism 2, taken at a dash-dot line A-A' and as seen in the direction of arrow B in FIG. 1. Note that not all of the component elements shown in FIG. 2 are shown in FIG. 1. As shown in FIGS. 1 and 2, the storage/transportation mechanism 2 comprises: two trays 22 and 23 which are fixed by being interposed between two side plates 21; a feed roller 24; a pair of transportation rollers 25 for loading purposes; and a pair of transportation rollers 26 for unloading purposes. Thus, by means of the two side plates 21, the two trays 22 and 23 are held together in an integral manner, so that the tray 23 comes generally above the tray 22. Since the tray 23 comes generally above the tray 22, the tray 23 will hereinafter be referred to as an "upper tray 23", and the tray 22 as a "lower tray 22".

The feed roller 24 is a roller for transporting a plate P which is accommodated in the lower tray 22 in the direction of the transportation rollers 25. The pair of transportation rollers 25, and the pair of transportation rollers 26, are disposed in the manner of a bridge astride one of the side plates 21 and the other side plate 21. The pair of transportation rollers 25 are disposed in the neighborhood of the leading end of the lower tray 22, in such a manner that the two rollers abut each other from above and from below. The upper transportation roller 25*a* can be driven to move up and down by means of a transportation roller up/down drive (not shown). Furthermore, the pair of transportation rollers 26 are disposed in the neighborhood of the leading end of the upper tray 23, in such a manner that two rollers abut each other. The feed roller 24 and the transportation rollers 25 are coupled via a belt (not shown) to a motor M50 which is fixed on one of the side plates 21, so as to be rotated by a driving force generated by the motor M50. The transportation rollers 26 are coupled via a belt (not shown) to a motor M54 which is fixed on one of the side plates 21, so as to be rotated by a driving force generated by the motor M54.

Small holes 27 and 28 are formed in predetermined positions of the lower tray 22 and the upper tray 23. Sensors PH50 and PH54 are fixed immediately under the small holes 27 and 28, respectively. The sensors PH50 and PH54 detect whether or not a plate P is present above the small holes 27 and 28.

Figure 3:
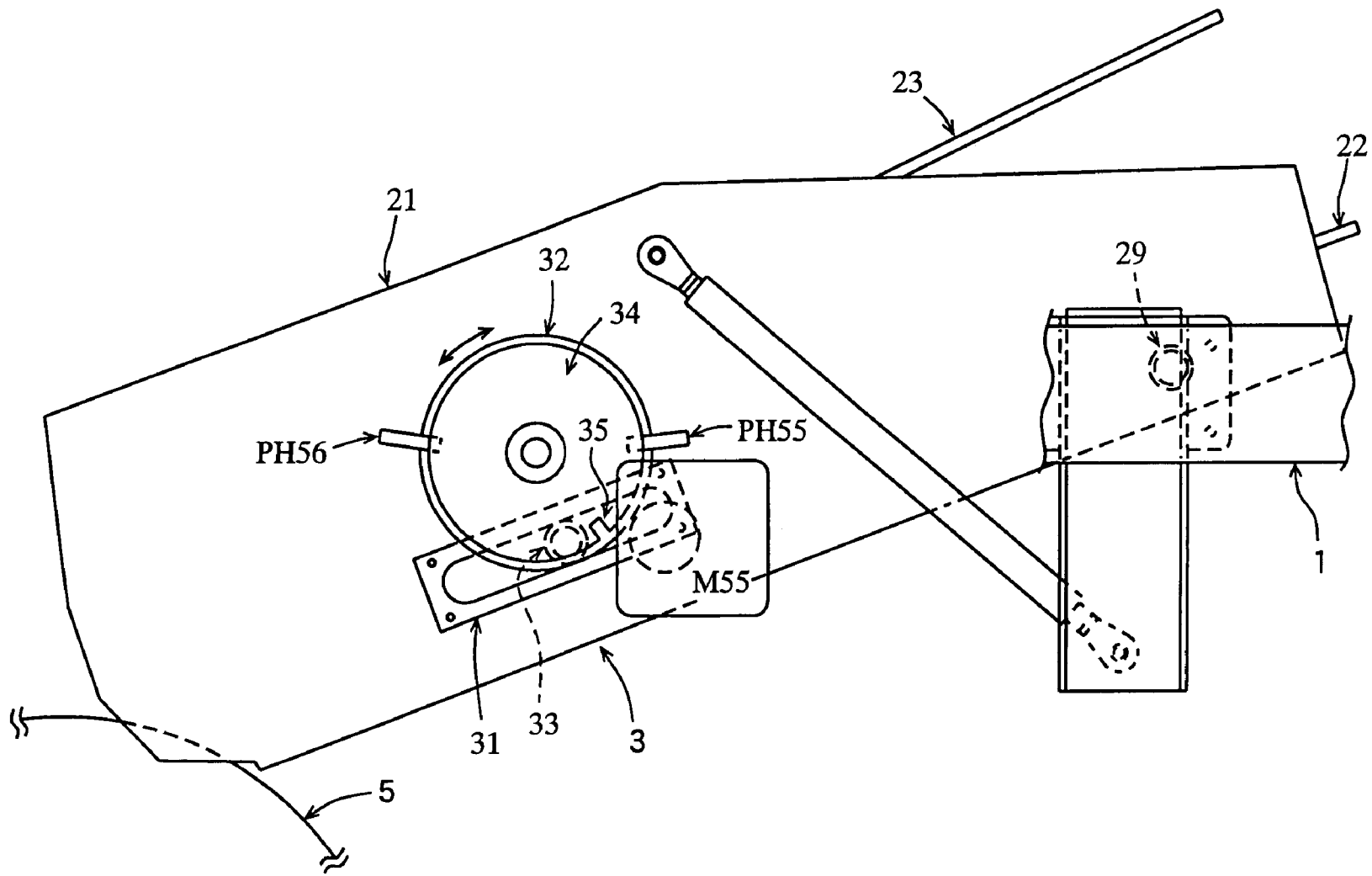
FIG. 3 is a view showing a drive mechanism 3 as seen in the direction of arrow C in FIG. 1.
Figure 4:
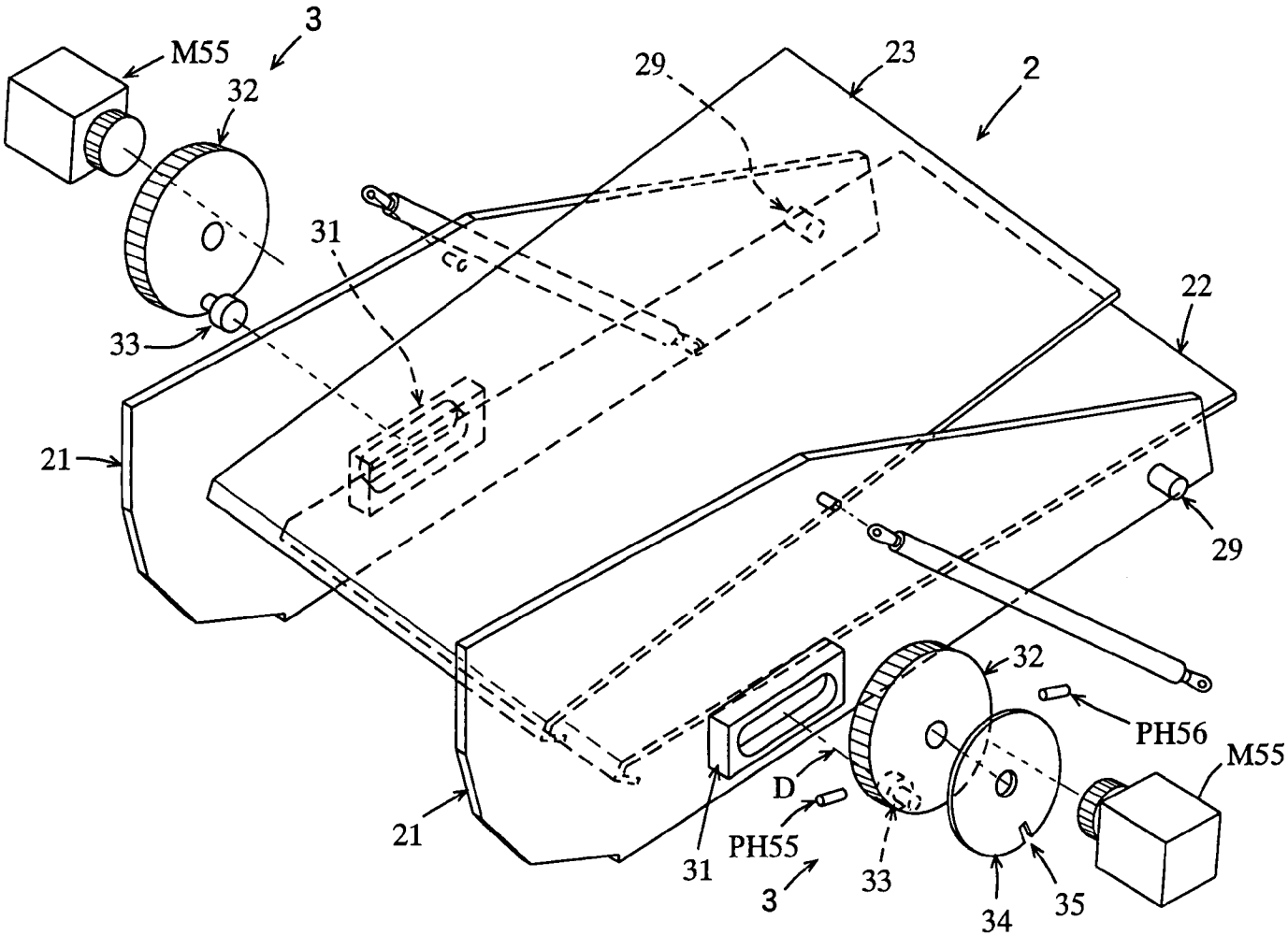
FIG. 4 is an exploded view of the drive mechanism 3 shown in FIG. 3.

The storage/transportation mechanism 2 having the above structure is fixed in an upper portion of the frame 1 as indicated by a dash-dot arrow α in FIG. 1, so as to be capable of rotating within a predetermined range (see arrow β in FIGS. 1 and 2) around a center of rotation defined by a rotation axis 29 protruding outward from the two side plates 21. The drive mechanism 3 realizes the rotation of the storage/transportation mechanism 2. FIG. 3 is a view showing the drive mechanism 3 as seen in the direction of arrow C in FIG. 1. FIG. 4 is an exploded view of the drive mechanism 3 shown in FIG. 3.

In FIGS. 3 and 4, the drive mechanism 3 comprises a pair of cam follower guides 31, a pair of motors M55, a pair of cam gears 32, and a pair of cam followers 33, and at least one sensor detection plate 34, at least one sensor PH55, and at least one sensor PH56. Each cam follower guide 31 has an outer shape of a rectangular solid, with elongated-circular through holes being formed in the rectangular solid. The cam follower guides 31 are fixed on the side plates 21, one on each side plate, in such a manner that the two through holes oppose each other with the storage/transportation mechanism 2 generally interposed therebetween (see FIG. 4). The motors M55 are disposed in the neighborhood of the respective side plates 21 so as to oppose each other, with the storage/transportation mechanism 2 interposed therebetween, and fixed on the frame 1. The cam gears 32 are fixed on the frame 1 so as to face the respective side plates 21, in such a manner that each cam gear 32 is capable of rotating around its axis with a driving force generated by the corresponding motor M55. Each cam follower 33, which is fixed at the outer edge of a face of the corresponding cam gear 32 facing the side plate 21, rotates in a circular motion around the axis of the cam gear 32. Each cam follower 33 has a disk shape with a diameter substantially identical to the shorter width of the through hole in the cam follower guide 31, so that the cam follower 33 is received in the through hole as indicated by a dash-dot arrow D in FIG. 4. As a result, each cam follower guide 31 and the corresponding cam gear 32 are coupled by means of the cam follower 33, whereby the storage/transportation mechanism 2 is supported by the drive mechanism 3.

Each disk-shaped sensor detection plate 34, which is disposed concentrically with the corresponding cam gear 32, rotates along with the cam gear 32. As lit 35 is formed in the outer periphery of each sensor detection plate 34. The sensors PH55 and PH56 are fixed on the frame 1 in such a manner as to be capable of detecting the slit 35 formed in the corresponding rotating sensor detection plate 34.

Figure 5A:
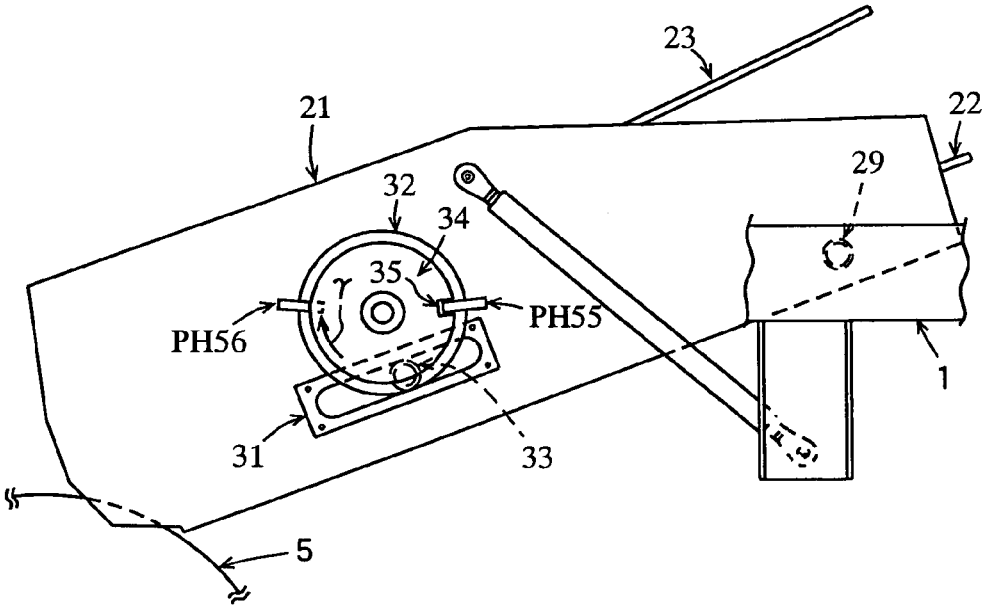
FIG. 5A is a diagram for illustrating a lower position in the operation of the drive mechanism 3 shown in FIGS. 3 and 4.

Now, the operation of the drive mechanism 3 having the above structure will be described with reference to FIGS. 5A and 5B. For clarity, the motor M55 is not shown in FIGS. 5A and 5B. In FIG. 5A, the slit 35 in the sensor detection plate 34 is being detected by the sensor PH55 because the slit 35 is situated immediately above the sensor PH55. When the slit 35 is being detected by the sensor PH55, each cam follower 33 is situated in the vicinity of the lowermost end of the circular motion thereof. Therefore, the storage/transportation mechanism 2 is being supported by the drive mechanism 3 at a position (hereinafter referred to as a "lower position") corresponding to the vicinity of the lowermost end of the circular motion of each cam follower 33. In this situation, as each cam gear 32 begins to rotate in a direction indicated by arrow γ due to a driving force generated by the corresponding motor M55, the corresponding cam follower 33 begins a circular motion in that direction, i.e., in an upper direction from the vicinity of the lowermost end of the circular motion of each cam follower 33. As a result, each cam follower 33 causes the storage/transportation mechanism 2, on which the corresponding cam follower guide 31 is fixed, to move in the upper direction from the lower position.

Figure 5B:
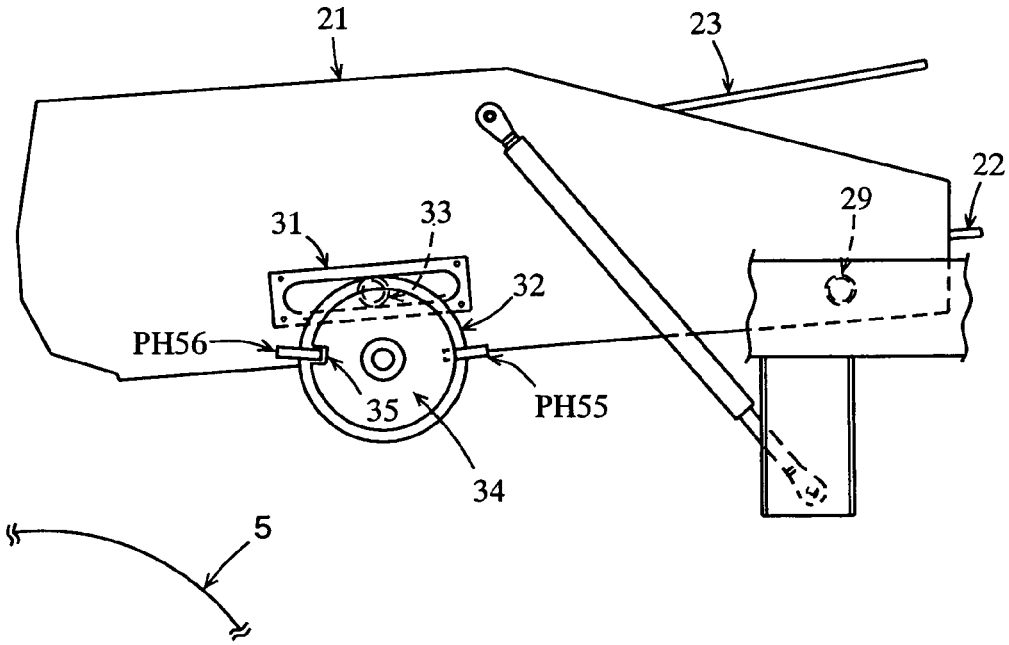
FIG. 5B is a diagram for illustrating an upper position in the operation of the drive mechanism 3 shown in FIGS. 3 and 4.

As shown in FIG. 5B, the rotation of the cam gear 32 causes the slit 35 in the sensor detection plate 34 to move in a circular motion in the direction of arrow γ from the position immediately above the sensor PH55, until the slit 35 comes immediately above the sensor PH56. The sensor PH56 detects the slit 35 situated immediately above the sensor PH56. When the slit 35 is detected by the sensor PH56, the motor M55 stops the generation of the driving force. As a result, each cam follower 33 is situated in the vicinity of the uppermost end of the circular motion of each cam follower 33, and the storage/transportation mechanism 2 is halted at a position (hereinafter referred to as an "upper position") corresponding to the vicinity of the uppermost end of the circular motion of each cam follower 33 while being supported by the drive mechanism 3. Through the above operation of the drive mechanism 3, the storage/transportation mechanism 2 moves up and down between its lower position and upper position.

Figure 6:
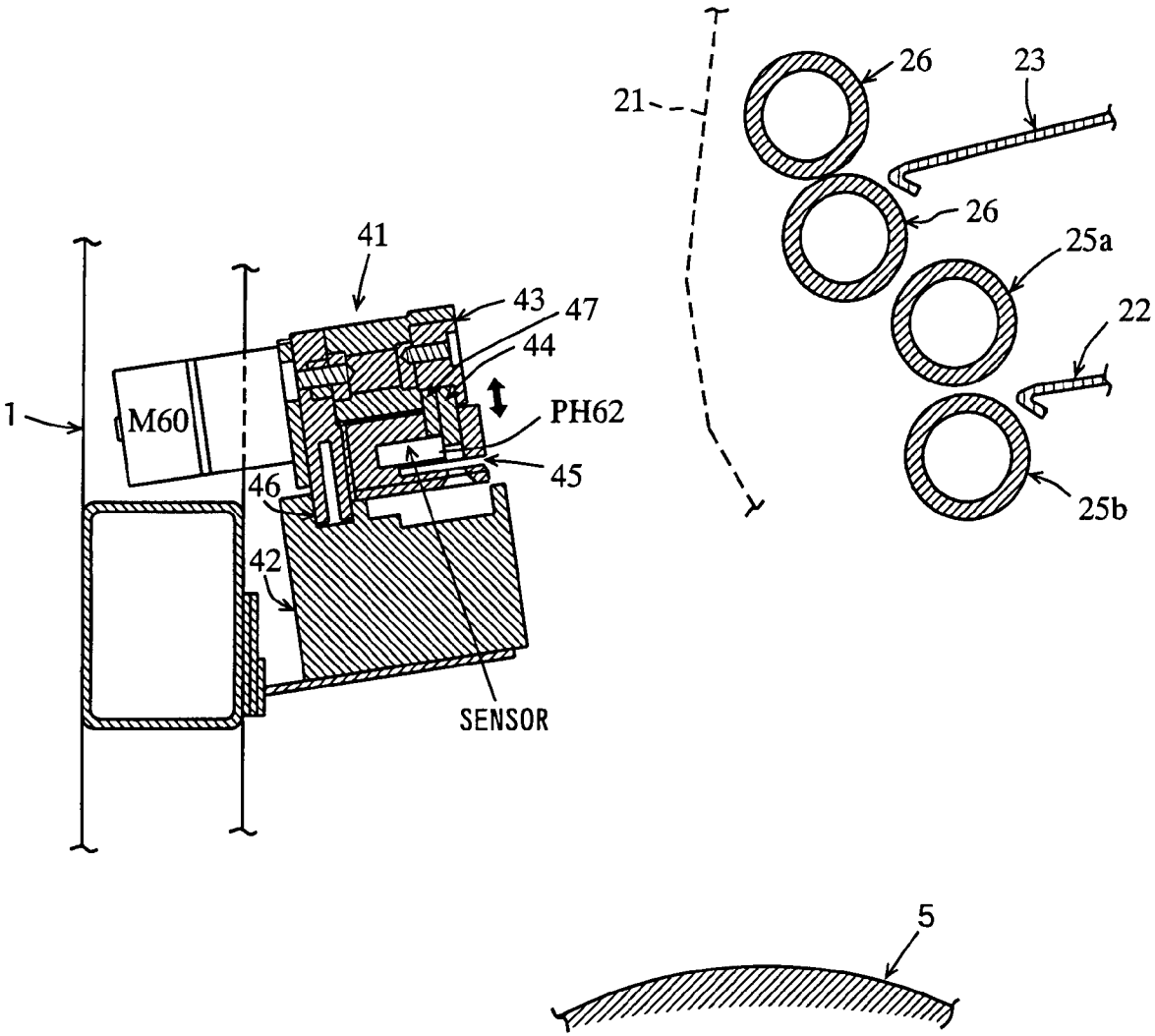
FIG. 6 is a cross-sectional view showing a punch unit 4, taken at a dash-dot line E-E' and seen in the direction of arrow F in FIG. 1.

Next, the punch unit 4 shown in FIG. 1 will be described. FIG. 6 is a cross-sectional view showing the punch unit 4, taken at a dash-dot line E-E' in FIG. 1 and seen in the direction of arrow F. As shown in FIG. 1, the punch unit 4 includes at least four punchers 41 and an attachment member 42. As shown in FIG. 6, each puncher 41 includes a main body 43, a sensor PH62, a motor M60, a punch 44, and a stopper pin 47. The main body 43 has an inlet 45 formed therein. A plate P which comes transported along a first supply path line (described below) is inserted in the inlet 45. The sensor PH62 detects whether or not a plate P has been inserted in the inlet 45.

Upon detection of a plate P by the sensor PH62, the motor M60 generates a driving force based on the control by the electrical circuitry section 7. The driving force generated by the motor M60 is converted to a force for moving the punch 44 up and down by means of a cam mechanism (not shown) within the main body. The driving force generated by the motor M60 is also converted to a force for moving the stopper pin 47 up and down by means of the cam mechanism. The cam mechanism comprises a driving axis which is coupled to the single motor M60. A plurality of different-shaped cams are mounted on the driving axis of the cam mechanism in different phases. The rear ends of the punch 44 and the stopper pin 47 are attached to the cams. As the driving axis rotates by a driving force generated by the motor M60, the plurality of cams rotate, thereby moving the punch 44 and the stopper pin 47 up and down at different timing. In other words, the electrical circuitry section 7 can control the upper and lower positions of the punch 44 and the stopper pin 47 by controlling an angular position of the driving axis rotated by the motor M60.

The punch 44 moves up and down due to the force which has been transmitted from the cam mechanism, so as to punch a hole in the plate P which is placed in the inlet 45. As a result, a positioning notch or a non-contacting notch is formed at one end of the plate P. The stopper pin 47 is a member used as a positioning reference for forming a positioning notch or a non-contacting notch in accordance with a type of plate inserted in the inlet 45. The stopper pin 47 moves up and down before the plate P is inserted in the inlet 45. While the punch 44 and the stopper pin 47 as described above move up and down by means of the driving axis coupled to the single motor M60 and provided with a plurality of different shaped cams, separate motors may be utilized for moving the punch 44 and the stopper pin 47 up and down. The specific shapes of the punch 44 and the stopper pin 47 will be described below.

The attachment member 42 has the shape of a generally rectangular solid. A groove 46 is formed along a longitudinal direction of the attachment member 42. The respective punchers 41 are attached in the groove 46. In stead of forming the groove 46 in the attachment member 42, the punchers 41 may be affixed by means of knock holes, bolt holes, and the like. The punch unit 4 having the above structure is fixed on the frame 1, as indicated by a dash-dot arrow δ in FIG. 1.

Figure 7:
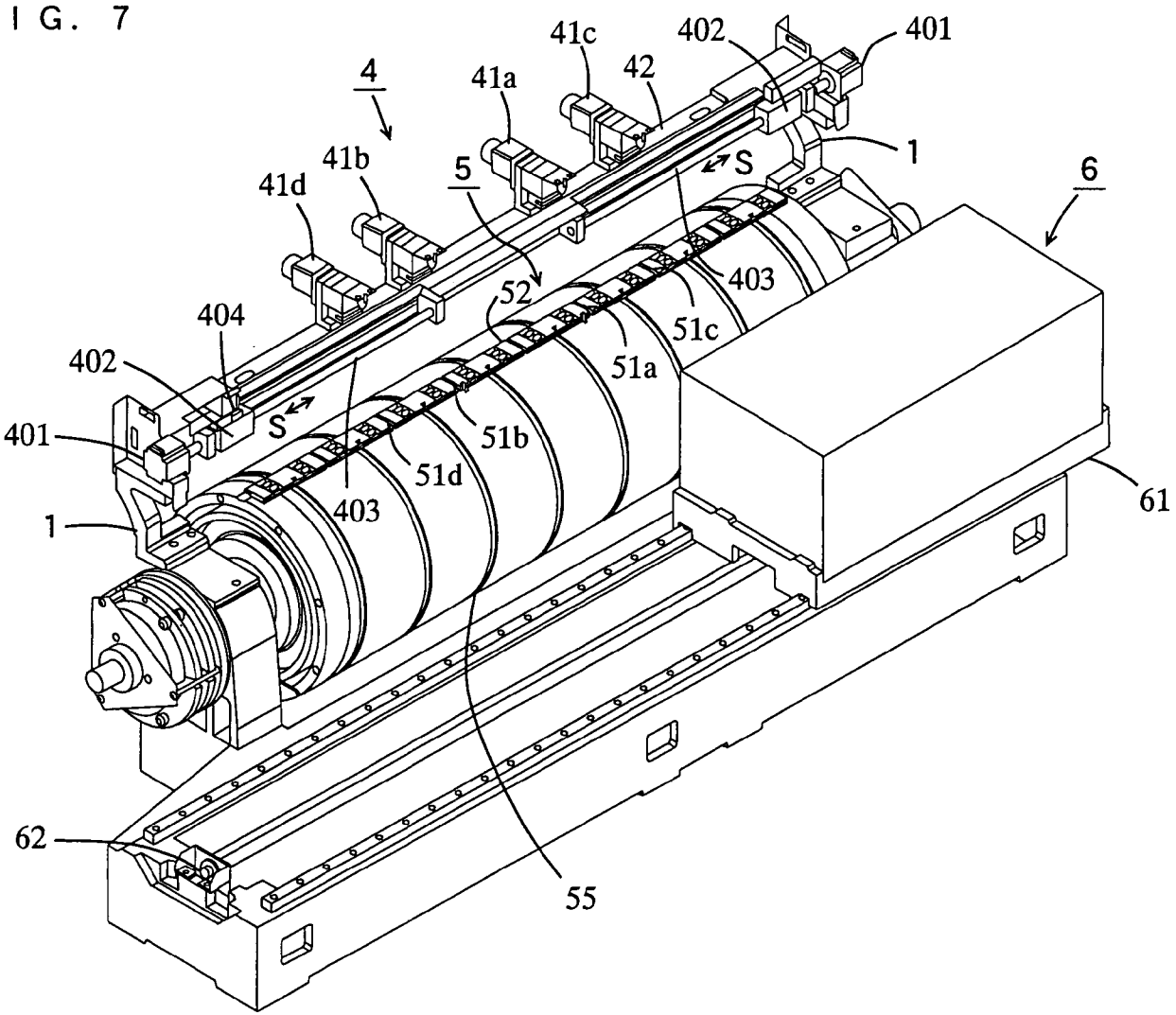
FIG. 7 is a perspective view showing the punch unit 4 and a recording drum 5 shown in FIG. 1 as well as the vicinity thereof.

FIG. 7 is a perspective view showing the punch unit 4, the recording drum 5, and the exposure head 6, which are fixed to the frame 1 in the above-described manners. For clarity, the storage/transportation mechanism 2, the drive mechanism 3, and the electrical circuitry section 7 are omitted from FIG. 7. Although positioning punchers for punching holes used in conjunction with a printing machine may also be mounted on the punch unit 4, only the positioning punchers 41 for punching holes used in conjunction with the recording drum 5 are illustrated for conciseness. The positioning punchers for punching holes used in conjunction with a printing machine may be fixed on the attachment member 42, for example, between the positioning punchers 41 for punching holes used in conjunction with the recording drum 5.

As shown in FIG. 7, four punchers 41*a* to 41*d* are fixed on the attachment member 42. Each of the above punchers 41*a* to 41*d* can punch both a positioning notch and a non-contacting notch, selectively. The punchers 41*a* and 41*b* are fixed in respective positions close to a center of the attachment member 42. Each of the punchers 41*c* and 41*d* is fixed in a position close to the corresponding end of the attachment member 42. As shown in FIG. 7, the punchers 41 are arranged in the order 41*c*, 41*a*, 41*b*, and 41*d* from right to left of the attachment member 42 (the specific positions and shapes of these notches will be described below). At opposite ends of the front face of the attachment member 42, centering motors 401 are fixed. The centering motors 401 respectively drive a pair of ball screws 403, which extend in the horizontal direction along the front face of the attachment member 42 and which are capable of rotating. A centering bearing 402 is in screw-engagement with each ball screw 403. On an upper face of each centering bearing 402, a cylindrical retention member 404 capable of rotating is provided (note that one of the retention members 404 is not shown in FIG. 7). Thus, as the centering motors 401 run, the centering bearings 402 move in an S direction shown in FIG. 7.

When the plate P is introduced into the punch unit 4, the plate P is placed between the pair of centering bearings 402. When the centering motors 401 run so as to move the pair of centering bearings 402 toward the center from predetermined original positions, the outer surfaces of the retention members 404 on the centering bearings 402 abut the end faces of the plate P on both sides, thereby positioning the plate P in the center of the attachment member 42 (hence, this mechanism will be referred to as a "centering mechanism").

Figure 8:
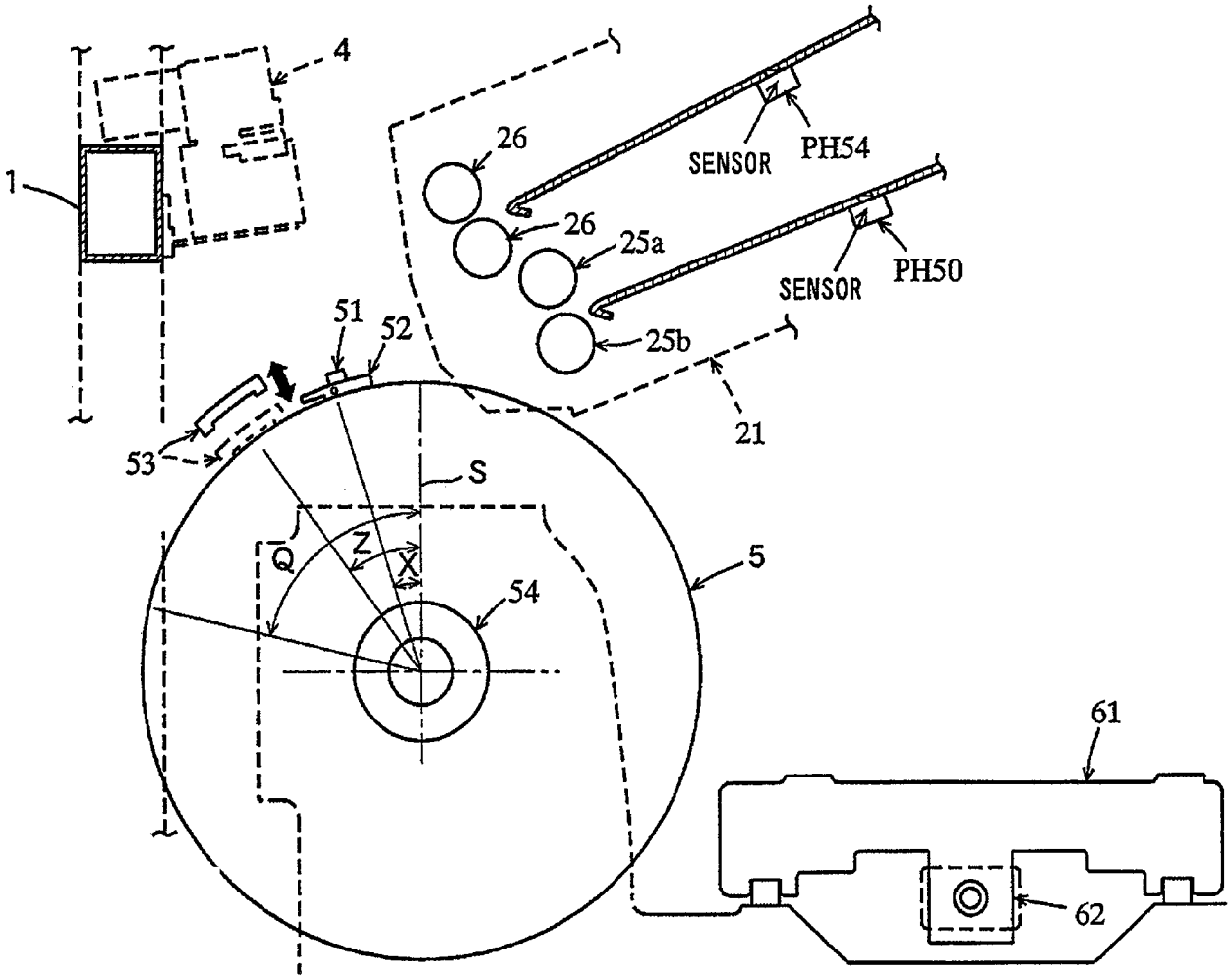
FIG. 8 is a cross-sectional view showing the recording drum 5 as well as the vicinity thereof, taken at a dash-dot line G-G' and as seen in the direction of arrow H in FIG. 1.

Next, referring to FIGS. 1, 7, and 8, the recording drum 5 will be described. FIG. 8 is a cross-sectional view showing the recording drum 5 and the vicinity thereof, taken at a dash-dot line G-G' in FIG. 1 and as seen in the direction of arrow H. Referring to FIGS. 1, 7, and 8, the recording drum 5 is disposed within the frame 1 so that the recording drum 5 is located obliquely below the storage/transportation mechanism 2 and the punch unit 4. The recording drum 5 having a generally cylindrical shape rotates around the cylindrical axis due to a driving force generated by the motor M1. A plate P (corresponding to the portion hatched with oblique line in FIG. 1), which comes transported along a second supply path line (described below), is mounted and wound around the outer surface (annular surface) of the recording drum 5.

As a structure for stabilizing the plate P on the outer surface of the recording drum 5, the cylindrical outer surface scanning apparatus comprises at least four positioning pins 51, leading-end clamps 52, and trailing-end clamps 53. The positioning pins 51 are fixed on the outer surface of the recording drum 5 (the specific positions of these positioning pins will be described below), and arranged so that it is possible to clamp one end (i.e., the leading end) of the plate P which comes transported along the second supply path line (described below) while any of the positioning pins 51*a* to 51*d* fits in a positioning notch created by any of the punchers 41*a* to 41*d*. The trailing-end clamp 53 is configured so as to be releasable from the outer surface of the recording drum 5. While the trailing-end clamp 53 is released from the recording drum 5, the trailing-end clamp 53 is retained by a first clamp driving section (not shown). Once attached on the recording drum 5, the trailing-end clamp 53 functions to clamp the other end (i.e., the trailing end) of the plate P which comes transported along the second supply path line (described below) on the outer surface of the recording drum 5.

A rotary encoder 54 is attached to the rotation axis of the recording drum 5 to detect various angular positions thereof. In the present cylindrical outer surface scanning apparatus, a first angular position X, a second angular position Z, and a third angular position Q are previously defined. Specifically, the leading-end clamp 52 clamps at the first angular position X; the second angular position Z concerns the positioning of the trailing-end clamp 53; and the clamping of the leading-end clamp 52 is released at the third angular position Q. As shown in FIG. 8, each angular position is defined relative to a predetermined reference line S. While the recording drum 5 is in the first angular position X, the leading-end clamp 52 is driven by the first clamp driving section (not shown) to clamp the leading end of the plate P. While the recording drum 5 is in the third angular position Q, the leading-end clamp 52 is driven by a second clamp driving section (not shown) to release the leading end of the plate P which has been clamped. While the recording drum 5 is in the second angular position Z, the trailing-end clamp 53 may be driven by a third clamp driving section (not shown) to be attached on the outer surface of the recording drum 5 so as to clamp the trailing end of the plate P. The trailing-end clamp 53 thus attached on the outer surface of the recording drum 5 may be taken off the outer surface by the third clamp driving section while the recording drum 5 is in the second angular position Z, thereby releasing the trailing end of the plate P. Since the first to third clamp driving sections do not constitute an essential portion of the present invention, any detailed description thereof will be omitted.

Furthermore, as a structure for keeping the plate P in close contact with the outer surface of the recording drum 5, the cylindrical outer surface scanning apparatus comprises: a plurality of small holes and grooves (hereinafter referred to as "suction holes" and "suction grooves 55") provided on the outer surface of the recording drum 5 for plate suction purposes; a blower (not shown) which cooperates with the suction holes and the suction groove 55 to create a vacuum system; and a squeeze roller (not shown) disposed in the neighborhood of the recording drum 5. Since the suction holes, the suction groove 55, the blower, and the squeeze roller do not constitute an essential portion of the present invention, any detailed description thereof will be omitted.

Next, the exposure head 6 will be described. As indicated by a dash-dot line ϵ in FIG. 1 and as illustrated in FIG. 7, the exposure head 6 is disposed on a table 61 which is provided in a close vicinity of the recording drum 5. While being conveyed in a direction parallel to the rotation axis of the recording drum 5 (sub scanning direction) due to a driving force generated by a feed screw mechanism 62, the exposure head 6 scans the plate P (which is rotating with the recording drum 5) with light beams which have been modified based on image data supplied from the electrical circuitry section 7 (described below). Thus, the exposure head 6 performs an exposure process to record an image on the plate P.

The electrical circuitry section 7 is attached to a side of the frame 1, as indicated by a dash-dot arrow ζ in FIG. 1. The electrical circuitry section 7 is electrically coupled with the aforementioned various component elements, so as to control the operation of the entire cylindrical outer surface scanning apparatus while exchanging signals with the respective component elements.

Next, the operation of the storage/transportation mechanism 2 and the plate P will be described with reference to FIGS. 9 to 16, which are schematic side views illustrating the operation of the storage/transportation mechanism 2 and the plate P.

Figure 9:
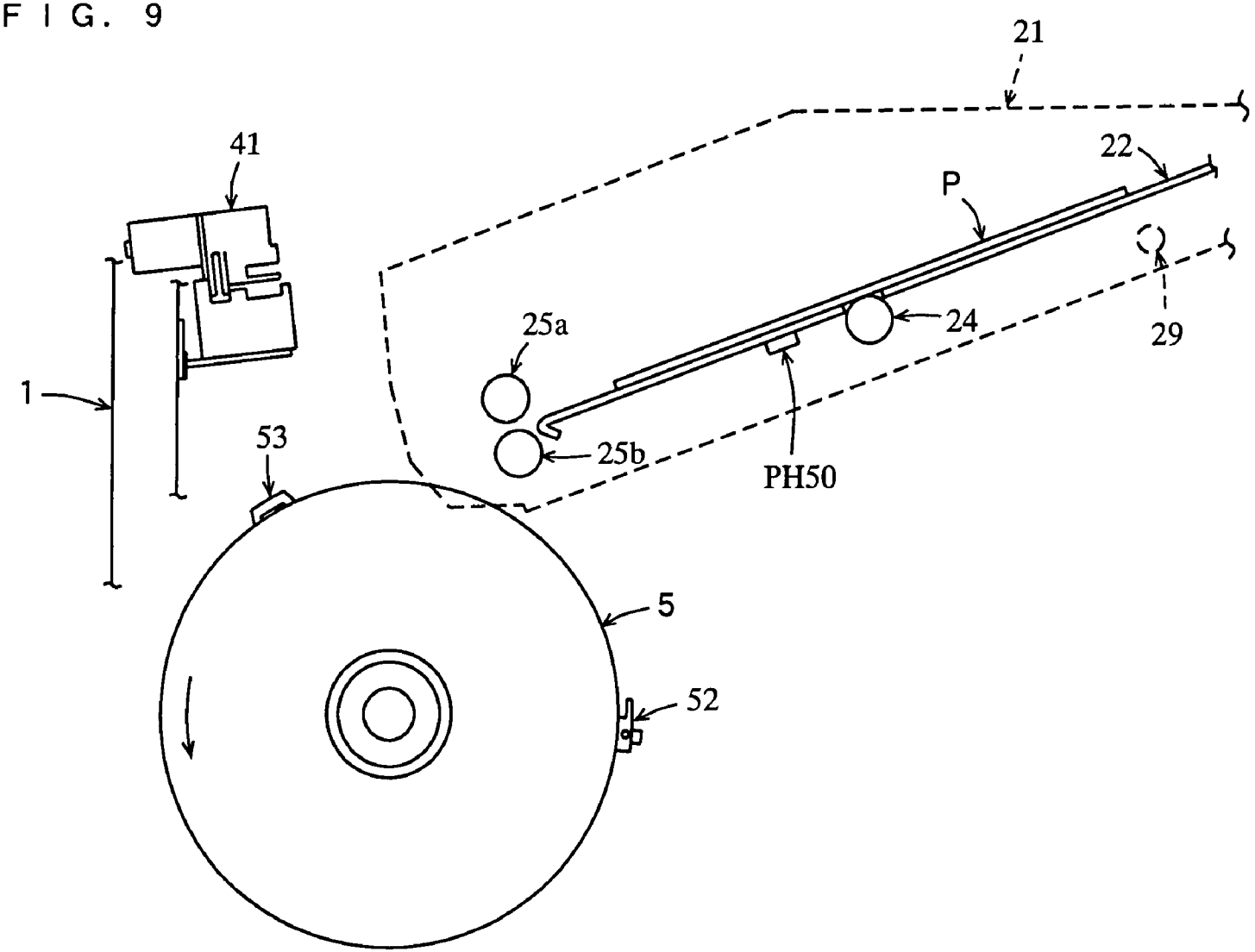
FIG. 9 is a schematic side view illustrating a plate P having been supplied in a lower tray 22 of the storage/transportation mechanism 2.
Figure 10:
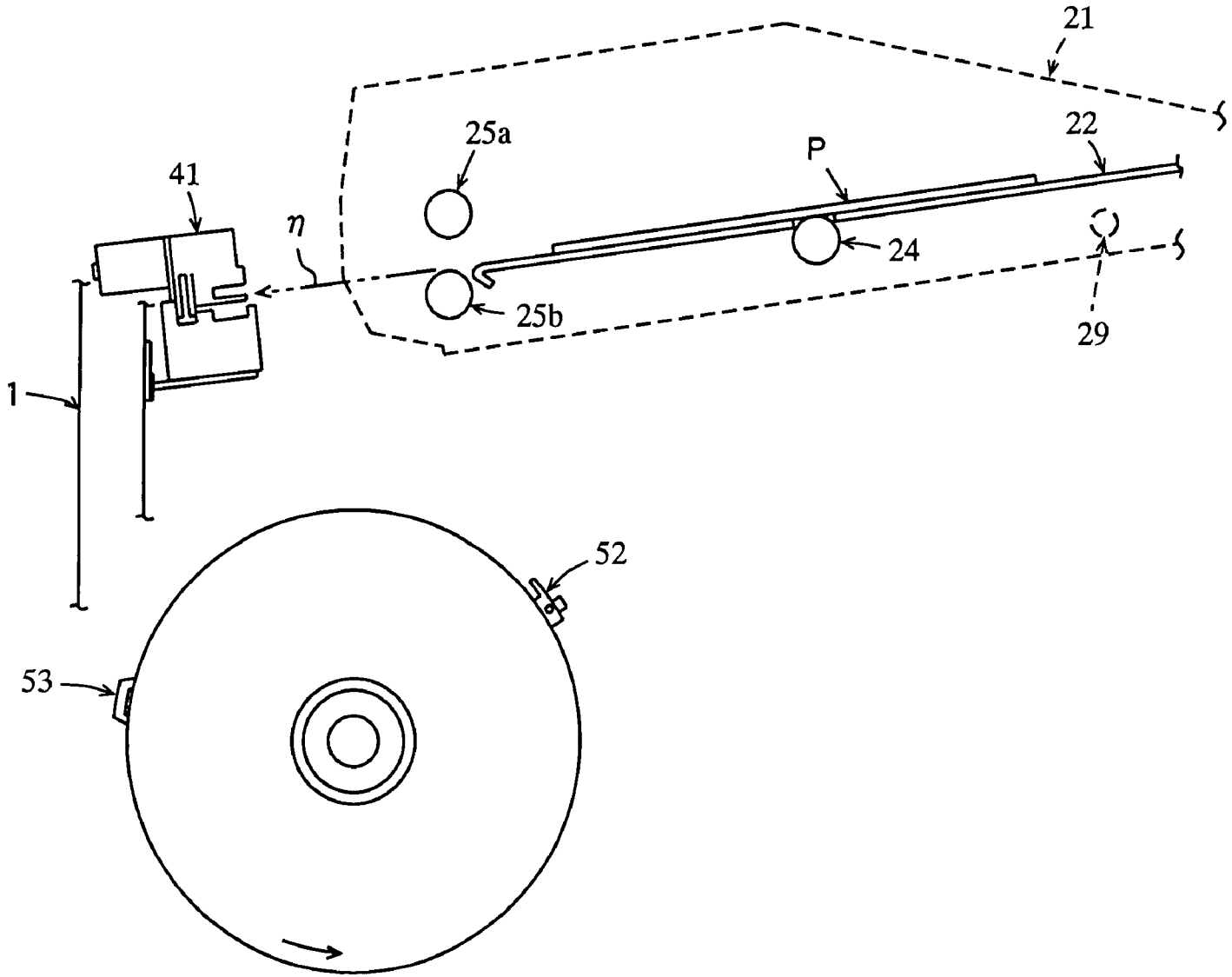
FIG. 10 is a schematic side view illustrating a first supply path line.

First, as shown in FIG. 9, a plate P to be punched is fed to the lower tray 22 of the storage/transportation mechanism 2. The plate P may be manually fed to the lower tray 22 by a human operator, or automatically fed by an automatic plate supplying mechanism (not shown) which may be additionally incorporated in the cylindrical outer surface scanning apparatus. Upon detecting that the plate P has been fed, the sensor PH50 of the storage/transportation mechanism 2 outputs a detection signal indicating the detection to the electrical circuitry section 7. Upon receiving the detection signal, the electrical circuitry section 7 drives the respective motors M55 in order to begin a punching process for the plate P which is currently accommodated in the lower tray 22. Due to the driving force generated by the motors M55, the drive mechanism 3 moves the storage/transportation mechanism 2 from the lower position to the upper position. Consequently, as shown in FIG. 10, the transportation rollers 25 and the lower tray 22 of the storage/transportation mechanism 2 and the inlets 45 of the punch unit 4 are positioned substantially along a single line, with a first supply path line as shown by a dash-double dot arrow η being created therebetween. Note that the transportation roller 25*a* is disposed over the transportation roller 25*b* by means of a transportation roller up/down drive (not shown), so as not to be in contact with the transportation roller 25*b*.

Figure 11:
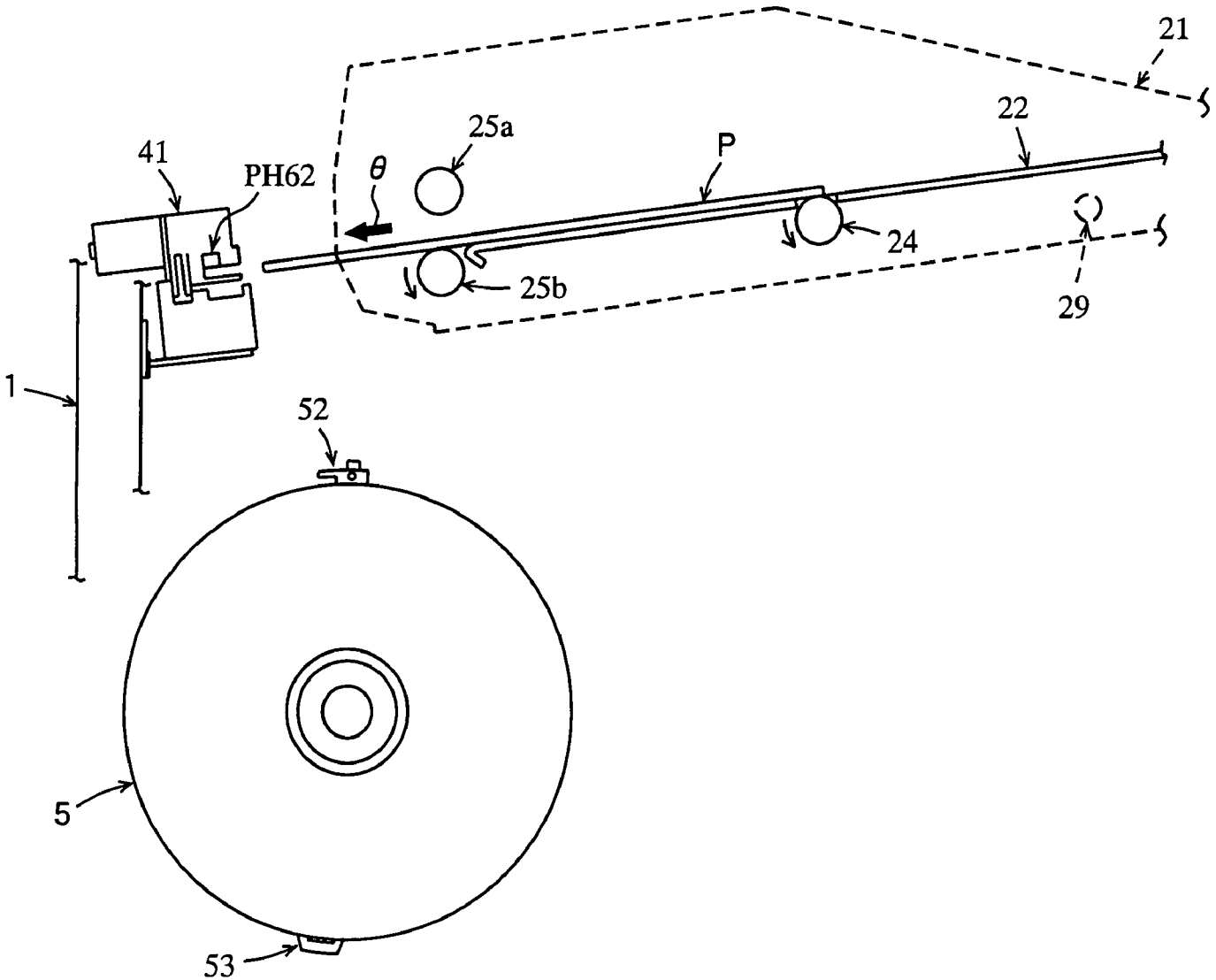
FIG. 11 is a schematic side view illustrating forward rotations of a feed roller 24 and transportation rollers 25*a* and 25*b;*

After the first supply path line is established, the electrical circuitry section 7 drives the motor M50. As shown in FIG. 11, the feed roller 24 and the transportation roller 25*b* rotate in a direction (see arrow θ) for feeding the plate P from the storage/transportation mechanism 2 to the punch unit 4 by the driving force generated by the motor M50. Hereinafter, such rotations of the feed roller 24 and the transportation roller 25*b* will be referred to as "forward rotations". Thus, the plate P is sent across the lower tray 22 in the direction of the transportation rollers 25 based on the rotation of the feed roller 24, and then sent onto the first supply path line, the leading end first, by the action of the transportation roller 25*b*. The plate P which has thus been sent along is transported along the first supply path line in a linear trajectory, and at some point along the first supply path line, fine-positioned with respect to the respective punchers 41 by the above-described centering mechanism. The plate P thus fine-positioned is eventually led into the inlets 45 of the respective punchers 41.

Here, the electrical circuitry section 7 controls the punchers 41 so that the stopper pins 47 of at least two punchers 41 protrude into the respective inlets 45 before the plate P is led into the inlets 45. When the sensor PH62 of each puncher 41 detects the leading end of the plate P having arrived immediately under itself, the sensor PH62 outputs a detection signal indicating the detection of the leading edge of the plate P to the electrical circuitry section 7. In response to the detection signal, the electrical circuitry section 7 stops driving the motor M50. As described above, the plate P is fine-positioned with respect to the right-left direction by the centering mechanism, and fine-positioned with respect to the front-back direction based on the detection result by the sensor PH62. As a result, the punch unit 4 can form positioning notches or non-contacting notches at precise positions in the plate P (the specific positions and shapes of these notches will be described below).

After completing the fine-positioning of the plate P, the electrical circuitry section 7 drives the motors M60 in the punch unit 4 depending on a type of plate P such as the lateral width thereof. The motor M60, which is driven by the electrical circuitry section 7 to move up and down, generates a driving force. Each punch 44 is moved up and down as appropriate due to the driving force generated by its motor M60 so as to punch a notch in a portion of the plate P lying immediately under the punch 44. The specific operations of the punch 44 will be described below.

Figure 12:
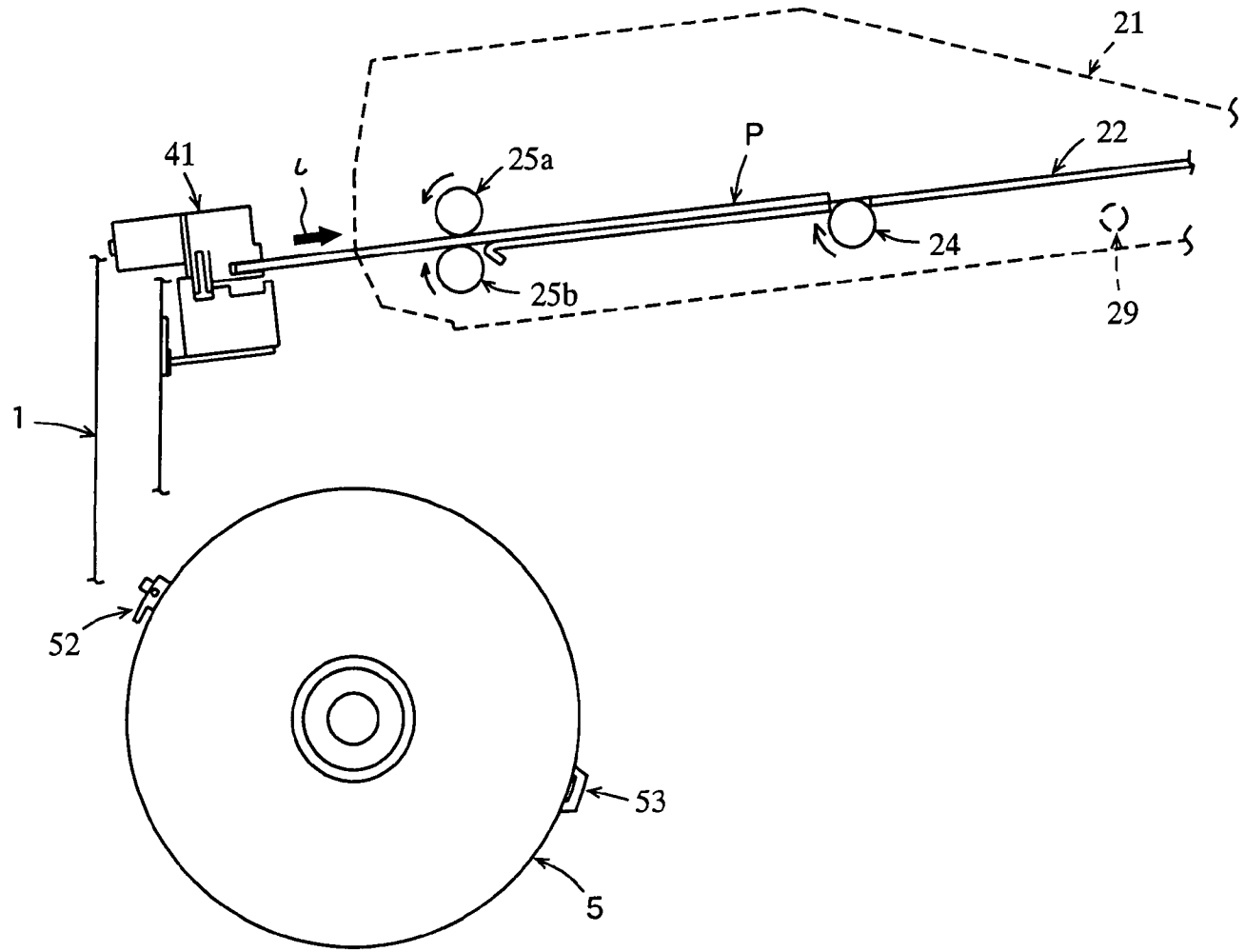
FIG. 12 is a schematic side view illustrating reverse rotations of the feed roller 24 and the transportation rollers 25.

After the completion of the punching, the electrical circuitry section 7 drives the motor M50. At this time, the transportation roller 25*a* is moved down by the transportation roller up/down drive so as to be in an abutting relationship with the transportation roller 25*b*. As shown in FIG. 12, the feed roller 24 and the transportation rollers 25 rotate at a generally constant speed, in the direction of pulling the punched plate P out of the punch unit 4 back into the storage/transportation mechanism 2 (see arrow ι), due to the driving force generated by the motor M50. Hereinafter, such rotations of the feed roller 24 and the transportation rollers 25 will be referred to as "reverse rotations". Due to such reverse rotations, the punched plate P is again accommodated into the lower tray 22 while traveling backwards along the first supply path line.

Figure 13:
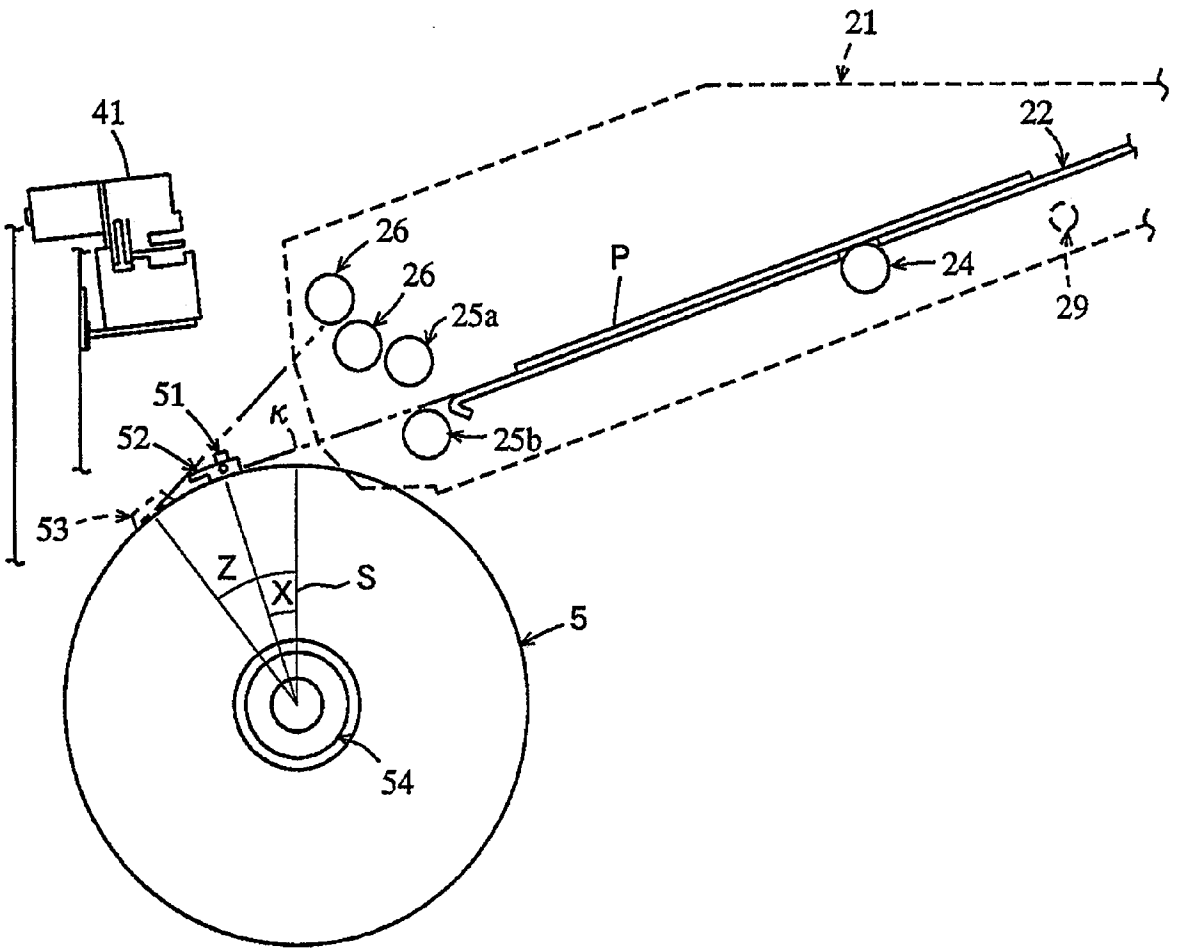
FIG. 13 is a schematic side view illustrating a first angular position X of a leading-end clamp 52.

Next, the electrical circuitry section 7 stops driving the motor M50. The transportation roller up/down drive moves the transportation roller 25*a* up so as to be in a non-abutting relationship with the transportation roller 25*b*. Then, the electrical circuitry section 7 drives the respective motors M55. As shown in FIG. 13, the drive mechanism 3 moves the storage/transportation mechanism 2 from the upper position to the lower position due to the driving force generated by the respective motors M55, and the storage/transportation mechanism 2 is halted at the lower position. As a result, the storage/transportation mechanism 2 and the recording drum 5 are positioned so as to face each other. Then, a loading of the plate P which is currently accommodated in the lower tray 22 is performed.

The electrical circuitry section 7 drives the motor M1 to move the recording drum 5 to a position at which the leading-end clamp 52 takes the angular position X, where the recording drum 5 is halted. When the leading-end clamp 52 takes the angular position X, the storage/transportation mechanism 2 in its lower position and the recording drum 5 are of such a positional relationship that an imaginary line extending in line with the transportation rollers 25 is in contact with (or intersecting) the outer surface of the recording drum 5. Thus, the point of contact (or intersection) between the aforementioned imaginary line and the outer surface of the recording drum 5 defines the angular position X. Furthermore, a line segment κ connecting the transportation rollers 25 and the leading-end clamp 52 at the angular position X defines the second supply path line.

Figure 14:
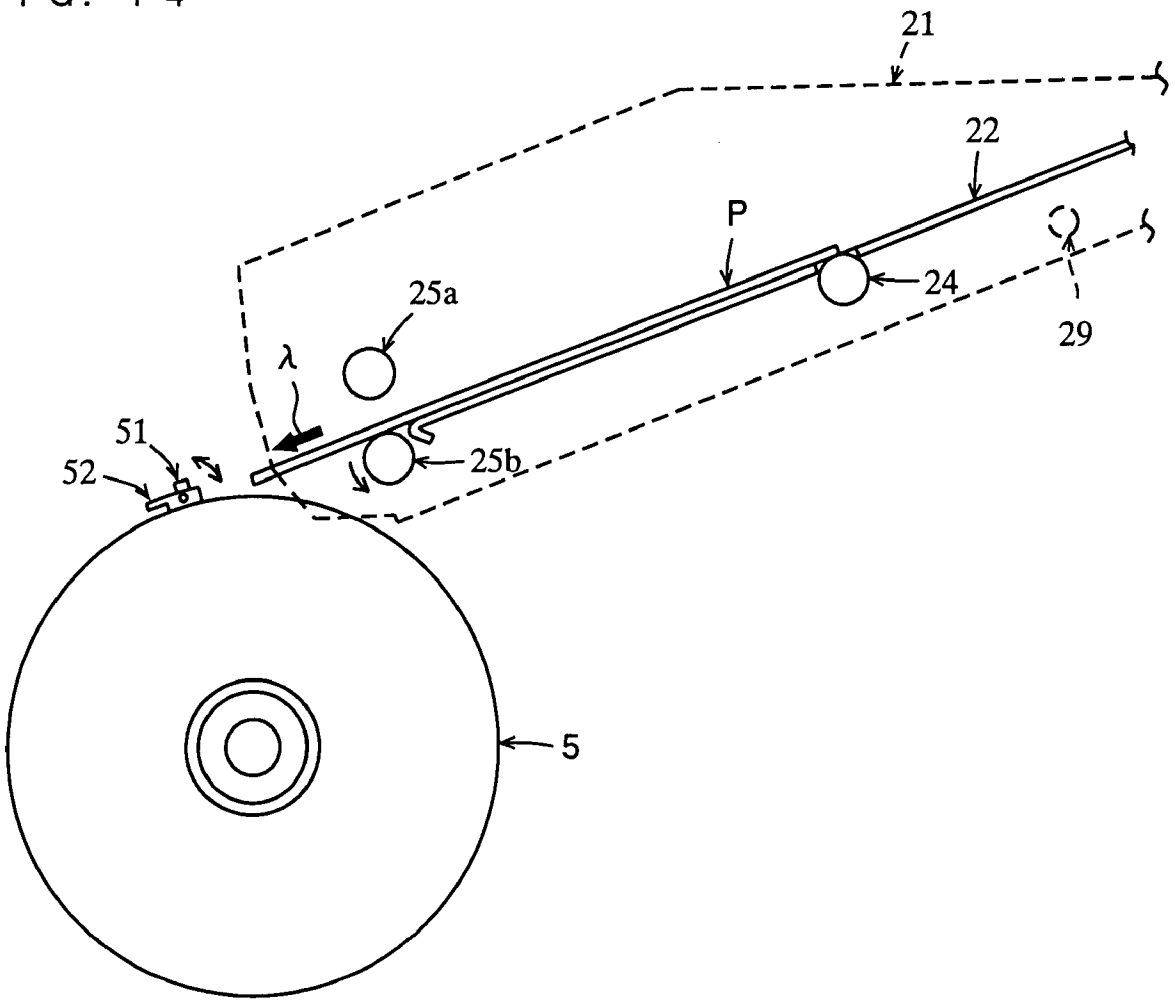
FIG. 14 is a schematic side view illustrating forward rotations of the feed roller 24 and the transportation rollers 25 during the loading of the plate P.
Figure 15:
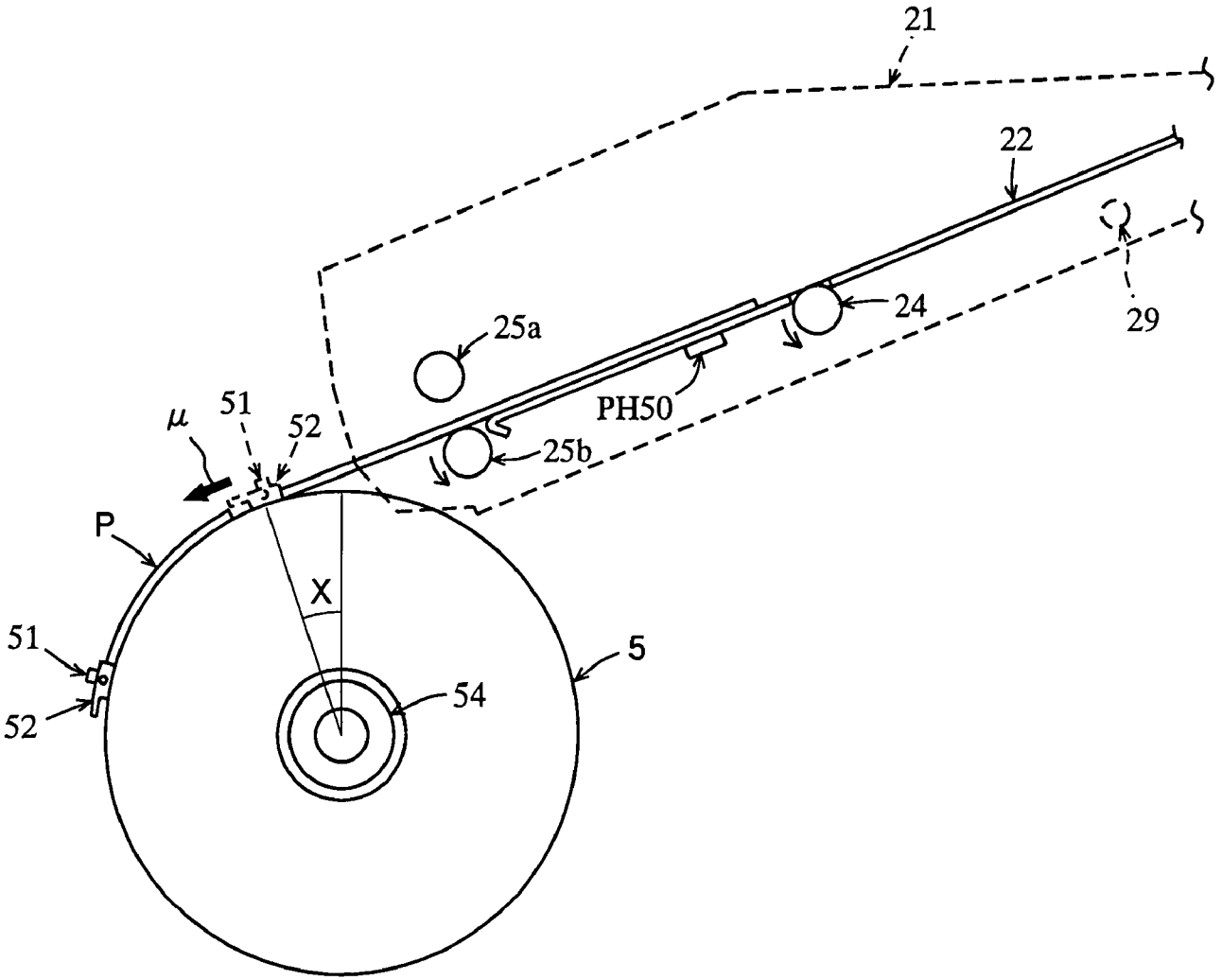
FIG. 15 is a schematic side view illustrating how the plate P is wound around the outer surface of the recording drum 5 due to a forward rotation thereof.

Then, the electrical circuitry section 7 drives the motor M50 to effect forward rotations of the feed roller 24 and the transportation rollers 25 as described above. Thus, as shown in FIG. 14, the plate P is sent off the lower tray 22 toward the recording drum 5, along the second supply path line (see arrow λ). The plate P thus sent-off is positioned with respect to the recording drum 5 as positioning notches formed in the leading end of the plate P fit with the positioning pins 51.

Once the leading end of the plate P is positioned with respect to the recording drum 5, the electrical circuitry section 7 drives the first clamp driving section so as to cause the leading-end clamp 52 to clamp the leading end of the plate P. Thereafter, the electrical circuitry section 7 runs the motor Ml to rotate in the direction indicated by arrow μ in FIG. 15, i.e., so that the plate P can be wound around the outer surface of the recording drum 5. Hereinafter, the rotation of the recording drum 5 in the direction of arrow μ will be referred to a sits "forward rotation".

Figure 16:
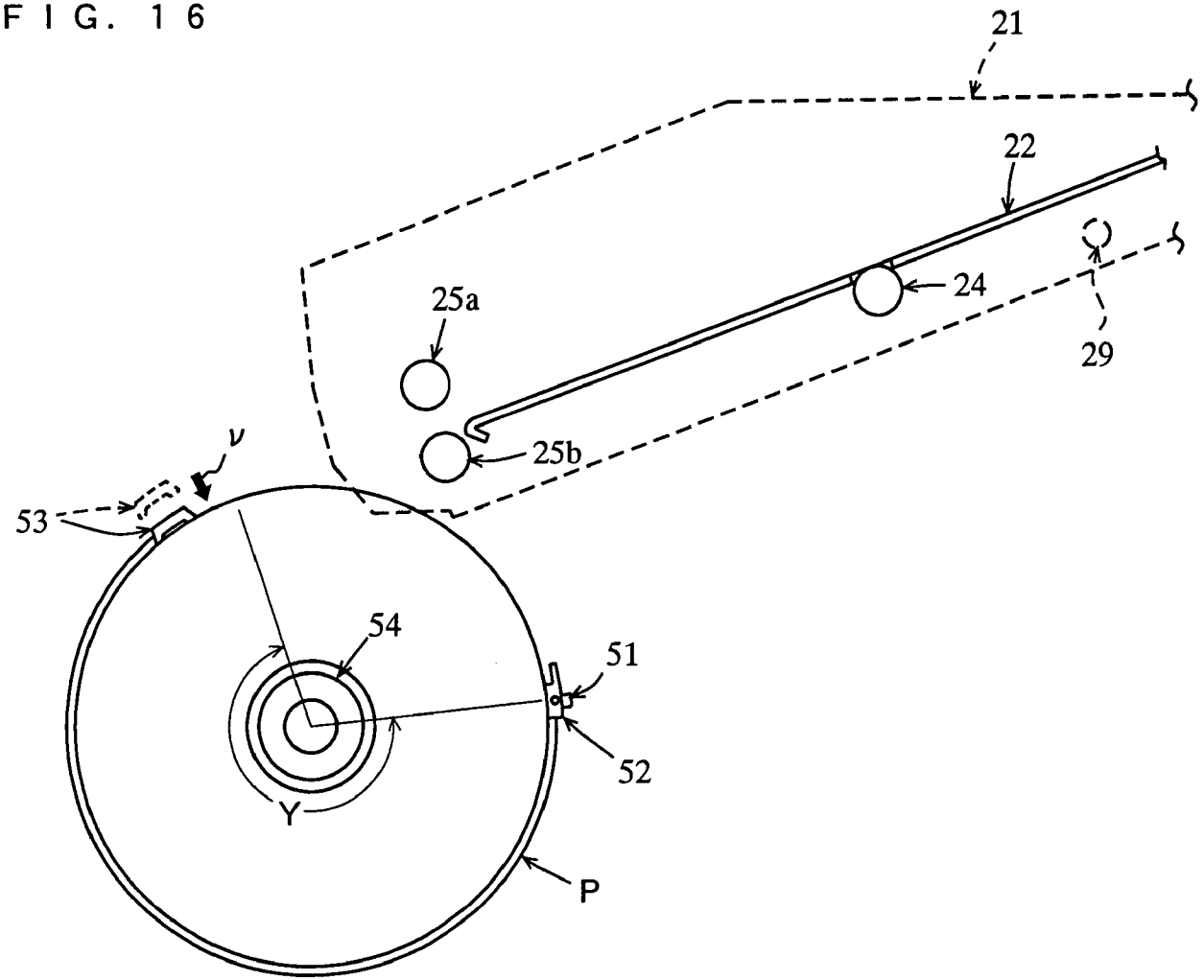
FIG. 16 is a schematic side view illustrating the leading-end clamp 52 having moved in a circular motion by an angle Y from the first angular position X due to the rotation of the recording drum 5.

Consequently, as shown in FIG. 16, the plate P is wound around the outer surface of the recording drum 5 as it is removed from the lower tray 22. While the plate P is being wound around the outer surface of the recording drum 5, the plate P is pressed against the outer surface of the recording drum 5 by the action of the squeeze roller, and achieves close contact with the outer surface of the recording drum 5 through a vacuum suction realized by the aforementioned vacuum system. Finally, the plate P is completely removed from the lower tray 22 due to the rotation of the transportation rollers 25 and the recording drum 5. As shown in FIG. 16, once the leading-end clamp 52 moves in a circular motion from the first angular position X by an angle Y, the other end (i.e., the trailing end) of the plate P arrives immediately under the trailing-end clamp 53, which is currently retained by the third clamp driving section (i.e., in the second angular position Z).

Then, the electrical circuitry section 7 stops driving the motor Ml at the angle ν. As a result, the other end (i.e., the trailing end) of the plate P is halted immediately under the retained trailing-end clamp 53. Thereafter, as the electrical circuitry section 7 begins driving the third clamp driving section, as indicated by arrow ν in FIG. 16, the respective trailing-end clamps 53 are attached on the outer surface of the recording drum 5. Thus, the respective trailing-end clamps 53 clamp the trailing end of the plate P, thereby stabilizing the trailing end on the outer surface of the recording drum 5. In this manner, the plate P is led into the punch unit 4 by the storage/transportation mechanism 2, and after being punched in accurate positions, led onto the recording drum 5 so as to be mounted in a specific position.

Figure 17A:
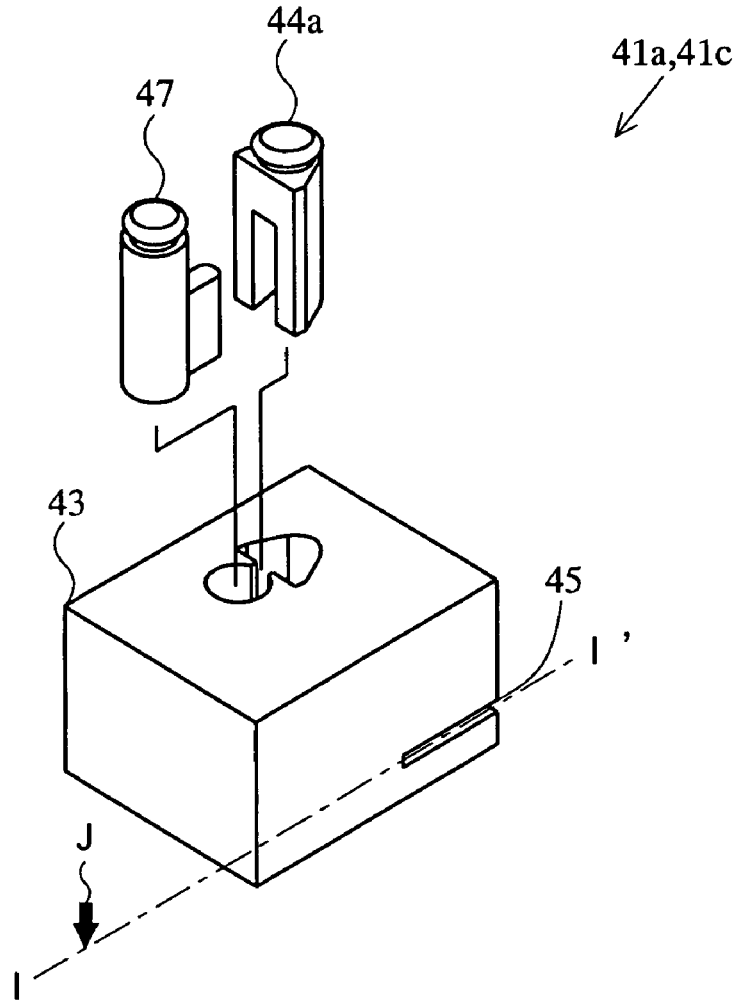
FIG. 17A is a perspective view showing an internal structure of punchers 41*a* and 41*c;*
Figure 17B:
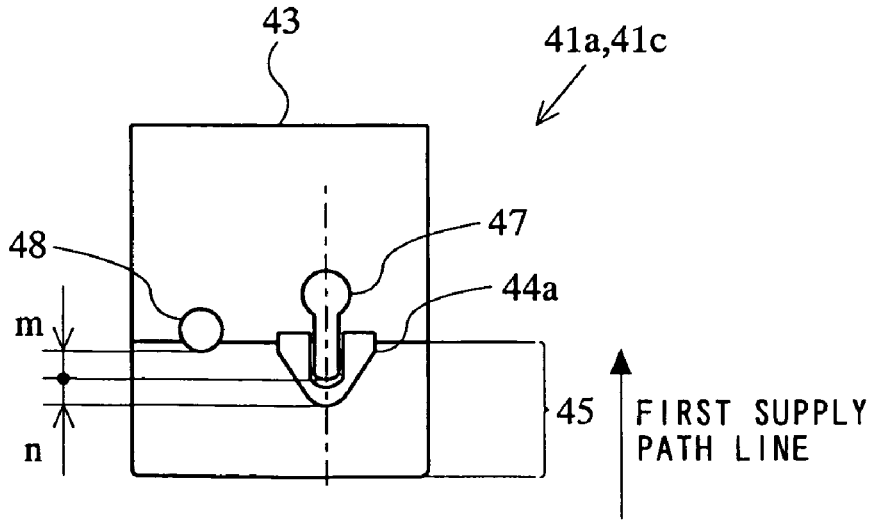
FIG. 17B is a cross-sectional view showing the punchers 41*a* and 41*c*, taken at a dash-dot line I-I' and as seen in the direction of arrow J in FIG. 17A.
Figure 18A:
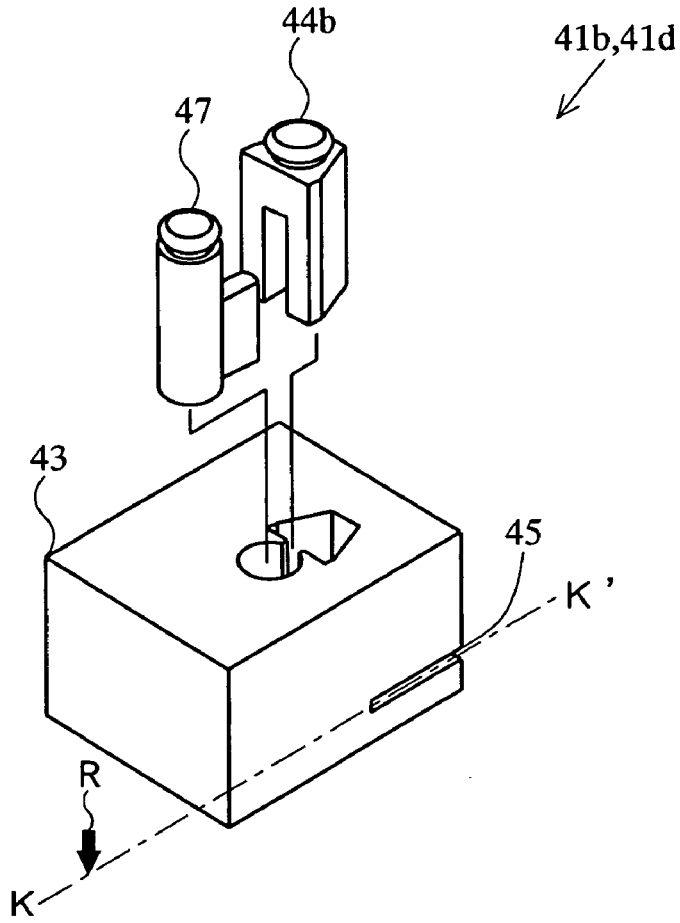
FIG. 18A is a perspective view showing an internal structure of punchers 41*b* and 41*d;*
Figure 18B:
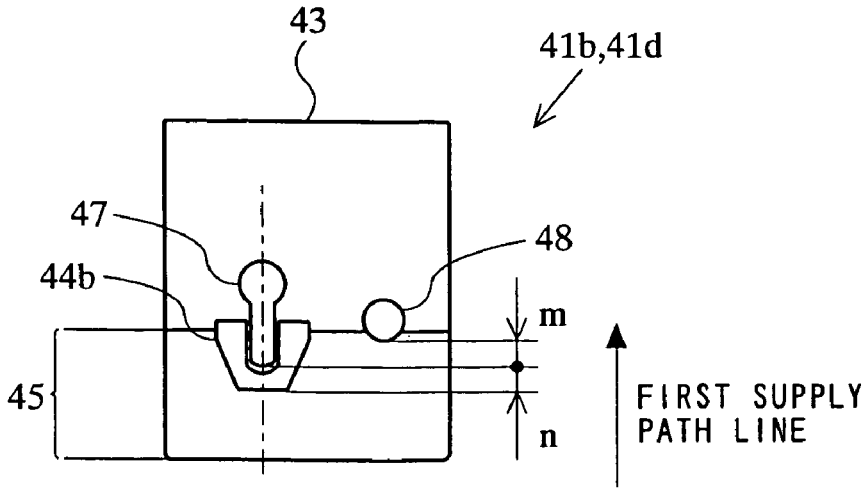
FIG. 18B is a cross-sectional view showing the punchers 41*b* and 41*d*, taken at a dash-dot line K-K' and as seen in the direction of arrow R in FIG. 18A.

Next, the punches 44 (punch 44*a* and punch 44*b*) and the stopper pin 47 provided in the punchers 41 will be described. According to the present example, the punch 44*a* is provided in each of the punchers 41*a* and 41*c* (shown in the right-hand part of FIG. 7), whereas the punch 44*b* is provided in each of the punchers 41*b* and 41*d* (shown in the left-hand part of FIG. 7). FIG. 17A is a perspective view showing a simplified internal structure of the punchers 41*a* and 41*c* each having the punch 44*a* and the stopper pin 47. FIG. 17B is across-sectional view showing the punchers 41*a* and 41*c*, taken at a dash-dot line I-I' and as seen in the direction of arrow J in FIG. 17A. FIG. 18A is a perspective view showing a simplified internal structure of the punchers 41*b* and 41*d* each having the punch 44*b* and the stopper pin 47. FIG. 18B is a cross-sectional view showing the punchers 41*b* and 41*d*, taken at a dash-dot line K-K' and as seen in the direction of arrow R in FIG. 18A. In the cross-sectional views of FIG. 17B and FIG. 18B, the punch 44 and the stopper pin 47 reach the inside of the inlet 45.

As shown in FIGS. 17A and 17B, the punch 44*a* has a cross section wherein the tip thereof, which faces an opening of the inlet 45 (i.e., from which the plate P is transported along the first supply path line), is in the shape of a circular arc. The stopper pin 47 has a cross section wherein the tip thereof, which faces the opening of the inlet 45, is in the shape of a circular arc having a shaper curvature than that of the punch 44*a*. The punch 44*a* and the stopper pin 47 are inserted in a vertical hole formed in the main body 43. The punch 44*a* and the stopper pin 47 thus inserted in the vertical hole move up and down along the vertical hole so as to retract from and protrude into the inlet 45. The punch 44 and the stopper pin 47 are disposed in such a manner that a line passing though the tips thereof coincides with the direction of the first supply path line. The tip of the punch 44*a* is disposed so as to be closer to the opening of the inlet 45 at a distance of n than the tip of the stopper pin 47. As shown in FIGS. 17A and 17B, the punch 44*a* has a cross section in the shape of "U" so as to accommodate a portion of the stopper pin 47 exposed to the inlet 45.

The stopper member 48 is fixed at the back end of the inlet 45. The stopper member 48 and the stopper pin 47 are disposed in such a manner that the tip of the stopper pin 47 is at a distance of m from the tip of the stopper member 48, which faces the opening of the inlet 45, along the direction of the first supply path line, and is closer to the opening of the inlet 45 than the tip of the stopper member 48. The distances m and n are set so as to satisfy m>n.

As mentioned above, the stopper pin 47 functions as a positioning reference for a plate P to be inserted in the inlet 45 along the first supply path line. For example, the end face of the plate P is brought into contact with the tip of the stopper pin 47 in the direction of the first supply path line, and then the punch 44*a* is moved down to the bottom of the inlet 45 while retaining the contact between the end face of the plate P and the tip of the stopper pin 47, whereby a notch having a depth of n is formed at the end of the plate. The deepest portion of the notch has a shape of a circular arc, which is identical to a shape of the tip of the punch 44*a*. Then, the notch having a depth of n and being formed at the end of the plate is brought into contact again with the tip of the stopper pin 47 in the direction of the first supply path line, and the punch 44*a* is moved down to the bottom of the inlet 45 while retaining the contact between the notch and the tip of the stopper pin 47. As a result, a notch having a depth of 2n is formed at the end of the plate P. In this case, the end face of the plate P is not in contact with the stopper member 48 due to m>n.

As shown in FIGS. 18A and 18B, the punch 44*b* has a cross section wherein the tip thereof, which faces an opening of the inlet 45, has a linear shape and is perpendicular to the first supply path line. In other words, the punch 44*b* has a cross section in the shape of a trapezoid whose shorter base faces the opening. A cross section of the stopper pin 47 is identical to that of the stopper pin 47 provided in the punchers 41*a* and 41*c*. The tip of the stopper pin 47, which faces the opening of the inlet 45, has a curvature greater than that of the punch 44*a*. The punch 44*b* and the stopper pin 47 are inserted in a vertical hole formed in the main body 43. The punch 44*b* and the stopper pin 47 thus inserted in the vertical hole move up and down along the vertical hole so as to retract from and protrude into the inlet 45. An imaginary line passing through the middle point of the tip of the punch 44b and the tip of the stopper pin 47 coincides with the direction of the first supply path line. The tip of the punch 44*b* is disposed so as to be closer to the opening of the inlet 45 at a distance of n than the tip of the stopper pin 47. As shown in FIGS. 18A and 18B, the punch 44*a* has a cross section in the shape of "U" so as to accommodate a portion of the stopper pin 47 exposed to the inlet 45.

The stopper member 48 is fixed at the back end of the inlet 45. The stopper member 48 and the stopper pin 47 are disposed in such a manner that the tip of the stopper pin 47 is at a distance of m from the tip of the stopper member 48, which faces the opening of the inlet 45, along the direction of the first supply path line, and is closer to the opening of the inlet 45 than the tip of the stopper member 48. The distances m and n are set so as to satisfy m>n.

For example, the end face of the plate P is brought into contact with the tip of the stopper pin 47 in the direction of the first supply path line, and then the punch 44*b* is moved down to the bottom of the inlet 45 while retaining the contact between the end face of the plate P and the tip of the stopper pin 47, whereby a notch having a depth of n is formed at the end of the plate P. The deepest portion of the notch has a linear shape identical to a shape of the tip of the punch 44*b* (e.g., a shorter base of a trapezoid). Then, the notch having a depth of n and being formed at the end of the plate P is brought into contact again with the tip of the stopper pin 47 in the direction of the first supply path line, and then the punch 44*b* is moved down to the bottom of the inlet 45 while retaining the contact between the notch and the tip of the stopper pin 47. As a result, a notch having a depth of 2n is formed at the end of the plate P. In this case, the end face of the plate P is not in contact with the stopper member 48 due to m>n.

As such, each of the punchers 41*a* to 41*d* creates a notch having a depth of n by bringing the end face of the plate P into contact with the tip of the stopper pin 47 in the direction of the first supply path line, and then moving the punch 44 down to the bottom of the inlet 45 while retaining the contact between the end face of the plate P and the tip of the stopper pin 47. The notch having a depth of n thus created functions as a positioning notch for the plate P. The notch having a depth of n and being formed at the end of the plate P is brought into contact again with the tip of the stopper pin 47 in the direction of the first supply path line, and then the punch 44 is moved down to the bottom of the inlet 45, whereby a notch having a depth of 2n is formed. The notch having a depth of 2n thus created functions as a non-contacting notch for the plate P. As described above, each of the punchers 41*a* to 41*d* can create two types of notches having different functions at the end of the plate P.

Figure 19:
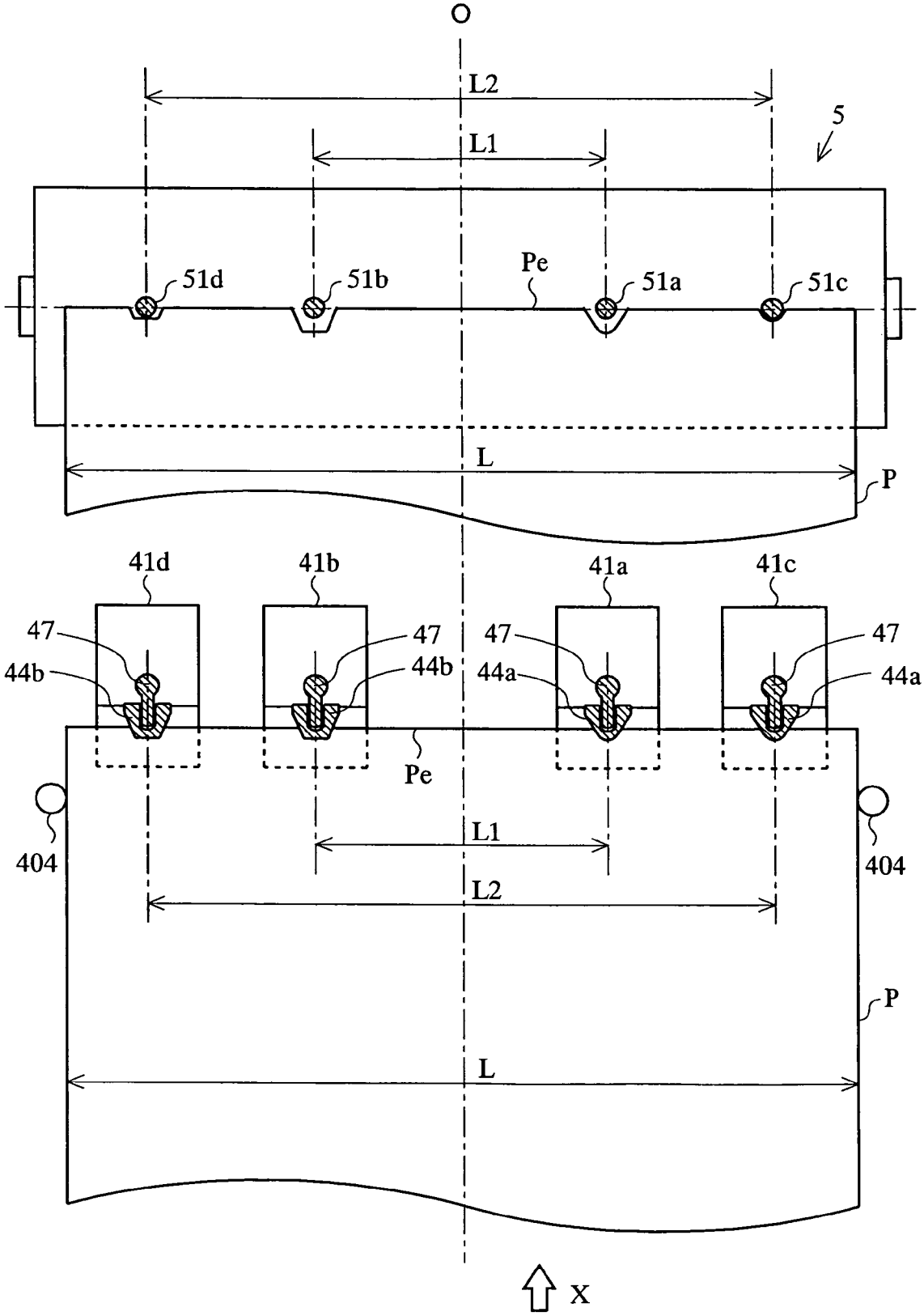
FIG. 19 is a view illustrating the simplified relative positions of the plate P, the punchers 41, and positioning pins 51.

Next, the specific positions of the above-described punchers 41 and the positioning pins 51 provided on the recording drum 5 will be described. FIG. 19 is a view illustrating the simplified relative positions of the plate P, the punchers 41, and positioning pins 51. For conciseness, those component elements which are not relevant to the relative positions of the aforementioned component elements are omitted from the following description.

As shown in FIG. 19, each of the punchers 41*a* to 41*d* has the punch 44*a* or 44*b* and the stopper pin 47. The punchers 41*a* to 41*d* are each disposed in such a manner that the tip of the punch 44*a* or 44*b* coincides with the same straight line perpendicular to the first supply path line. Thus, the tips of the stopper pins 47 are also disposed on the same straight line perpendicular to the first supply path line. The tip of the punch 44*a* of the puncher 41*a* and the tip of the punch 44*b* of the puncher 41*b* are disposed with a distance L1 therebetween so as to be centered with respect to a centering reference O (described below), whereas the tip of the punch 44*a* of the puncher 41*c* and the tip of the punch 44*b* of the puncher 41*d* are disposed with a distance L2 (L2>L1) therebetween so as to be centered with respect to the centering reference O.

As described above, when the storage/transportation mechanism 2 (not shown) has transported a plate P having a lateral width L along the first supply path line (i.e., in an X direction shown in FIG. 19) and led the plate P into the punchers 41, both sides of the plate P receive a centering action by the retention members 404, so as to be centered with respect to the centering reference O. The plate P thus centered is led into the inlets 45 of the punchers 41, so that the stopper pins 47 protruding into the inlets 45 come in contact with a leading end face Pe of the plate P. In other words, the plate P is positioned in such a manner that: the plate P is centered with respect to the center line 0 by the retention members 404; and the positioning of the plate P along the X direction is determined by the stopper pins 47. After the sensor PH62 has detected that the plate P sits in this state, necessary notches having a depth of n are formed along the end face Pe of the plate P by the punches 44. Also, if required, after the notches having a depth of n are formed along the end face Pe of the plate P, the stopper pins 47 protruding into the inlets 45 come in contact with the notches formed along the end face Pe of the plate P such that necessary notches having a depth of 2n are formed along the end face Pe of the plate P by the punches 44. The specific operations of the punches 44, the stopper pins 47, and the plate P will be described below.

On the other hand, the aforementioned four positioning pins 51 are provided on the surface of the recording drum 5. Each of the positioning pins 51*a* to 51*d* has a cross section in the shape of a full circle with the radius r, for example. The positioning pins 51*a* to 51*d* are fixed on the same straight line parallel to the cylindrical axis of the recording drum 5. The positioning pin 51*a* fits in the notch created by the puncher 41*a*. The positioning pin 51*b* fits in the notch created by the puncher 41*b*. The positioning pin 51*c* fits in the notch created by the puncher 41*c*. The positioning pin 51*d* fits in the notch created by the puncher 41*d*. The center of the positioning pin 51*a* and the center of the positioning pin 51*b* are disposed with a distance L1 therebetween so as to be centered with respect to the centering reference O, whereas the center of the positioning pin 51*c* and the center of the positioning pin 51*d* are disposed with a distance L2 so as to be centered with respect to the centering reference O. In other words, the positioning pins 51*a* and 51*b* are fixed in the respective positions close to the center of the recording drum 5; each of the positioning pins 51*c* and 51*d* is fixed in a position close to the corresponding end of the recording drum 5. The positioning pins 51 are arranged in the order 51*c*, 51*a*, 51*b*, and 51*d* from right to left of the recording drum 5 as shown in FIG. 19.

Figure 20:
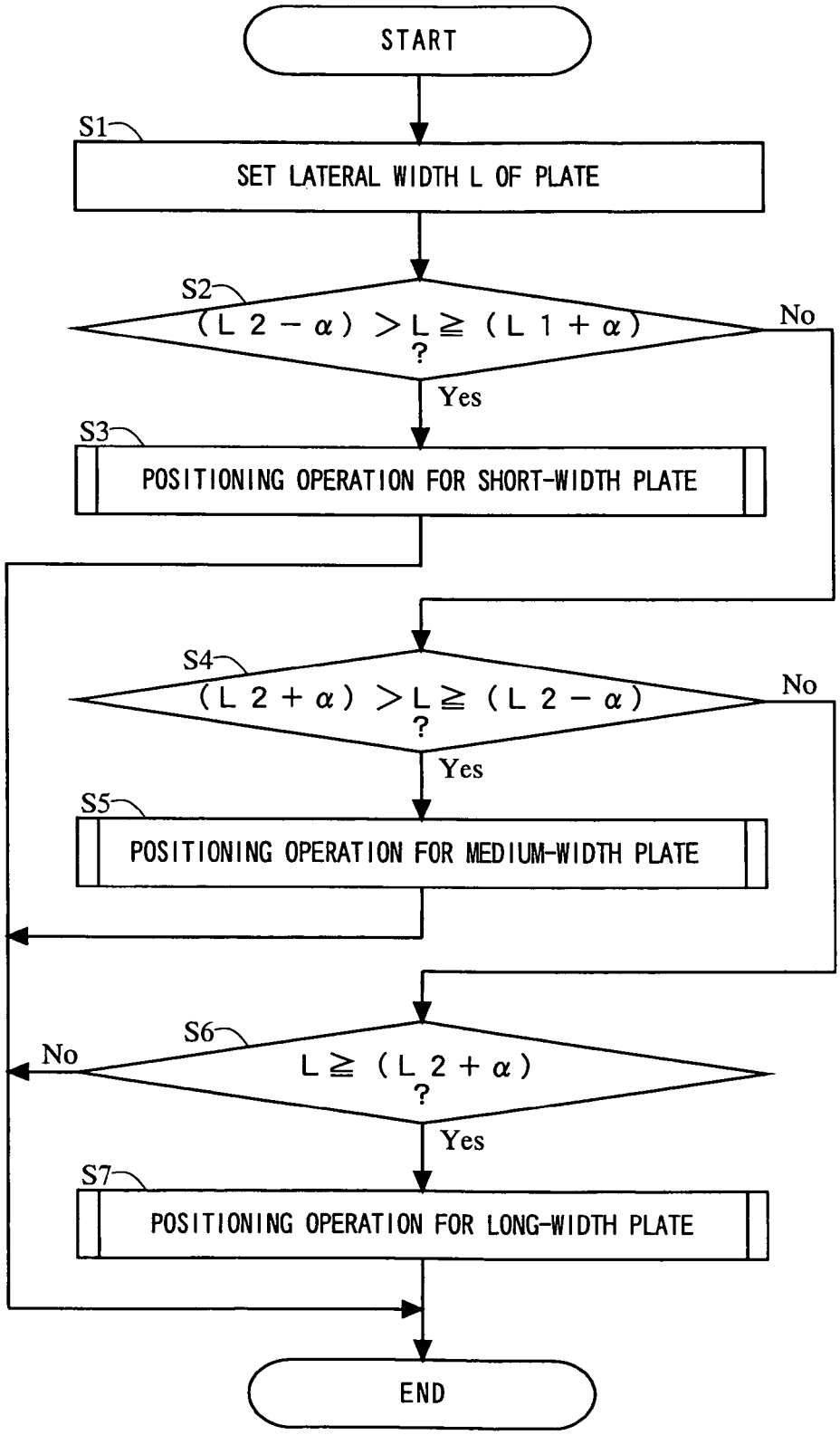
FIG. 20 is a flowchart showing how the plate P is positioned on the recording drum 5 of the cylindrical outer surface scanning apparatus shown in FIG. 1.
Figure 21:
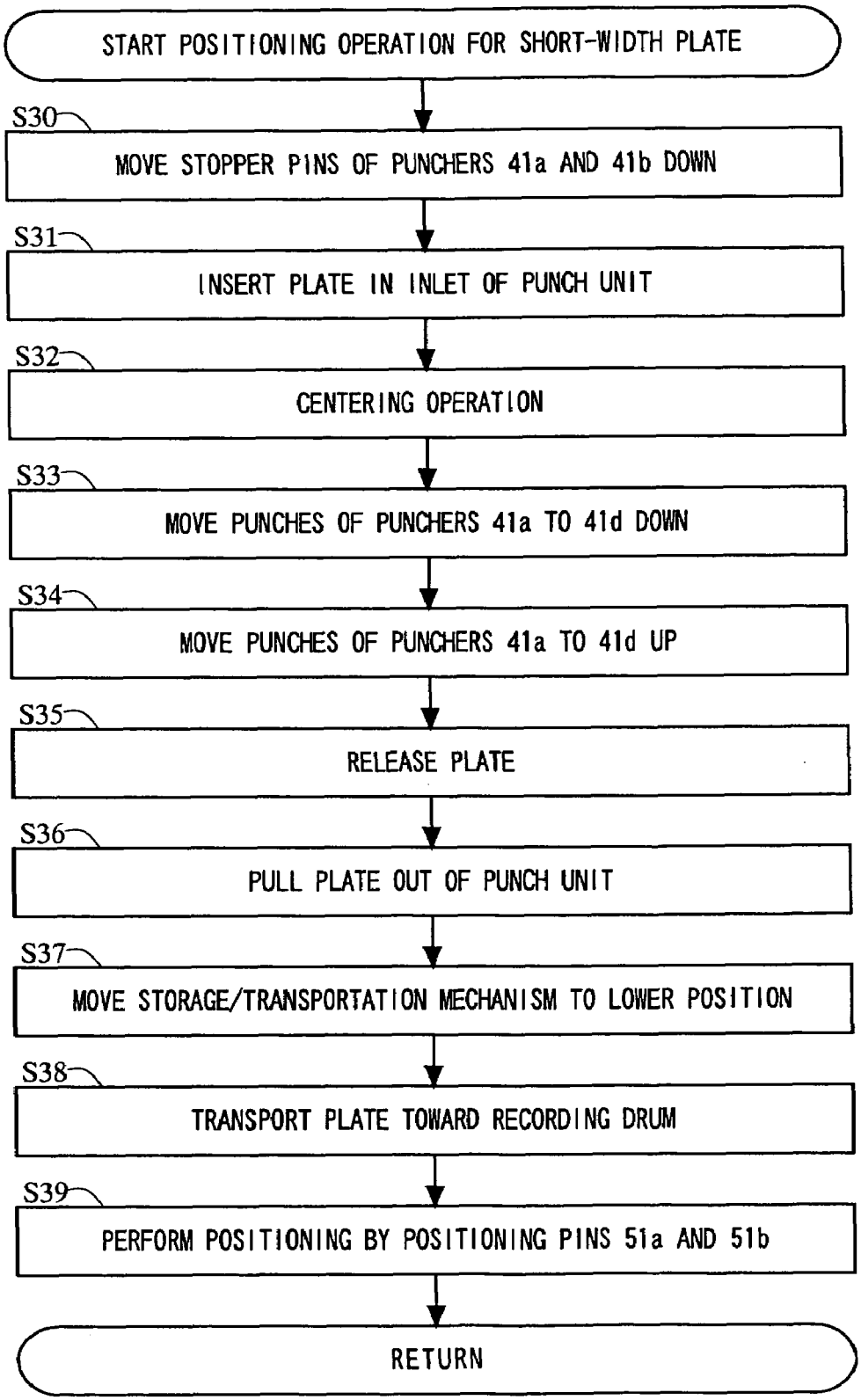
FIG. 21 is a subroutine showing how a short-width plate is positioned at step S3 of FIG. 20.
Figure 22:
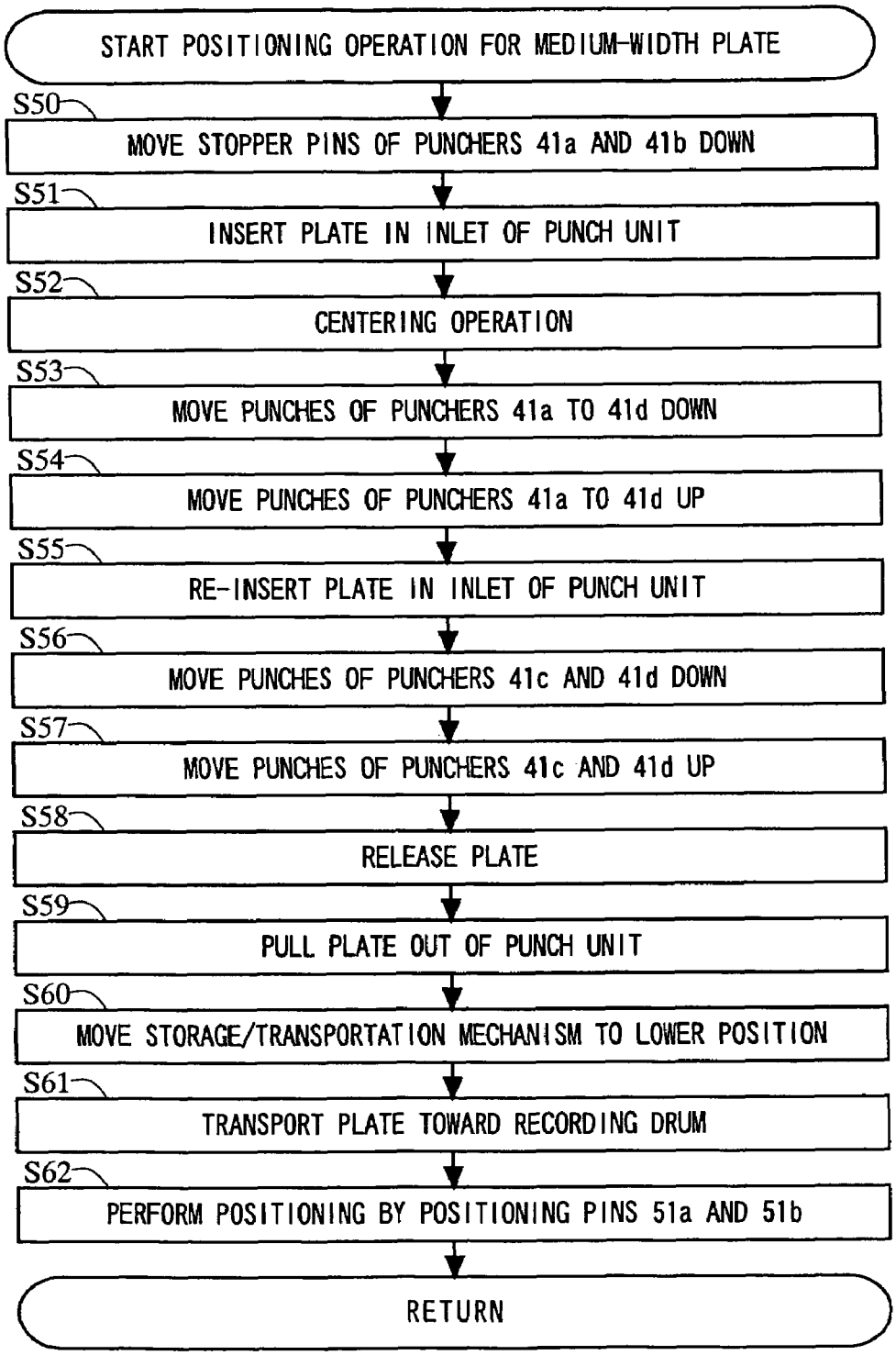
FIG. 22 is a subroutine showing how a medium-width plate is positioned at step S5 of FIG. 20.
Figure 23:
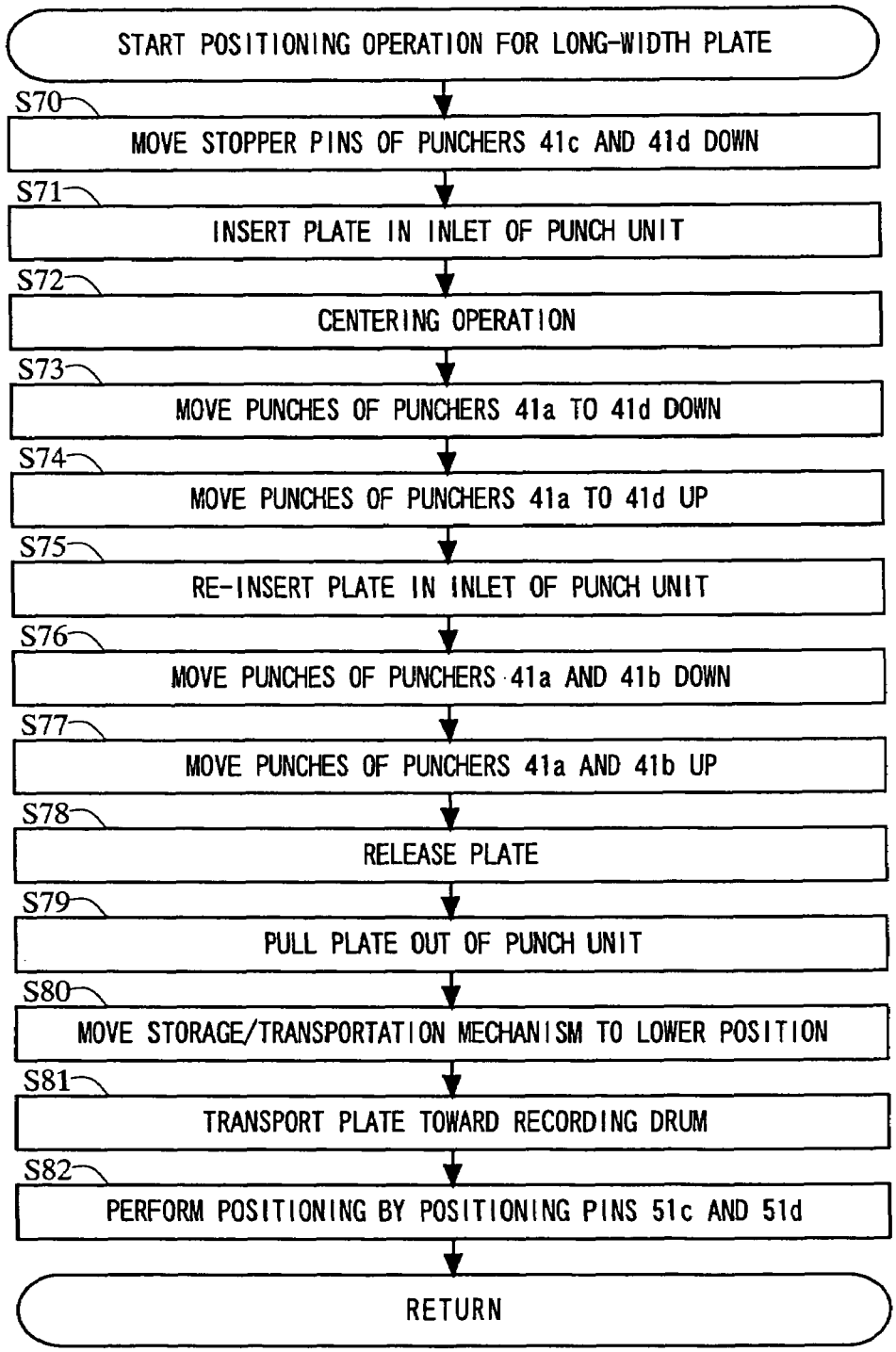
FIG. 23 is a subroutine showing how a long-width plate is positioned at step S7 of FIG. 20.

Next, referring to FIGS. 20 to 28, the methods for positioning the plate P with respect to the recording drum 5 will be described. According to the present embodiment, different positioning methods are employed depending on the lateral width of the plate P. FIG. 20 is a flowchart showing how the plate P is positioned on the recording drum 5 of the cylindrical outer surface scanning apparatus. FIG. 21 is a subroutine showing how a short-width plate P is positioned at step S3 of FIG. 20. FIG. 22 is a subroutine showing how a medium-width plate P is positioned at step S5 of FIG. 20. FIG. 23 is a subroutine showing how a long-width plate P is positioned at step S7 of FIG. 20. FIGS. 24A to 24D are schematic views showing the operation for positioning a short-width plate P. FIGS. 25A to 25F are schematic views showing the operation for positioning a medium-width plate P. FIGS. 26A to 26F are schematic views showing the operation for positioning a long-width plate. FIGS. 27A to 27D are schematic perspective views showing the first half of the operation for forming a notch along one end face of the plate P when a long-width plate P is positioned. FIGS. 28A to 28C are schematic perspective views showing the last half of the operation for forming a notch along one end face of the plate P when the long-width plate P is positioned.

As shown in FIG. 20, the electrical circuitry section 7 sets a lateral width L of a plate P to be mounted on the outer surface of the recording drum 5 (step S1). For instance, the lateral width L may be manually set by a user of the cylindrical outer surface scanning apparatus, or may be set according to information from the plate feeding unit feeding a plate P into the cylindrical outer surface scanning apparatus. Alternatively, a sensor may be provided on the storage/transportation mechanism 2 for detecting a lateral width of a plate P, such that the lateral width L can be set according to information therefrom.

Next, the electrical circuitry section 7 determines whether or not the lateral width L set at step 1 satisfies $(L2-\alpha)>L\geqq(L1+\alpha)$ (step S2). In the above inequality, L1 corresponds to the aforementioned distance L1 between the center of the positioning pin 51*a* and the center of the positioning pin 51*b*; L2 corresponds to the aforementioned distance L2 between the center of the positioning pin 51*c* and the center of the positioning pin 51*d* (see FIG. 19). Also, $\alpha$ corresponds to a margin for positioning the plate P by utilizing the positioning pin 51. For example, the margin $\alpha$ is set to be equal to or greater than twice the radius r of the positioning pin 51.

In the case where the lateral width L satisfies $(L2-\alpha)>L\geqq(L1+\alpha)$, the electrical circuitry section 7 performs a positioning operation for a short-width plate P (step S3), and ends the process of the flowchart. The details concerning the positioning operation for a short-width plate P at step S3 will be described below. In the case where the lateral width L does not satisfy $(L2-\alpha)>L\geqq(L1+\alpha)$, the electrical circuitry section 7 proceeds to step S4.

At step S4, the electrical circuitry section 7 determines whether or not the lateral width L set at step S1 satisfies $(L2+\alpha)>L\geqq(L2-\alpha)$. In the case where the lateral width L satisfies $(L2+\alpha)>L\geqq(L2-\alpha)$, the electrical circuitry section 7 performs a positioning operation for a medium-width plate P (step S5), and ends the process of the flowchart. The details concerning the positioning operation for a medium-width plate P at step S5 will be described below. In the case where the lateral width L does not satisfy $(L2+\alpha)>L\geqq(L2-\alpha)$, the electrical circuitry section 7 proceeds to step S6.

At step S6, the electrical circuitry section 7 determines whether or not the lateral width L set at step S1 satisfies $L\geqq(L2+\alpha)$. In the case where the lateral width L satisfies $L\geqq(L2+\alpha)$, the electrical circuitry section 7 performs a positioning operation for a long-width plate P (step S7), and ends the process of the flowchart. The details concerning the positioning operation for a long-width plate P at step S7 will be described below. In the case where the lateral width L does not satisfy $L\geqq(L2+\alpha)$, the electrical circuitry section 7 determines that positioning is impossible. The electrical circuitry section 7 performs a predetermined aborting process, and ends the process of the flowchart.

Figure 24A:
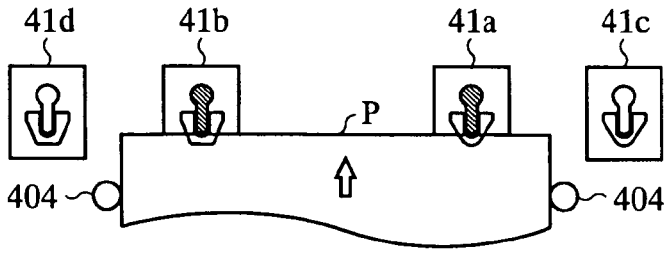
FIG. 24A is a schematic view showing a first stage of a positioning operation for a short-width plate.

Next, referring to FIG. 21 and FIGS. 24A to 24D, the positioning process for a short-width plate P at step S3 will be described. Firstly, the electrical circuitry section 7 moves the stopper pins 47 provided in the punchers 41*a* and 41*b* down so as to protrude into the inlets 45 (step S30). The electrical circuitry section 7 causes the plate P to be sent across the lower tray 22 in the direction of the transportation roller 25 based on the rotation of the feed roller 24, and then sent onto the first supply path line. As a result, one end face of the plate P is inserted in the inlets 45 of the punchers 41*a* and 41*b*. The one end face of the plate P thus inserted comes in contact with the tips of the stopper pins 47 (step S31; see FIG. 11). When the electrical circuitry section 7 moves the pair of centering bearings 402 toward the center, the outer surfaces of the retention members 404 on the centering bearing 402 abut the end faces of the plate P on both sides, thereby positioning the plate P in the center of the attachment member 42 (step S32). The plate P, the punchers 41, and the retention members 404 as illustrated in FIG. 24A are in this state. Note that the punches 44 and the stopper pins 47 hatched with oblique lines in FIGS. 24A to 24D, and FIGS. 25A to 25F and FIGS. 26A to 26F (described below) indicate that they moved down to the bottom of the inlets 45.

Figure 24B:
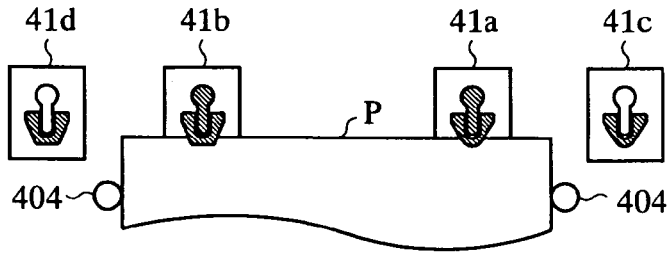
FIG. 24B is a schematic view showing a second stage of the positioning operation for a short-width plate.

Next, the electrical circuitry section 7 moves the punches 44 provided in the punchers 41*a* to 41*d* down to protrude into the inlets 45, so as to punch a notch in a portion of the plate P lying immediately under the punches 44 (step S33). The punch 44*a* of the puncher 41*a* punches a portion of the plate P, whereby a positioning notch having a depth of n is formed at one end of the plate P. The deepest portion of the positioning notch thus formed has a circular arc shape. Similarly, the punch 44*b* of the puncher 41*b* punches a portion of the plate P, whereby a positioning notch having a depth of n is formed at one end of the plate P. The deepest portion of the positioning notch thus formed has a linear shape. Note that the plate P does not lie immediately under the punches 44 of the punchers 41*c* and 41*d* due to the lateral width L of the plate P satisfying $(L2-\alpha)>L$. Thus, no notch is formed along the end of the plate P by the action of the punchers 41*c* and 41d. The plate P, the punchers 41, and the retention members 404 as illustrated in FIG. 24B are in this state.

Figure 24C:
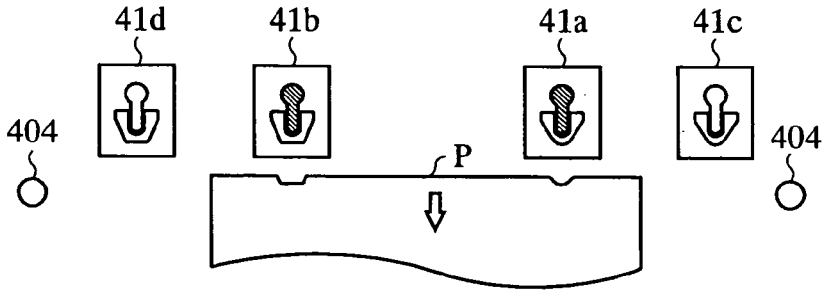
FIG. 24C is a schematic view showing a third stage of the positioning operation for a short-width plate.

Next, the electrical circuitry section 7 moves the punches 44 provided in the punchers 41*a* to 41*d* up so as to retract from the inlets 45 (step S34). When the electrical circuitry section 7 moves the centering bearings 402 outward, the retention members 404 move away from the end faces of the plate P on both sides, thereby releasing the plate P (step S35). The electrical circuitry section 7 causes the punched plate P to travel backward along the first supply path line from the punch unit 4 to the storage/transportation mechanism 2 so as to accommodate the plate P again into the lower tray 22 (step S36; see FIG. 12). The plate P, the punchers 41, and the retention members 404 as illustrated in FIG. 24C are in this state.

Figure 24D:
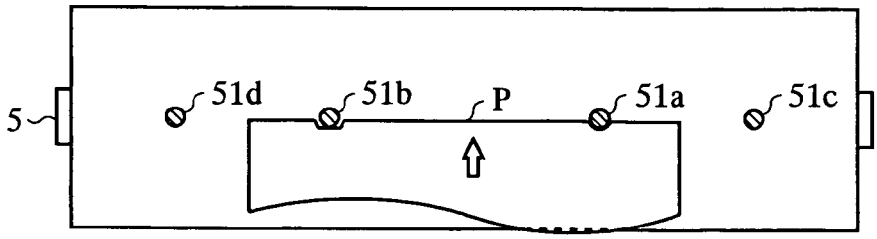
FIG. 24D is a schematic view showing a fourth stage of the positioning operation for a short-width plate.

Next, the electrical circuitry section 7 moves the storage/transportation mechanism 2 from the upper position to the lower position, and the storage/transportation mechanism 2 is halted at the lower position (step S37; see FIG. 13). The plate P is sent off the lower tray 22 toward the recording drum 5, along the second supply path line, by the electrical circuitry section 7 (step S38; see FIG. 14). The plate P thus sent-off is positioned with respect to the recording drum 5 as two positioning notches formed at one end of the plate P fit with the positioning pins 51*a* and 51*b* (step S39). The plate P, the recording drum 5, and the positioning pins 51 as illustrated in FIG. 24D are in this state. The process for mounting the plate P thus positioned on the recording drum 5 is the same as the process described above regarding FIGS. 15 and 16, and the descriptions thereof are omitted. Then, the electrical circuitry section 7 ends the process of the subroutine.

Figure 25A:
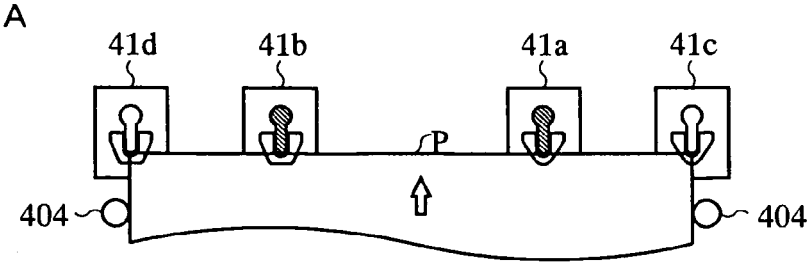
FIG. 25A is a schematic view showing a first stage of a positioning operation for a medium-width plate.

Next, referring to FIG. 22 and FIGS. 25A to FIG. 25F, the positioning process for a medium-width plate P at step S5 will be described. Firstly, the electrical circuitry section 7 moves the stopper pins 47 provided in the punchers 41*a* and 41*b* down so as to protrude into the inlets 45 (step S50). The electrical circuitry section 7 causes the plate P to be sent across the lower tray 22 in the direction of the transportation roller 25 based on the rotation of the feed roller 24, and then sent onto the first supply path line. As a result, one end of the plate P is inserted in the inlets 45 of the punchers 41*a* to 41*d*. The one end face of the plate P thus inserted comes in contact with the tips of the stopper pins 47 (step S51; see FIG. 11). When the electrical circuitry section 7 moves the pair of centering bearings 402 toward the center, the outer surfaces of the retention members 404 on the centering bearing 402 abut the end faces of the plate P on both sides, thereby positioning the plate P in the center of the attachment member 42 (step S52). The plate P, the punchers 41, and the retention members 404 as illustrated in FIG. 25A are in this state.

Figure 25B:
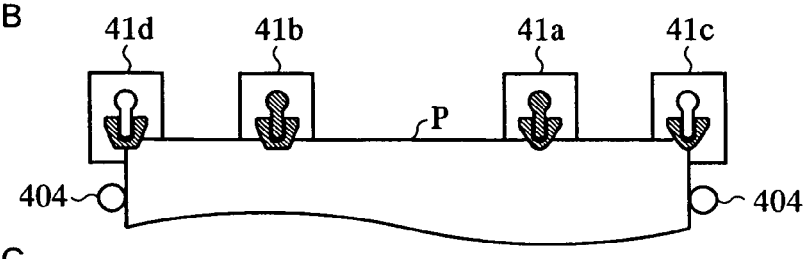
FIG. 25B is a schematic view showing a second stage of the positioning operation for a medium-width plate.

Next, the electrical circuitry section 7 moves the punches 44 provided in the punchers 41*a* to 41*d* down to protrude into the inlets 45, so as to punch a notch in a portion of the plate P lying immediately under the punches 44 (step S53). The punch 44*a* of the puncher 41*a* punches a portion of the plate P, whereby a positioning notch having a depth of n is formed at one end of the plate P. The deepest portion of the positioning notch thus formed has a circular arc shape. Similarly, the punch 44*b* of the puncher 41*b* punches a portion of the plate P, whereby a positioning notch having a depth of n is formed at one end of the plate P. The deepest portion of the positioning notch thus formed has a linear shape. Two corners at one end of the plate P lie immediately under the respective punches 44 of the punchers 41*c* and 41*d* due to the lateral width L of the plate P satisfying $(L2+\alpha)>L\geqq(L2-\alpha)$. Thus, notches are formed in the vicinity of the two corners at one end of the plate P by the action of the punchers 41*c* and 41d. The plate P, the punchers 41, and the retention members 404 as illustrated in FIG. 25B are in this state.

Figure 25C:
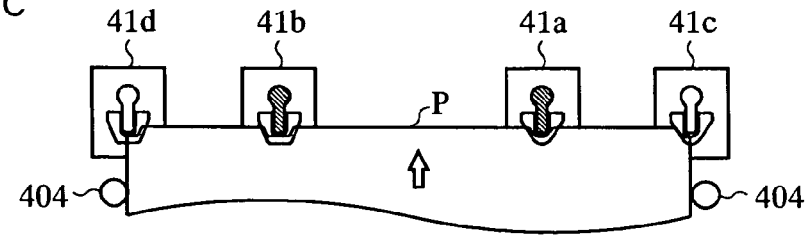
FIG. 25C is a schematic view showing a third stage of the positioning operation for a medium-width plate.

Next, the electrical circuitry section 7 moves the punches 44 provided in the punchers 41*a* to 41*d* up so as to retract from the inlets 45 (step S54). The electrical circuitry section 7 causes the plate P to be sent across the lower tray 22 based on the rotations of the transportation roller 25 and the feed roller 24, such that one end of the plate P is further inserted toward the back end of the inlets 45 (step S55). The plate P can be further inserted toward the back end of the inlets 45 by the depth of the notch formed by the punches 44 of the punchers 41*a* and 41*b* although the stopper pins 47 provided in the punchers 41*a* and 41*b* are protruding into the inlets 45. Specifically, the tips of the stopper pins 47 provided in the punchers 41*a* and 41*b* abut the deepest portions of the positioning notches formed at one end of the plate P, whereby the plate P is further inserted toward the back end of the inlets 45 by the depth (i.e., n) of the positioning notch. The plate P, the punchers 41, and the retention members 404 as illustrated in FIG. 25C are in this state.

Figure 25D:
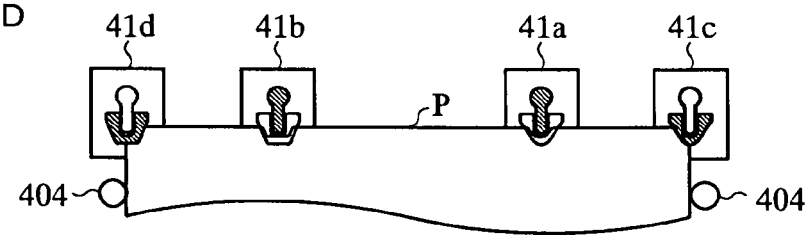
FIG. 25D is a schematic view showing a fourth stage of the positioning operation for a medium-width plate.

Next, the electrical circuitry section 7 moves the punches 44 provided in the punchers 41*c* and 41*d* down to protrude into the inlets 45, so as to further punch a notch in a portion of the plate P lying immediately under the punches 44 (step S56). The notches formed at step S53 in the vicinity of the two corners at one end of the plate P lie immediately under the punches 44 of the punchers 41*c* and 41*d* due to the lateral width L of the plate P satisfying $(L2+\alpha)>L\geqq(L2-\alpha)$. Thus, deeper notches are formed in the vicinity of the two corners at one end of the plate P by the action of the punchers 41*c* and 41*d*. The notches thus formed function as non-contacting notches. For example, in the case where a notch having a depth of n is formed at step S53 in the vicinity of a corner of one end of the plate P, a non-contacting notch having a depth of 2n is formed at step S56. Note that the positioning notches formed at step S53 remain the same because the punchers 41*a* and 41*b* do not operate. The plate P, the punchers 41, and the retention members 404 as illustrated in FIG. 25D are in this state.

Figure 25E:
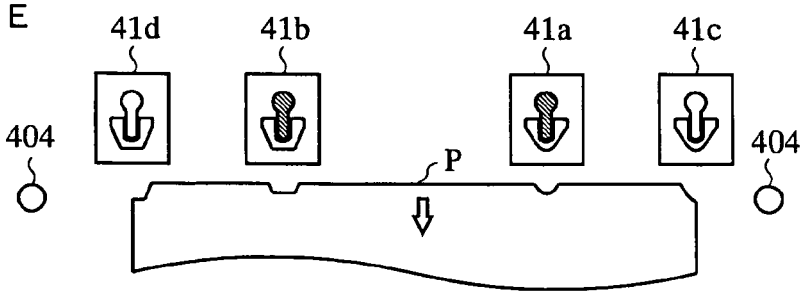
FIG. 25E is a schematic view showing a fifth stage of the positioning operation for a medium-width plate.

Next, the electrical circuitry section 7 moves the punches 44 provided in the punchers 41*c* and 41*d* to retract from the inlets 45 (step S57). When the electrical circuitry section 7 moves the centering bearings 402 outward, the retention members 404 move away from the end faces of the plate P on both sides, thereby releasing the plate P (step S58). The electrical circuitry section 7 causes the punched plate P to travel backward along the first supply path line from the punch unit 4 to the storage/transportation mechanism 2 so as to accommodate the plate P again into the lower tray 22 (step S59; see FIG. 12). The plate P, the punchers 41, and the retention members 404 as illustrated in FIG. 25E are in this state.

Figure 25F:
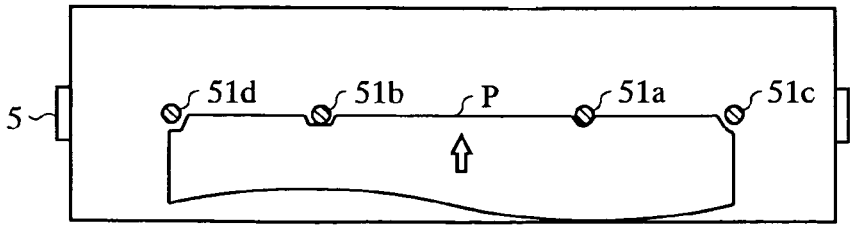
FIG. 25F is a schematic view showing a sixth stage of the positioning operation for a medium-width plate.

Next, the electrical circuitry section 7 moves the storage/transportation mechanism 2 from the upper position to the lower position, and the storage/transportation mechanism 2 is halted at the lower position (step S60; see FIG. 13). The plate P is sent off the lower tray 22 toward the recording drum 5, along the second supply path line, by the electrical circuitry section 7 (step S61; see FIG. 14). The plate P thus sent-off is positioned with respect to the recording drum 5 as two positioning notches formed at one end of the plate P fit with the positioning pins 51*a* and 51*b* (step S62). Note that the plate P is not in contact with the positioning pins 51*c* and 51*d* disposed in the vicinity of the corners of one end of the plate P due to the non-contacting notches, which are deeper than the positioning notches receiving the positioning pins 51*a* and 51*b*, formed in the vicinity of the corners of one end of the plate P. Thus, the plate P is positioned in place with respect to the recording drum 5 based on the positioning pins 51*a* and 51*b*, whereby stable positioning can be realized. The plate P, the recording drum 5, and the positioning pins 51 as illustrated in FIG. 25F are in this state. The process for mounting the plate P thus positioned on the recording drum 5 is the same as the process described above regarding FIGS. 15 and 16, and the descriptions thereof are omitted. Then, the electrical circuitry section 7 ends the process of the subroutine.

Figure 26A:
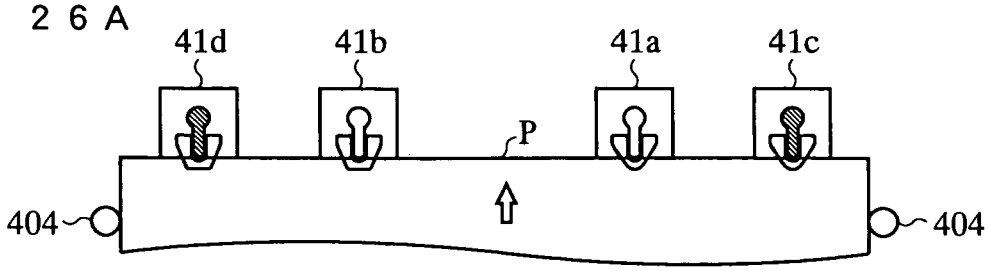
FIG. 26A is a schematic view showing a first stage of a positioning operation for a long-width plate.

Next, referring to FIGS. 23, 26A to 26F, 27A to 27D, and 28A to 28C, the positioning process for a long-width plate P at step S7 will be described. Firstly, the electrical circuitry section 7 moves the stopper pins 47 provided in the punchers 41*c* and 41*d* down so as to protrude into the inlets 45 (step S70; the state illustrated in FIG. 27A). The electrical circuitry section 7 causes the plate P to be sent across the lower tray 22 in the direction of the transportation roller 25 based on the rotation of the feed roller 24, and then sent onto the first supply path line. As a result, one end of the plate P is inserted in the inlets 45 of the punchers 41*a* to 41*d*. The one end face of the plate P thus inserted comes in contact with the tips of the stopper pins 47 (step S71; see FIGS. 11 and 27B). When the electrical circuitry section 7 moves the pair of centering bearings 402 toward the center, the outer surfaces of the retention members 404 on the centering bearing 402 abut the end faces of the plate P on both sides, thereby positioning the plate P in the center of the attachment member 42 (step S72). The plate P, the punchers 41, and the retention members 404 as illustrated in FIG.26A are in this state.

Figure 26B:
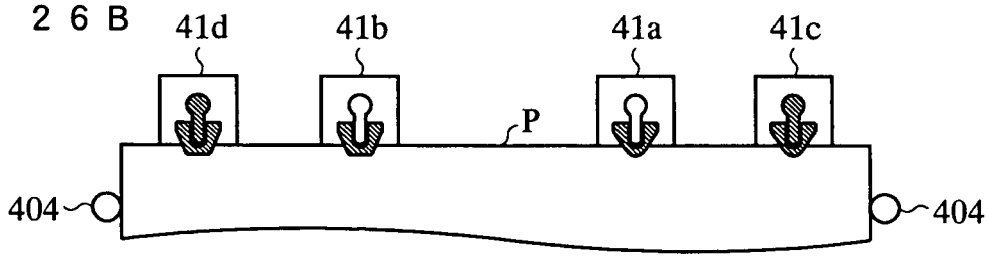
FIG. 26B is a schematic view showing a second stage of the positioning operation for a long-width plate.
Figure 27A:
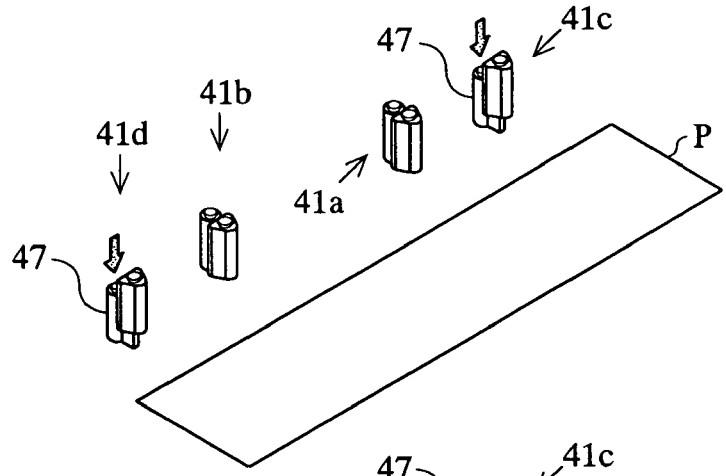
FIG. 27A is a schematic perspective view showing a first stage of the first half of an operation for forming a notch along one end face of the plate P when a long-width plate is positioned.
Figure 27B:
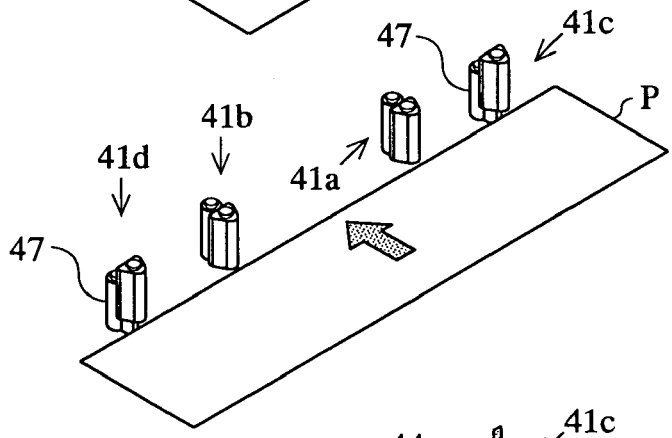
FIG. 27B is a schematic perspective view showing a second stage of the first half of the operation for forming a notch along one end face of the plate P when the long-width plate is positioned.
Figure 27C:
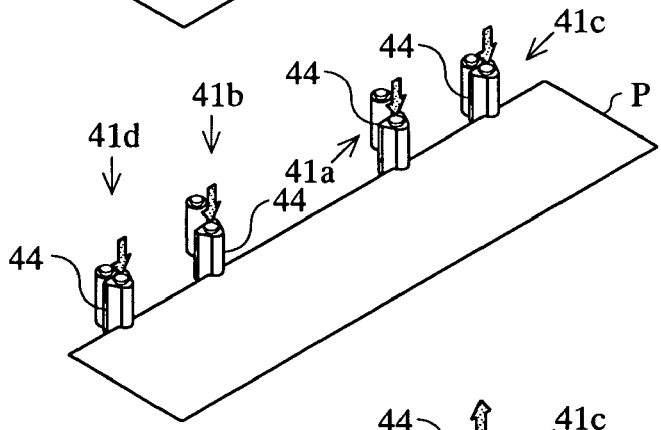
FIG. 27C is a schematic perspective view showing a third stage of the first half of the operation for forming a notch along one end face of the plate P when the long-width plate is positioned.
Figure 28A:
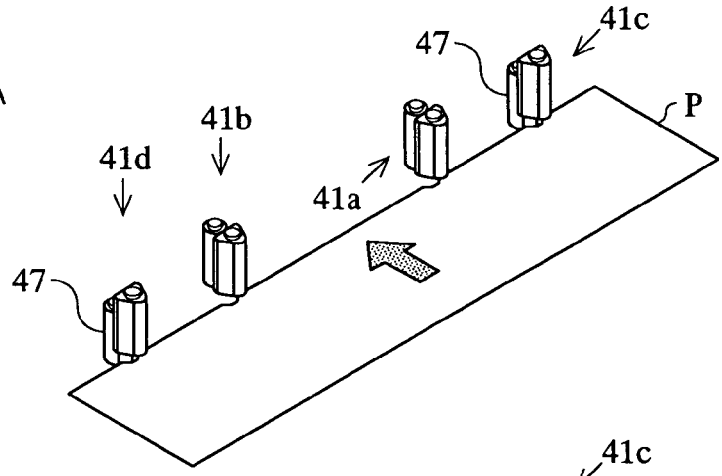
FIG. 28A is a schematic perspective view showing a fifth stage of the last half of the operation for forming a notch along one end face of the plate P when the long-width plate is positioned.
Figure 28B:
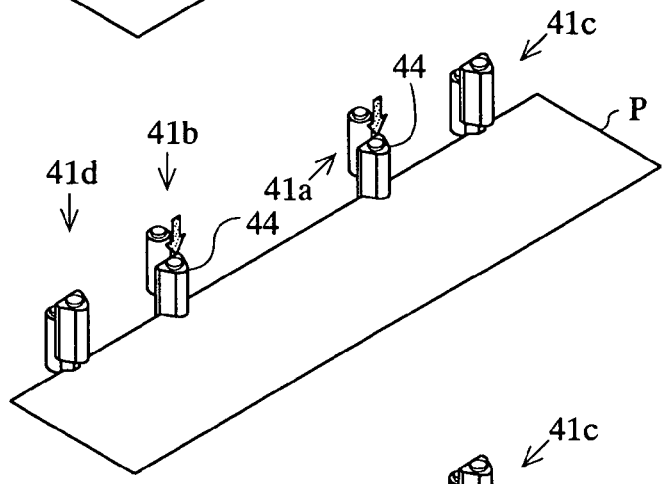
FIG. 28B is a schematic perspective view showing a sixth stage of the last half of the operation for forming a notch along one end face of the plate P when the long-width plate is positioned.
Figure 28C:
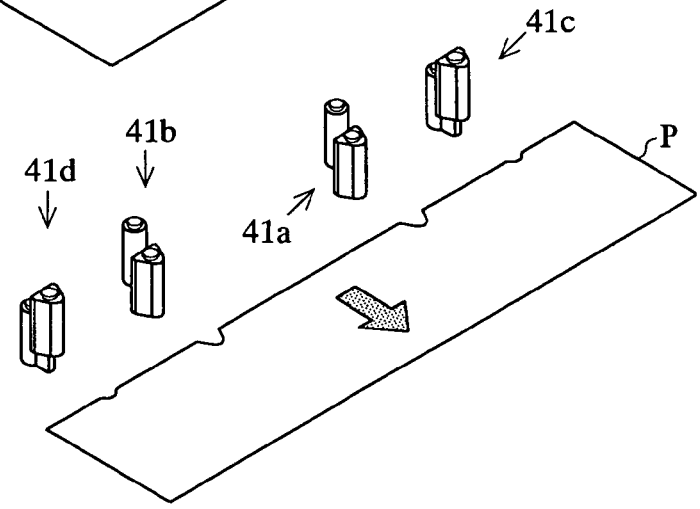
FIG. 28C is a schematic perspective view showing a seventh stage of the last half of the operation for forming a notch along one end face of the plate P when the long-width plate is positioned.

Next, the electrical circuitry section 7 moves the punches 44 provided in the punchers 41*a* to 41*d* down to protrude into the inlets 45, so as to punch a notch in a portion of the plate P lying immediately under the punches 44 (step S73; see FIG. 27C). Note that the plate P lies immediately under the punches 44 of the punchers 41*a* to 41*d* due to the lateral width L of the plate P satisfying $L \geqq (L2+\alpha)$. The punch 44*a* of the puncher 41*c* punches a portion of the plate P, whereby a positioning notch having a depth of n is formed at one end of the plate P. The deepest portion of the positioning notch thus formed has a circular arc shape. Similarly, the punch 44*b* of the puncher 41*d* punches a portion of the plate P, whereby a positioning notch having a depth of n is formed at one end of the plate P. The deepest portion of the positioning notch thus formed has a linear shape. In other words, in the case where the lateral width L satisfies $L \geqq (L2+\alpha)$, positioning notches are formed in the plate P by the punchers 41*c* and 41*d* disposed in the respective outermost positions. Furthermore, the punch 44*a* of the puncher 41*a* punches a portion of the plate P, whereby a notch having a depth of n is formed at one end of the plate P. The deepest portion of the notch thus formed has a circular arc shape. Also, the punch 44*b* of the puncher 41*b* punches a portion of the plate P, whereby a notch having a depth of n is formed at one end of the plate P. The deepest portion of the notch thus formed has a linear shape. The plate P, the punchers 41, and the retention members 404 as illustrated in FIG. 26B are in this state.

Figure 26C:
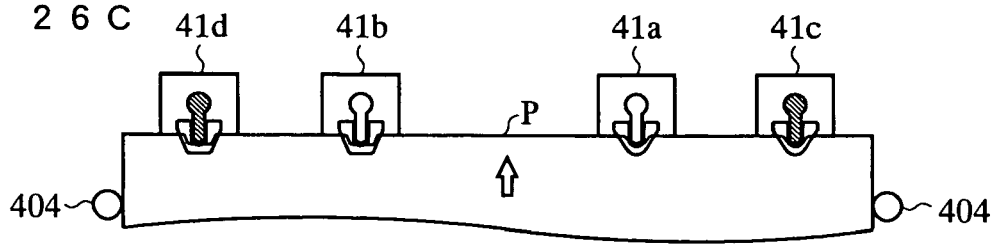
FIG. 26C is a schematic view showing a third stage of the positioning operation for a long-width plate.
Figure 27D:
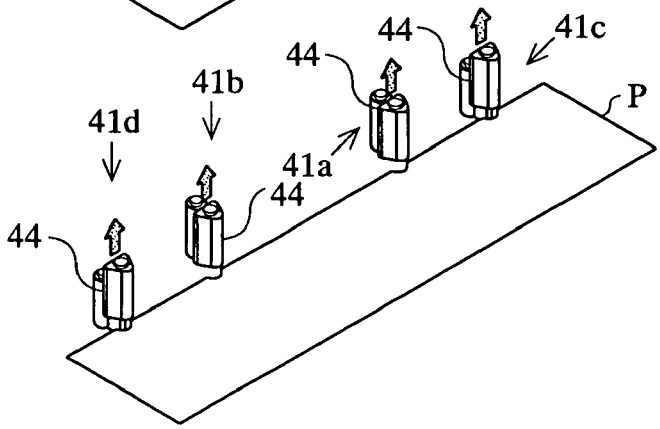
FIG. 27D is a schematic perspective view showing a fourth stage of the first half of the operation for forming a notch along one end face of the plate P when the long-width plate is positioned.

Next, the electrical circuitry section 7 moves the punches 44 provided in the punchers 41*a* to 41*d* up so as to retract from the inlets 45 (step S74; see FIG. 27D). The electrical circuitry section 7 causes the plate P to be sent across the lower tray 22 based on the rotations of the transportation roller 25 and the feed roller 24, such that one end of the plate P is further inserted toward the back end of the inlets 45 (step S75). The plate P can be further inserted toward the back end of the inlets 45 by the depth of the notch formed by the punches 44 of the punchers 41*c* and 41*d* although the stopper pins 47 provided in the punchers 41*c* and 41*d* are protruding into the inlets 45. Specifically, the tips of the stopper pins 47 provided in the punchers 41*c* and 41*d* abut the deepest portions of the positioning notches formed at one end of the plate P, whereby the plate P is further inserted toward the backend of the inlets 45 by the depth (i.e., n) of the positioning notch (see FIG. 28A). The plate P, the punchers 41, and the retention members 404 as illustrated in FIG. 26C are in this state.

Figure 26D:
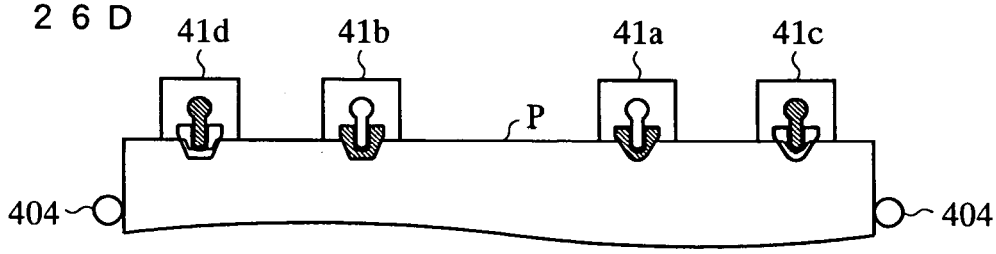
FIG. 26D is a schematic view showing a fourth stage of the positioning operation for a long-width plate.

Next, the electrical circuitry section 7 moves the punches 44 provided in the punchers 41*a* and 41*b* down to protrude into the inlets 45, so as to further punch notches in a portion of the plate P lying immediately under the punches 44 (step S76; see FIG. 28B). The notches formed at step S73 in positions close to the center of the plate P lie immediately under the punches 44 of the punchers 41*a* and 41*b*. Thus, deeper notches are formed in the same positions close to the center of the plate P by the action of the punchers 41*a* and 41*b*. The notches thus formed function as a non-contacting notch. For example, in the case where a notch having a depth of n is formed at step S73 in a position close to the center of the plate P, a non-contacting notch having a depth of 2n is formed at step S76. Note that the positioning notches formed at step S73 remain the same because the punchers 41*c* and 41*d* do not operate. The plate P, the punchers 41, and the retention members 404 as illustrated in FIG.26D are in this state.

Figure 26E:
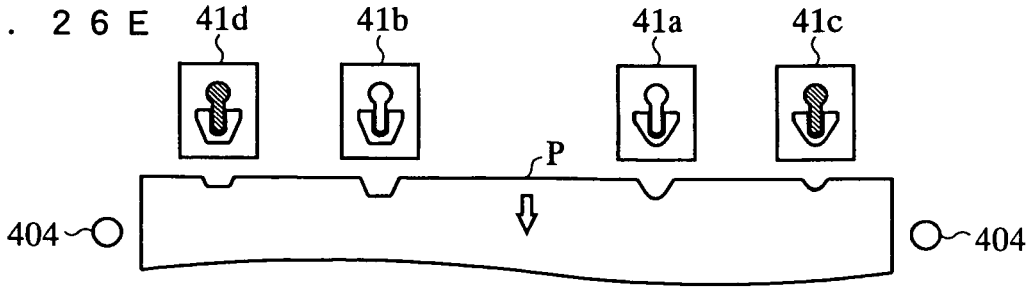
FIG. 26E is a schematic view showing a fifth stage of the positioning operation for a long-width plate.

Next, the electrical circuitry section 7 moves the punches 44 provided in the punchers 41*a* and 41*b* up so as to retract from the inlets 45 (step S77). When the electrical circuitry section 7 moves the centering bearings 402 outward, the retention members 404 move away from the end faces of the plate P on both sides, thereby releasing the plate P (step S78). The electrical circuitry section 7 causes the punched plate P to travel backward along the first supply path line from the punch unit 4 to the storage/transportation mechanism 2 so as to accommodate the plate P again into the lower tray 22 (step S79; see FIGS. 12 and 28C). The plate P, the punchers 41, and the retention members 404 as illustrated in FIG. 26E are in this state.

Figure 26F:
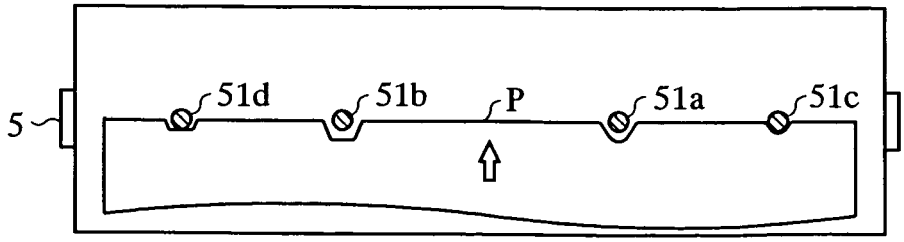
FIG. 26F is a schematic view showing a sixth stage of the positioning operation for a long-width plate.

Next, the electrical circuitry section 7 causes the storage/transportation mechanism 2 to move from the upper position to the lower position, and the storage/transportation mechanism 2 is halted at the lower position (step S80; see FIG. 13). The plate P is sent off the lower tray 22 toward the recording drum 5, along the second supply path line, by the electrical circuitry section 7 (step S81; see FIG. 14). The plate P thus sent-off is positioned with respect to the recording drum 5 as two positioning notches formed at one end of the plate P fit with the positioning pins 51*c* and 51*d* (step S82). Note that the plate P is not in contact with the positioning pins 51*a* and 51*b* disposed in the positions close to the center of the plate P due to the non-contacting notches, which are deeper than the positioning notches receiving the positioning pins 51*c* and 51*d*, formed in the positions close to the center of the plate P. Thus, the plate P is positioned in place with respect to the recording drum 5 based on the positioning pins 51*c* and 51*d*, whereby stable positioning can be realized. The plate P, the recording drum 5, and the positioning pins 51 as illustrated in FIG. 26F are in this state. The process for mounting the plate P thus positioned on the recording drum 5 is the same as the process described above regarding FIGS. 15 and 16, and the descriptions thereof are omitted. Then, the electrical circuitry section 7 ends the process of the subroutine.

As such, according to the present cylindrical outer surface scanning apparatus, a plate having a relatively short lateral width is positioned on the recording drum 5 by fitting two central positioning pins which are disposed with a relatively short pitch therebetween into corresponding positioning notches while preventing contact with two positioning pins disposed on the opposite ends of the plate by providing a non-contacting notch, if necessary. Also, a plate having a relatively long lateral width is positioned on the recording drum 5 by fitting two positioning pins which are disposed on the opposite ends with a relatively long pitch therebetween into corresponding positioning notches, while preventing contact with central positioning pins by providing a non-contacting notch. In order to realize such a positioning method, it is necessary to appropriately form a positioning notch and a non-contacting notch along one end of the plate depending on a lateral width thereof. As aforementioned, each of a plurality of punchers provided in the cylindrical outer surface scanning apparatus can punch both a positioning notch and a non-contacting notch, selectively, along one end of a plate, whereby it is possible to realize the above-described positioning method in a suitable manner.

Also, according to the cylindrical outer surface scanning apparatus of the present invention, each of a plurality of punchers can form both a positioning notch and a non-contacting notch along one end of a plate, thereby eliminating the need of causing a particular positioning pin to always abut the plate for positioning. Thus, it is possible to provide greater flexibility in layout of the plate to be mounted on the recording drum. For example, it is possible to mount two plates along the cylindrical axis in parallel on one recording drum. In other words, a plurality of punchers provided in the cylindrical outer surface scanning apparatus of the present invention can form various notches along one end of a plate depending on a positioning method. Thus, plates having a broad range of lateral widths can be stably positioned on the recording drum on the basis of two positioning pins with an appropriate pitch therebetween.

Figure 29:
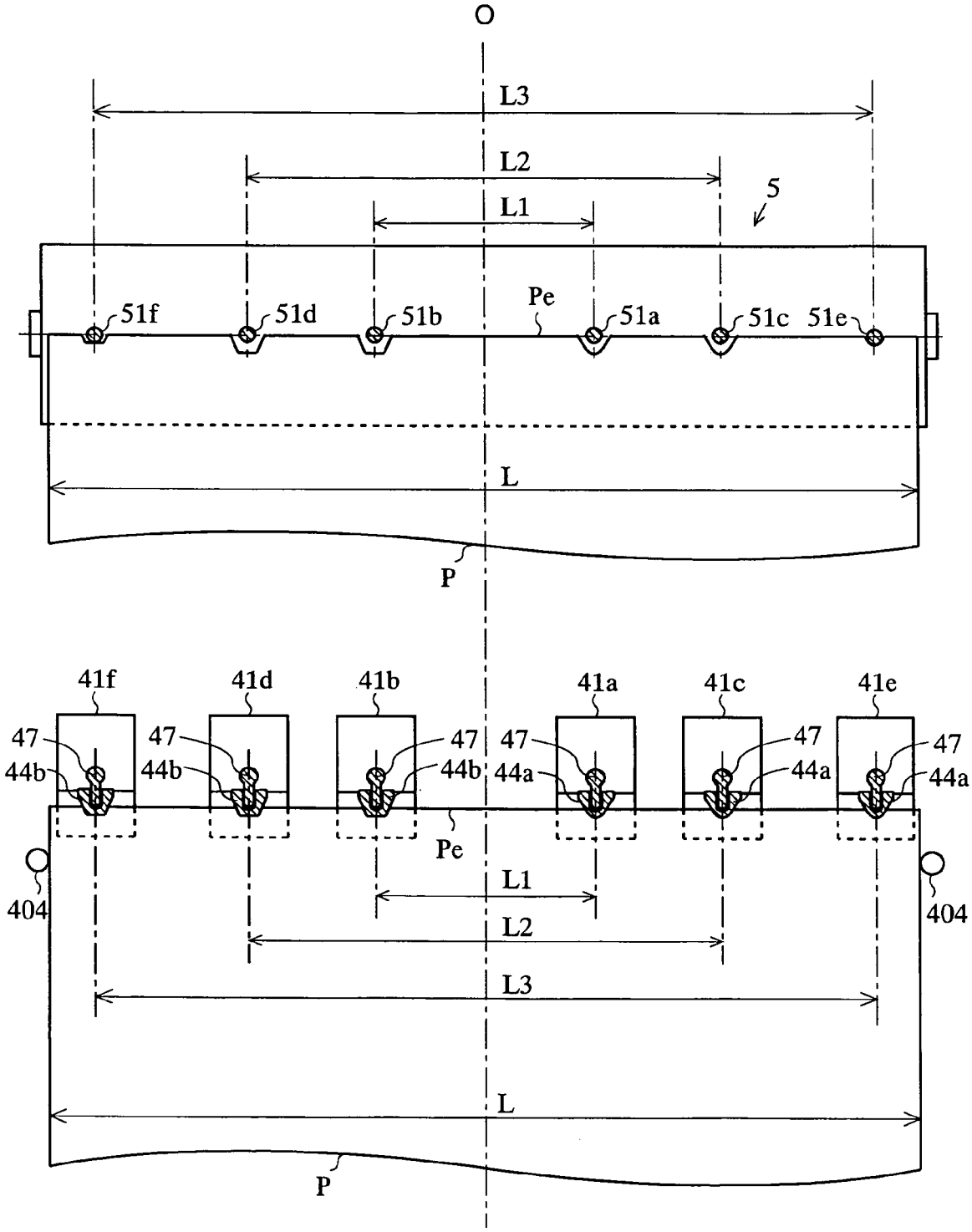
FIG. 29 shows one variant in which additional two punchers 41*e* and 41*f* are respectively provided at the outer side of the punchers 41*c* and 41*d;*

In the present example, four punchers are used in combination with four positioning pins so that a plate is positioned in place depending on a lateral width thereof, the present invention is not limited thereto. For example, as shown in FIG. 29, additional two punchers 41*e* and 41*f* are provided at the outer sides of the punchers 41*c* and 41*d*, respectively, in such a manner that the punchers 41*e* and 41*f* are disposed with a distance L3 (L3>L2) therebetween so as to be centered with respect to a centering reference O. Also, two positioning pins 51*e* and 51*f* are fixed on the recording drum 5 at the outer sides of the positioning pins 51*c* and 51*d*, in such a manner that the positioning pins 51*e* and 51*f* are disposed with a distance L3 therebetween so as to be centered with respect to a centering reference O. As such, the use of the additional punchers 41*e* and 41*f* in combination with the positioning pins 51*e* and 51*f* enables stable positioning of a plate having a greater lateral width.

In another example, it would be possible to position a plate in place depending on a lateral width thereof by using three punchers in combination with three positioning pins. As shown in FIGS. 30A to 30D, three positioning pins 51*a* to 51*c* are fixed on the recording drum 5 in the order of 51*a*, 51*b*, and 51*c* from right to left. The punchers 41*a* to 41*c* (not shown) are provided so as to correspond to the positioning pins 51*a* to 51*c* as described above.

Figure 30A:
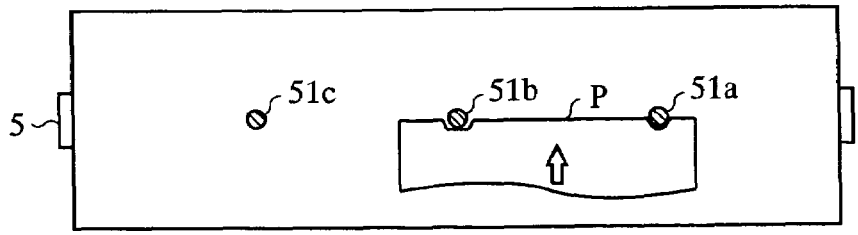
FIG. 30A is a schematic view showing a first stage of a positioning operation in another variant in which the plate P is positioned on the recording drum 5 to which three positioning pins 51*a* to 51*c* are secured.

As shown in FIG. 30A, in the case where a short-width plate P is positioned in place with respect to the recording drum 5, the punchers 41*a* and 41*b* operate to form positioning notches in the plate P. The positioning pins 51*a* and 51*b* fit in the corresponding positioning notches formed in the plate P, thereby positioning the plate P in place with respect to the recording drum 5.

Figure 30B:
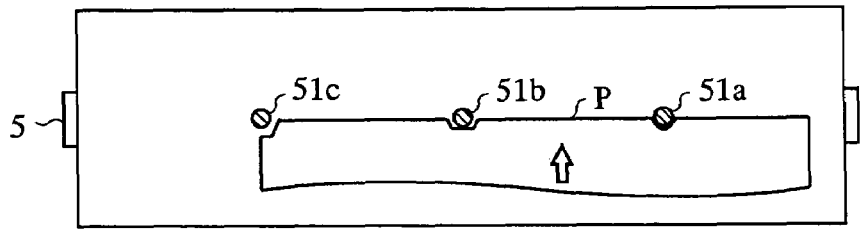
FIG. 30B is a schematic view showing a second stage of the positioning operation in another variant in which the plate P is positioned on the recording drum 5 to which three positioning pins 51*a* to 51*c* are secured.

As shown in FIG. 30B, in the case where a medium-width plate P is positioned in place with respect to the recording drum 5, the punchers 41*a* and 41*b* operate to form positioning notches in the plate P, whereas the puncher 41*c* operates to form a non-contacting notch in the plate P. The positioning pin 51*a* and 51*b* fit in the corresponding positioning notches formed in the plate P, thereby positioning the plate P in place with respect to the recording drum 5.

Figure 30C:
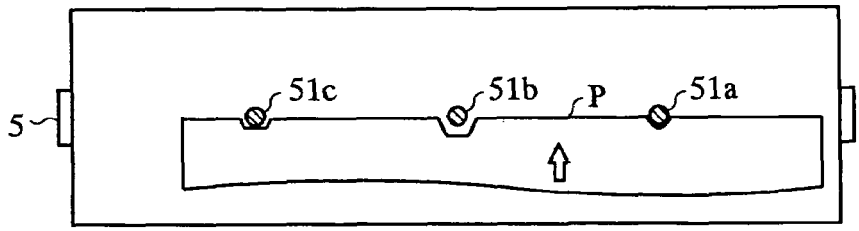
FIG. 30C is a schematic view showing a third stage of the positioning operation in another variant in which the plate P is positioned on the recording drum 5 to which three positioning pins 51*a* to 51*c* are secured.

As shown in FIG. 30C, in the case where a long-width plate P is positioned in place with respect to the recording drum 5, the punchers 41*a* and 41*c* operate to form positioning notches in the plate P, whereas the puncher 41*b* operates to form a non-contacting notch in the plate P. The positioning pins 51*a* and 51*c* fit in the corresponding positioning notches formed in the plate P, thereby positioning the plate P in place with respect to the recording drum 5.

Figure 30D:
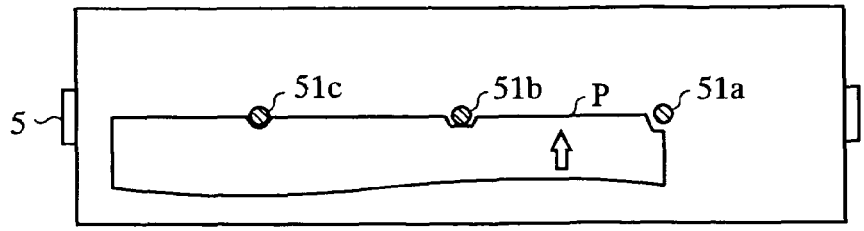
FIG. 30D is a schematic view showing a fourth stage of the positioning operation in another variant in which the plate P is positioned on the recording drum 5 to which three positioning pins 51*a* to 51*c* are secured.
Figure 31:
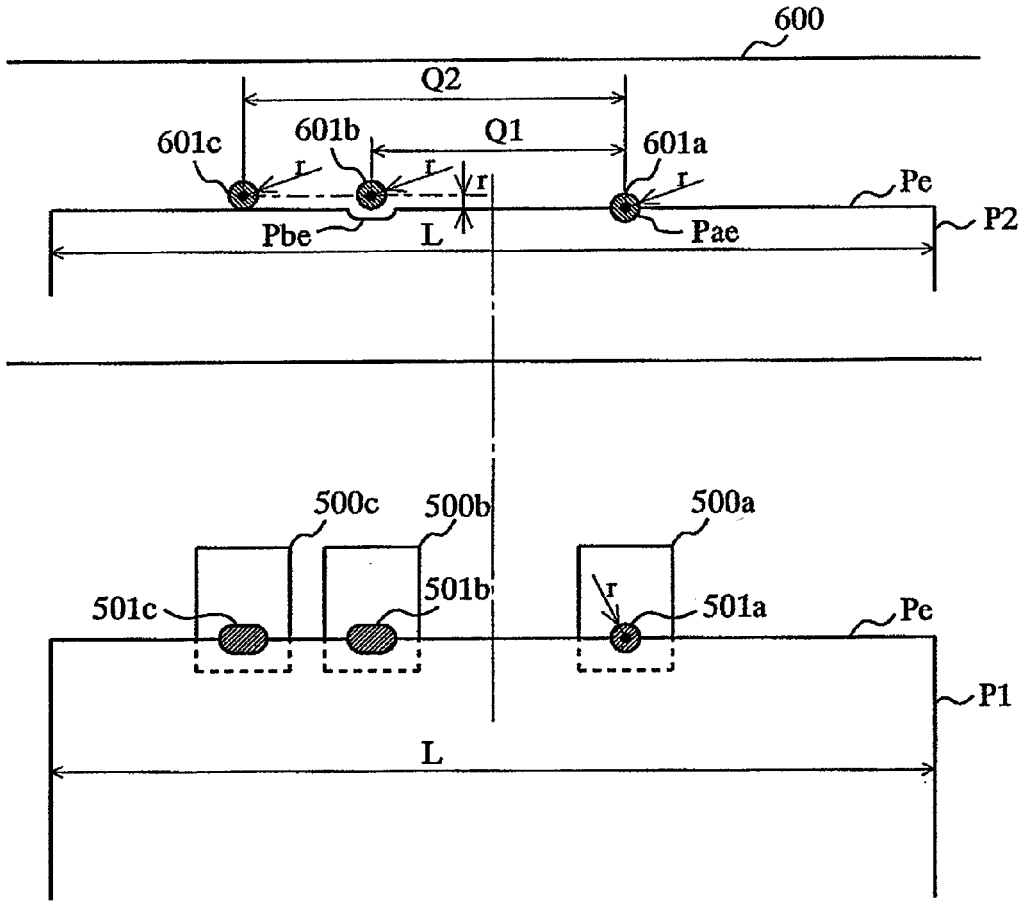
FIG. 31 PRIOR ART
FIG. 31 is a schematic view for describing an outline of a plate positioning method employed in a conventional cylindrical outer surface scanning apparatus.

Alternatively, the medium-width plate P may be positioned in place with respect to the recording drum 5 in a manner as shown in FIG. 30D. In this case, the punchers 41*b* and 41*c* operate to form positioning notches in the plate P, whereas the puncher 41*a* operates to form a non-contacting notch in the plate P. The positioning pins 51*b* and 51*c* fit in the corresponding positioning notches formed in the plate P, thereby positioning the plate P in place with respect to the recording drum 5.

As aforementioned, the apparatus disclosed in Japanese Laid-Open Patent Publication No. 2002-341561 and described in the Related Art Statement causes one of the two positioning pins 51 abutting the end face Pe of a plate P to be contact not with a notch, but with the end face Pe itself. Such a positioning method may reduce positioning accuracy of the plate P compared to the case where positioning is performed by abutting two positioning holes with the two positioning pins. Unlike the above method, if at least one puncher of the three punchers 41*a*, 41*b*, and 41*c* cited in conjunction with FIGS. 30A to 30D as described above, that is, at least the puncher 41*b* disposed in the center of the plate P along the lateral width direction thereof can perform selective notch formation, it is possible to position a short-width plate and a long-width plate by using two notches. Furthermore, if not only the puncher 41*b* but also the puncher 41*c* can perform selective notch formation, it is possible to form a non-contacting notch for preventing contact with the positioning pin 51*c*, whereby a medium-width plate as well as the short-width plate and the long-width plate can be positioned by using two positioning notches. In either of the above two cases, positioning accuracy is increased compared to the apparatus disclosed in Japanese Laid-Open Patent Publication No. 2002-341561. Moreover, as described by using FIG. 30D, the use of the punchers 41*a*, 41*b*, and 41*c* capable of performing selective notch formation eliminates the need for a particular positioning pin to be always used. Thus, it is possible to provide greater flexibility in layout of the plate P to be mounted on the recording drum 5.

As such, the puncher of the cylindrical outer surface scanning apparatus of the present invention is particularly effective in positioning a plate in place by using three or more positioning members.

In the above-described embodiment, a puncher re-punches a punched plate by moving it until a notch formed thereon comes in contact with a movable stopper pin, thereby forming a positioning notch and a non-contacting notch which are different in depth along one end of the plate. The followings are further examples for realizing the present invention.

As a first example, the punch 44 punches a hole in a plate whose one end face is in contact with the stopper member 48 (see FIGS. 17A and 17B and 18A and 18B) provided at the back end of the inlet 45, thereby forming a non-contacting notch having a depth (i.e., m+n) deeper than a positioning notch along one end of the plate.

As a second example, after the puncher punches a hole in a plate with the punch 44, the puncher itself moves until the notch thus formed comes in contact with the stopper pin 47, and re-punches the punched plate. In this case, it is possible to form a notch similar to the non-contacting notch as described above along one end of the plate.

As a third example, a plurality of punches are provided in one puncher such that a relatively shallow notch (positioning notch) and a relatively deep notch (non-contacting notch) are formed by one puncher. Alternatively, a plurality of punchers, each of which is capable of forming a relatively shallow notch (positioning notch) or a relatively deep notch (non-contacting notch), are provided. In either of the above two cases, it is possible to form a desired notch along one end of a plate by appropriately selecting a punch or a puncher to be used for forming a notch of the plate.

As a fourth example, the stopper pin 47 provided in the puncher 41 is fixed so as to protrude into the inlet 45. In the case where the above-described movable stopper pin 47 is used, it is possible to form a notch in a more accurate manner by utilizing the stopper pin 47 corresponding to a positioning pin 51 to be used for positioning as a punching reference. In the case where such an effect is not expected, the stopper pins 47 provided in the punchers 41*a* and 41*b* are fixed so as to protrude into the inlets 45, whereas no stopper pin 47 is provided in the punchers 41*c* and 41d, for example. Thus, it is possible to realize the present invention by an inexpensive puncher.

As shown in FIGS. 18A and 18B, the punch 44*b* has a cross section wherein the tip thereof, which faces an opening of the inlet 45, has a linear shape and is perpendicular to the first supply path line. In other words, the punch 44*b* has a cross section in the shape of a trapezoid whose shorter base faces the opening of the inlet 45. When the punch 44*b* punches one end face of the plate, a notch having the shape of a trapezoid whose longer base corresponds to the opening of the notch is formed. Thus, it is possible to change not only a depth of a notch but also a lateral width thereof depending on a depth by which a plate to be punched is inserted in the inlet 45. As a result, it is possible to realize a punch capable of forming a notch flexibly receiving positioning pins of different radii.

As above, the present example illustrates the case where the positioning pins 51 to be fixed on the recording drum 5 are arranged so as to be on a single line, but the present invention is not limited thereto. Depending on a position or a direction of a plate to be mounted, a predetermined positioning pin 51 may not be on a single line, or may be obliquely disposed with respect to the cylindrical axis of the recording drum 5. In this case, the present invention can be applied to the positioning method (i.e., abutting one end face of a plate with two positioning pins by changing a tilt of the plate depending on the width thereof) employed in the apparatus disclosed in U.S. Pat. No. 6,321,651, which has been described in the Related Art Statement.

In the present example, at least two positioning notches are formed along one end of a plate, so that the positioning notches are fitted with respective two positioning pins, but the present invention is not limited thereto. For example, it would be possible to form only one positioning notch along one end of a plate. In this case, the positioning of the plate can be realized by fitting the one positioning pin in the positioning notch and abutting another positioning pin with one end face of the plate.

While the invention has been described in detail, the foregoing description is in all aspects illustrative and not restrictive. It is understood that numerous other modifications and variations can be devised without departing from the scope of the invention.

What is claimed is:

1. An image recording apparatus for recording an image on a sheet-shaped image recording material mounted thereon, comprising:

a mounting member having a predetermined mounting surface on which the image recording material is mounted;

a first positioning member fixed on the mounting surface of the mounting member;

a second positioning member fixed on the mounting surface of the mounting member and located at a first pitch from the first positioning member with respect to a predetermined direction;

a third positioning member fixed on the mounting surface of the mounting member and located at a second pitch from the first positioning member with respect to the predetermined direction, so that the third positioning member is further away from the first positioning member than the second positioning member, the second pitch being greater than the first pitch;

a first notch forming section for forming, along one end of the image recording material, either a positioning notch to be fitted with the first positioning member or a non-contacting notch for preventing the first positioning member from coming in contact with the image recording material, the non-contacting notch being deeper than the positioning notch;

a second notch forming section located at the first pitch from the first notch forming section, the second notch forming section for forming, along one end of the image recording material, either a positioning notch to be fitted with the second positioning member or a non-contacting notch for preventing the second positioning member from coming in contact with the image recording material, the non-contacting notch being deeper than the positioning notch;

a third notch forming section located at the second pitch from the first notch forming section, the third notch forming section for forming, along one end of the image recording material, either a positioning notch to be fitted with the third positioning member or a non-contacting notch for preventing the third positioning member from coming in contact with the image recording material, the non-contacting notch being deeper than the positioning notch; and a mounting mechanism for mounting the image recording material, in which the notches are formed by any of the first, second, and third notch forming sections, on the mounting surface of the mounting member by using any two of the first, second, and third positioning members as positioning references.

2. The image recording apparatus according to claim 1, wherein each of the first, second, and third notch forming sections includes:

a punch member for forming a notch by punching one end of the image recording material in an up and down motion; and a contact member for determining where the image recording material is punched by the punch member by coming in contact with the image recording material, wherein, when the positioning notch is formed, each of the first, second, and third notch forming sections punches the image recording material by the punch member with the contact member being in contact with one end of the image recording material, and wherein, when the non-contacting notch is formed, each of the first, second, and third notch forming sections punches the image recording material by the punch member with the contact member being in contact with a deepest portion of the notch formed along one end of the image recording material by the punch member.

3. The image recording apparatus according to claim 2, wherein each of the first, second, and third notch forming sections includes a contact member moving section for moving the contact member between a position where the contact member is in contact with the image recording material and a position where the contact member is retracted from said position so as not to be in contact with the image recording material.

4. The image recording apparatus according to claim 2, wherein each of the first, second, and third notch forming sections includes the punch member and the contact member arranged on a single line parallel to a direction in which the image recording material to be punched is inserted.

5. The image recording apparatus according to claim 1, wherein any one of the first, second, and third notch forming sections forms the non-contacting notch along one end of the image recording material, and the remaining notch forming sections form the positioning notches along one end of the image recording material.

6. The image recording apparatus according to claim 1, further comprising:

a fourth positioning member fixed on the mounting surface of the mounting member and located at a third pitch from the first positioning member with respect to the predetermined direction, so that the fourth positioning member is further away from the first positioning member than the third positioning member, the third pitch being greater than the second pitch; and a fourth notch forming section located at the third pitch from the first notch forming section, the fourth notch forming section for forming, along one end of the image recording material, either a positioning notch to be fitted with the fourth positioning member or a non-contacting notch for preventing the fourth positioning member from coming in contact with the image recording material, the non-contacting notch being deeper than the positioning notch, wherein any two of the first, second, third, and fourth notch forming sections form the non-contacting notches along one end of the image recording material, and the remaining notch forming sections form the positioning notches along one end of the image recording material, wherein the mounting mechanism mounts the image recording material, in which the notches are formed by the first, second, third, and fourth notch forming sections, on the mounting surface of the mounting member by using any two of the first, second, third, and fourth positioning members as positioning references.

7. An image recording apparatus for recording an image on a sheet-shaped image recording material mounted thereon, comprising:

a mounting member having a predetermined mounting surface on which the image recording material is mounted;

a first positioning member fixed on the mounting surface of the mounting member;

a second positioning member fixed on the mounting surface of the mounting member and located at a first pitch from the first positioning member with respect to a predetermined direction;

a third positioning member fixed on the mounting surface of the mounting member and located at a second pitch from the first positioning member with respect to the predetermined direction, so that the third positioning member is further away from the first positioning member than the second positioning member, the second pitch being greater than the first pitch;

a first notch forming section for forming, along one end of the image recording material, a positioning notch to be fitted with the first positioning member;

a second notch forming section located at the first pitch from the first notch forming section, the second notch forming section for forming, along one end of the image recording material, either a positioning notch to be fitted with the second positioning member or a non-contacting notch for preventing the second positioning member from coming in contact with the image recording material, the non-contacting notch being deeper than the positioning notch;

a third notch forming section located at the second pitch from the first notch forming section, the third notch forming section for forming, along one end of the image recording material, a positioning notch to be fitted with the third positioning member; and a mounting mechanism for mounting the image recording material, in which the notches are formed by the first, second, and third notch forming sections, on the mounting surface of the mounting member by using the first and second positioning members as positioning references or using the first and third positioning members as positioning references.

8. The image recording apparatus according to claim 7, wherein the second notch forming section includes:

a punch member for forming a notch by punching one end of the image recording material in an up and down motion; and a contact member for determining where the image recording material is punched by the punch member by coming in contact with the image recording material, wherein, when the positioning notch is formed, the second notch forming section punches the image recording material by the punch member with the contact member being in contact with one end of the image recording material, and wherein, when the non-contacting notch is formed, the second notch forming section punches the image recording material by the punch member with the contact member being in contact with a deepest portion of the notch formed along one end of the image recording material by the punch member.

9. An image recording apparatus for recording an image on a sheet-shaped image recording material mounted thereon, comprising:

a mounting member having a predetermined mounting surface on which the image recording material is mounted; a first positioning member fixed on the mounting surface of the mounting member;

a second positioning member fixed on the mounting surface of the mounting member and located at a first pitch from the first positioning member with respect to a predetermined direction;

a third positioning member fixed on the mounting surface of the mounting member and located at a second pitch from the first positioning member with respect to the predetermined direction, so that the third positioning member is further away from the first positioning member than the second positioning member, the second pitch being greater than the first pitch;

a first notch forming section for forming, along one end of the image recording material, a positioning notch to be fitted with the first positioning member;

a second notch forming section located at the first pitch from the first notch forming section, the second notch forming section for forming, along one end of the image recording material, either a positioning notch to be fitted with the second positioning member or a non-contacting notch for preventing the second positioning member from coming in contact with the image recording material, the non-contacting notch being deeper than the positioning notch;

a third notch forming section located at the second pitch from the first notch forming section, the third notch forming section for forming, along one end of the image recording material, either a positioning notch to be fitted with the third positioning member or a non-contacting notch for preventing the third positioning member from coming in contact with the image recording material, the non-contacting notch being deeper than the positioning notch; and a mounting mechanism for mounting the image recording material, in which the notches are formed by the first, second, and third notch forming sections, on the mounting surface of the mounting member by using the first and second positioning members as positioning references or using the first and third positioning member as positioning references.

10. The image recording apparatus according to claim 9, wherein each of the second and third notch forming sections includes:

a punch member for forming a notch by punching one end of the image recording material in an up and down motion; and a contact member for determining where the image recording material is punched by the punch member by coming in contact with the image recording material, wherein, when the positioning notch is formed, each of the second and third notch forming sections punches the image recording material by the punch member with the contact member being in contact with one end of the image recording material, and wherein, when the non-contacting notch is formed, each of the second and third notch forming sections punches the image recording material by the punch member with the contact member being contact with a deepest portion of the notch formed along one end of the image recording material by the punch member.

* * * * *